US007318681B2

(12) United States Patent
Kato et al.

(10) Patent No.: US 7,318,681 B2
(45) Date of Patent: Jan. 15, 2008

(54) LABEL MAKING APPARATUS

(75) Inventors: Tsutomu Kato, Nagoya (JP); Tsuyoshi Nagae, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/384,287

(22) Filed: Mar. 21, 2006

(65) Prior Publication Data

US 2006/0222431 A1 Oct. 5, 2006

(30) Foreign Application Priority Data

Mar. 31, 2005 (JP) ..... 2005-100748

(51) Int. Cl.
*B41J 11/00* (2006.01)

(52) U.S. Cl. ..... 400/621; 400/615.2; 400/621.1

(58) Field of Classification Search ..... 400/219, 400/83, 615.2, 621, 621.1; 156/384, 350
See application file for complete search history.

(56) References Cited

U.S. PATENT DOCUMENTS 4,623,418 A * 11/1986 Gombrich et al. ..... 156/361
4,651,288 A * 3/1987 Zeising ..... 358/1.18
4,717,059 A * 1/1988 Takahashi ..... 226/2
4,924,411 A * 5/1990 Kashiwagi ..... 345/639
5,078,523 A * 1/1992 McGourty et al. ..... 400/613
5,314,256 A * 5/1994 Niwa ..... 400/61
5,562,353 A * 10/1996 Handa et al. ..... 400/615.2
5,651,619 A * 7/1997 Nunokawa et al. ..... 400/83
5,680,520 A * 10/1997 Watanabe et al. ..... 345/471
5,920,684 A * 7/1999 Hastings et al. ..... 358/1.13
5,926,618 A * 7/1999 Watanabe et al. ..... 358/1.11
5,951,174 A * 9/1999 Handa ..... 400/120.01
6,045,277 A * 4/2000 Kurashina et al. ..... 400/615.2
6,109,798 A * 8/2000 Nunokawa et al. ..... 400/83
6,113,294 A * 9/2000 Niwa ..... 400/621
6,116,796 A * 9/2000 Yamaguchi et al. ..... 400/615.2
6,129,467 A * 10/2000 Toyosawa et al. ..... 400/615.2
6,296,406 B1 * 10/2001 Kurashina ..... 400/615.2
6,338,583 B1 * 1/2002 Tanabe et al. ..... 400/63
6,373,510 B1 * 4/2002 Hosokawa et al. ..... 347/171
6,375,306 B1 * 4/2002 Tsukagoshi ..... 347/40
6,666,593 B2 * 12/2003 Akaiwa ..... 400/61
6,682,171 B2 * 1/2004 Otsuka ..... 347/43
2004/0265027 A1 12/2004 Hine et al. ..... 400/76

FOREIGN PATENT DOCUMENTS

EP 1 040 928 A1 10/2000
JP A 04-152162 5/1992
JP A 2000-280551 10/2000
WO WO 99/38692 8/1999

* cited by examiner

*Primary Examiner*—Minh Chau
(74) *Attorney, Agent, or Firm*—Oliff & Berridge, PLC

(57) ABSTRACT

A label making apparatus displays a copy print setting screen to make a user input a number of sets or labels to be copied, and determines whether or not a value stored in a total number of sets in a RAM is 1. After the determination, if the total number of sets is 1, the print format input process is terminated, and if the total number of sets is not 1, the user is made to select whether or not a numbering print is to be performed. Accordingly, the label making apparatus can print on a tape having a half cut line which extends in a tape longitudinal direction and makes a plurality of the labels which is narrower than the tape.

11 Claims, 35 Drawing Sheets

| 131a KIND OF TAPE | 131b NUMBER OF TAPE ROWS | 131c WIDTH OF FIRST ROW | 131d WIDTH OF SECOND ROW |
|---|---|---|---|
| 24mm | 1 | 24 | 0 |
| 18mm | 1 | 18 | 0 |
| 12mm | 1 | 12 | 0 |
| 9mm | 1 | 9 | 0 |
| 9mm-A | 2 | 3 | 6 |
| 9mm-B | 2 | 6 | 3 |
| 9mm-C | 2 | 4.5 | 4.5 |

FIG. 8

| | | FIRST DETECTION SWITCH | SECOND DETECTION SWITCH | THIRD DETECTION SWITCH | FOURTH DETECTION SWITCH | FIFTH DETECTION SWITCH |
|---|---|---|---|---|---|---|
| WIDTH OF TAPE | 9mm | OFF | OFF | | | |
| | 12mm | OFF | ON | | | |
| | 18mm | ON | OFF | | | |
| | 24mm | ON | ON | | | |
| KIND OF DIVISION | NO CASSETTE | | | OFF | OFF | OFF |
| | NO DIVISION | | | OFF | OFF | ON |
| | 1:1 | | | OFF | ON | OFF |
| | 1:2 | | | OFF | ON | ON |
| | 2:1 | | | ON | OFF | OFF |
| | (1:1:1) | | | ON | OFF | ON |
| | (1:2:1) | | | ON | ON | OFF |
| | RESERVE | | | ON | ON | ON |

1:1:1 TAPE AND 1:2:1 TAPE CAN BE DETERMINED, BUT NOT SUPPORTED IN PRINT PROCESS

FIG. 9

MEMORY CONFIGURATION OF ROM

| | |
|---|---|
| PROGRAM DATA | 130 |
| TAPE INFORMATION TABLE | 131 |
| CASSETTE INFORMATION TABLE | 132 |
| DISPLAYING CG DATA | 133 |
| PRINTING CG DATA | 134 |
| OTHER DATA | 135 |

FIG. 10

MEMORY CONFIGURATION OF RAM

| | |
|---|---|
| PRINT BUFFER | 140 |
| LABEL IMAGE BUFFER | 141 |
| TEMPLATE FLAG | 142 |
| TYPE OF DIVISION | 143 |
| TEXT BUFFER a | 144 |
| TEXT BUFFER b | 145 |
| TOTAL NUMBER OF SETS (TOTAL NUMBER OF LABEL SETS) | 146 |
| SET COUNTER (LABEL COUNTER) | 147 |
| UPPER ROW LABEL STARTING POSITION | 148 |
| UPPER ROW LABEL LENGTH | 149 |
| LOWER ROW LABEL STARTING POSITION | 150 |
| LOWER ROW LABEL LENGTH | 151 |
| WIDTH DIRECTION ALIGNMENT FLAG | 152 |
| LENGTH DIRECTION ALIGNMENT FLAG | 153 |
| EACH-PRINT CUTTING FLAG | 154 |
| MEMORY FOR OTHER OPERATIONS | 155 |

FIG. 45

```
1 2 3 4 5 6 7 8 9 0 1 2 3 4 5 6
↑ 2 0 ↑
  2 0 0 5 / 0 2 / 0 1   1 2 : 3 0
```

FIG. 46

```
1 2 3 4 5 6 7 8 9 0 1
↑ 0 1 / 2 0 ↑
  2 0 0 5 / 0 2 / 0 1
```

FIG. 47

```
1 2 3 4 5 6 7
↑ 0 1 / 2 0 ↑
```

FIG. 48

```
1 2
0 1
```

FIG. 52

↑01/20 FL01↑
2005/02/01 12:30

FIG. 53

2005/02/01
01/01

ABCDE

FIG. 54

LABEL ARRANGEMENT SETTING 1

● NORMAL INPUT
○ TEMPLATE INPUT

FIG. 55

LABEL ARRANGEMENT SETTING 2

● 1 : 2 TAPE
○ 2 : 1 TAPE
○ 1 : 1 TAPE

FIG. 56

LABEL ARRANGEMENT SETTING 3

● NO ALIGNMENT IN TAPE WIDTH DIRECTION
○ ALIGNMENT IN TAPE WIDTH DIRECTION

FIG. 57

LABEL ARRANGEMENT SETTING 4

● CUT FOR EACH PRINT
○ NOT CUT FOR EACH PRINT

FIG. 58

LABEL ARRANGEMENT SETTING 5

● NO ALIGNMENT IN TAPE LONGITUDINAL DIRECTION
○ ALIGNMENT IN TAPE LONGITUDINAL DIRECTION

FIG. 59

COPY PRINT SETTING

● NO COPY PRINT
○ COPY PRINT

◀ ▶ 01 LABEL(S)

LABEL MAKING APPARATUS

TECHNICAL FIELD

The disclosure relates to a label making apparatus which makes a label by printing on a tape, especially to the label making apparatus which makes the label by printing on the tape having a half cut line which extends in a tape longitudinal direction.

BACKGROUND

Conventionally, there has been used a label of which desired characters are printed on a printed face on a front side, and which adheres to a desired place with an adhesive face on a back side thereof. The label is made by a label printer on which a cassette which houses a tape as a printing medium is freely mountable, and which has a printing device for printing characters and images of figures on the tape which is unwound from the cassette in accordance with data previously inputted. The tape which is printed by the label printer is a laminated tape comprising a printed layer, a separating layer and an adhesive layer to easily adhere to a predetermined place after printed. The adhesive layer is protected by the separating layer, so that the adhesive layer does not interfere with print operation, and the printed tape easily adheres to the desired place with the separating layer removed. There are various kinds of the tapes including a wide tape and a narrow tape which are used depending on purposes. Not only the cassette housing the wide tape but also the cassette housing the narrow tape can be set in the label printer. Accordingly, both the wide and narrow labels can be printed by the same label printer.

It has been believed that a limitation of a minimum width of the tape is 6 mm, because stiffness is lost from the tape which is narrower than 6 mm. The loss of the stiffness from the tape causes malfunctions such as a winding of the tape while the tape is fed, and misalignment of printing in a tape width direction. However, demands for the label which is narrower than 6 mm are increased with the purposes of the labels. In spite of the demands, the conventional label printer cannot steadily make the tape narrower than 6 mm because of the malfunctions described above.

To provide a label printer which can make a label having a narrow width, for example, a label which is narrower than 6 mm and formed by printing on a tape having a printed layer, an adhesive layer and a separating layer, there is proposed the label printer having a structure to perform printing on the tape in plural rows on small regions divided by a half cut line which is on the tape to divide the tape into two or more regions, and to cut and separate the printed plural rows in the tape as one piece. (See Japanese patent application laid-open No.2000-280551).

The conventional label printer having the above structure, however, cannot satisfy further requests by a user to make a plurality of the same labels, a plurality of the different labels together, and a plurality of combinations of different labels.

The label printer for making the label using the tape with the half cut line to divide the tape into two or more regions in the tape width direction has another advantage in addition to making the label which is narrower than 6 mm. There has been a case in which labels are different in spite of a relationship therebetween such as labels in a spine and a cover of a binder binding paper documents. In that case, the spine label and the cover label are made separately, and carried as two labels, which causes inconvenience to the user and risk of loss of the labels.

The two types of the labels which happen to be in same widths, and are made being unseparated and connected to each other are easily portable and stored rather than the above case, but it is feared that the labels become too long. Further, in case of three types of the labels, the labels become much longer than in case of the two types. As a natural result, the unseparated pattern of printing is the only one pattern as above, so that the user must choose this pattern without other choices.

SUMMARY

The disclosure has been made in view of the above circumstances and has an object to overcome the above problems and to provide a label making apparatus for making various printing patterns of labels such as a plurality of the same labels, a plurality of the different labels together, and a plurality of combinations of different labels.

Additionally, the label making apparatus is provided to make a plurality of the labels in an unseparated form of printing depending on a usage condition.

To achieve the purpose of the invention, there is provided a label making apparatus comprising: a printing device for printing print contents on a tape; a cutting device for cutting the printed tape to make a label; a label arrangement unit for setting an arrangement of the label on the tape by a predetermined arrangement rule; and a print control unit for controlling the printing device to print on the tape with the arrangement of the label set by the label arrangement unit, wherein the tape comprises a printed layer, an adhesive layer, and a separating layer, and also includes a half cut line which extends in a tape longitudinal direction across at least the printed layer to divide the tape into more than one tape area in a tape width direction, and the label making apparatus further comprises a number-of-labels setting unit for setting a number of labels to be printed, further wherein the label arrangement unit sets the arrangement of the number of labels, which has been set by the number-of-labels setting unit, in each of the tape areas divided with the half cut line so that the label making apparatus makes the number of labels being narrower than the tape.

In the label making apparatus having the above structure, the label arrangement unit can set the arrangement of the label on the tape areas divided with the half cut line of the tape having the half cut line which extends in the tape longitudinal direction. The print control unit can print on the tape areas to make the label which is narrower than the tape. Also in the label making apparatus, the number-of-labels setting unit is provided to make a plurality of the labels which are narrower than the tape. Therefore, a user can make the desired number of labels which is narrower than the tape.

BRIEF DESCRIPTION OF THE DRAWINGS

FIG. 8 is a diagram showing a cassette information table;

FIG. 9 is a diagram showing a memory configuration of a ROM;

FIG. 10 is a diagram showing a memory configuration of a RAM;

FIG. 45 is a diagram illustrating a print example of a margin label (large);

FIG. 46 is a diagram illustrating a print example of the margin label (medium);

FIG. 47 is a diagram illustrating a print example of the margin label (small);

FIG. 48 is a diagram illustrating a print example of the margin label (mini);

FIG. 52 is a diagram illustrating a print example of another example 1 of the margin label;

FIG. 53 is a diagram illustrating a print example of another example 2 of the margin label;

FIG. 54 is a label arrangement setting screen 1;

FIG. 55 is a label arrangement setting screen 2;

FIG. 56 is a label arrangement setting screen 3;

FIG. 57 is a label arrangement setting screen 4;

FIG. 58 is a label arrangement setting screen 5;

FIG. 59 is a copy print setting screen for a normal input mode;

DETAILED DESCRIPTION

Hereinafter, the exemplary embodiments of the disclosure will be described with reference to the drawings.

First Exemplary Embodiment

Figure 1:
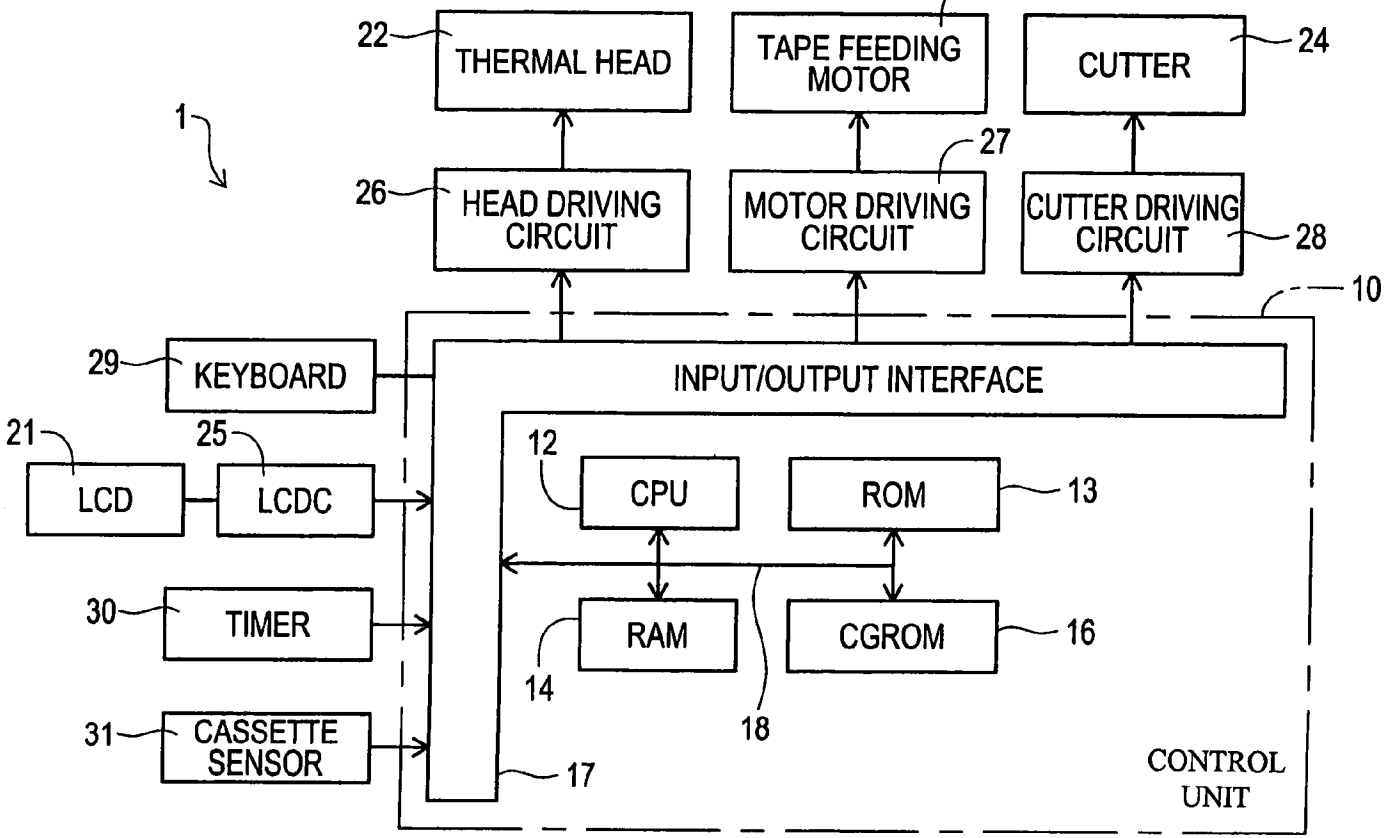
FIG. 1 is a block diagram illustrating an electrical configuration of a label making apparatus according to a first exemplary embodiment.

FIG. 1 shows a block diagram illustrating an electrical configuration of a label making apparatus according to the first exemplary embodiment of the disclosure. The operation of the label making apparatus 1 is controlled by control unit 10. The control unit 10 includes a CPU 12, a ROM 13, a RAM 14, a CGROM 16, and an input/output interface 17, all of which are connected with each other through a bus 18. The ROM 13 stores programs necessary for operating the label making apparatus 1, such as a display control program for a liquid crystal display (LCD) 21 and driving control programs for a thermal head 22, a tape feeding motor 23, a cutter (cutting device) 24, and the like, and in addition thereto, the ROM 13 stores necessary data, and the like. The CGROM (pattern data memory) 16 stores dot pattern data with respect to a plurality of characters. The RAM 14 is provided with a print buffer for storing print contents, a buffer for temporarily storing a result computed by the CPU 12, and the like.

The input/output interface 17 is connected with each of a display controller (LCDC) 25 coupled to the LCD 21, a head driving circuit 26 for driving the thermal head 22, a motor driving circuit 27 for driving the tape feeding motor 23, a cutter driving circuit 28 for driving the cutter 24, a keyboard 29 for receiving an input from a user, a timer 30 for clocking the present date and time, and a cassette sensor 31 for detecting the kind of mounted cassette and the like.

The LCD 21 and the keyboard 29 are arranged on a front face of a front portion of the label making apparatus 1. The keyboard includes respective keys such as up/down/right/left keys, an enter key, a cancel key, a label arrangement setting key, a print key, a label switch key and a power key, in addition to keys for edit such as alphabet keys, numeric keys, a delete key, a space key, symbol input keys, accent input keys, and a kana/kanji conversion key (all of which are not shown in the drawings). Note that functions of the label arrangement setting key, the print key and the label switch key will be described later in detail. An openable/closable cover is provided at a rear portion of the label making apparatus 1, and a cassette mounting portion including the thermal head 22 and the tape feeding motor 23 is provided inside the openable/closable cover.

The LCD 21 is a monochrome liquid crystal display. The thermal head 22 has a plurality of heating elements that are arranged in one direction. The tape feeding motor 23 is a stepping motor, and allows respective rollers for feeding a tape to rotate.

A tape which is a medium to be printed for use in the label making apparatus 1 is accommodated in a tape cassette in a state where the tape is wound in a rolling manner, and the tape cassette is detachably mounted in the cassette mounting portion of the label making apparatus 1. The print on the tape is performed by the thermal head. The tape is pulled out from the tape cassette with the rotation of the tape feeding motor 23, and the printed tape is discharged from an outlet port.

The tape cassettes used for the label making apparatus 1 are of plural kinds because the tapes are different in width and material, and the tapes are also different in provision or nonprovision of a half cut line, the number of half cut lines, the position of the half cut line, and the like. The difference of the tape cassettes due to the kinds of tapes can be recognized by reading the arrangement patterns of cylindrical concave portions that are provided at the bottom of the tape cassette.

The label making apparatus 1 is provided with a plurality of needle-shaped protrusions as the cassette sensor 31. When the tape cassette is not mounted, the plurality of needle-shaped protrusions protrude from a supporting face of the tape cassette, and when the tape cassette-is mounted, the plurality of needle-shaped protrusions are pressed down by the tape cassette and the tip ends thereof are pulled back up to the supporting face. Accordingly, since the concave-convex patterns of the plurality of needle-shaped protrusions are different depending on the kind of tape cassette to be mounted, it is possible to detect which kind of cassette tape accommodating the print tape is mounted in the label making apparatus 1 with a signal from the cassette sensor 31.

The kinds of tapes 2 accommodated in the tape cassette to be used for the label making apparatus 1 will be described with reference to FIGS. 2 to 6

Figure 2:
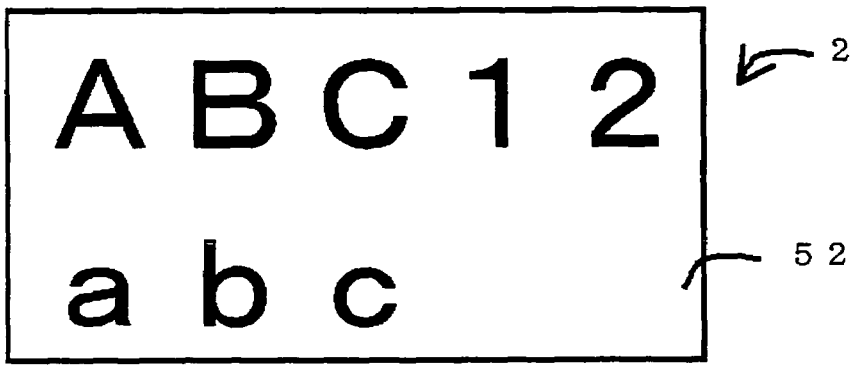
FIG. 2 is a diagram showing a print example of a label image on a 9 mm tape (with no divisions)
Figure 3:
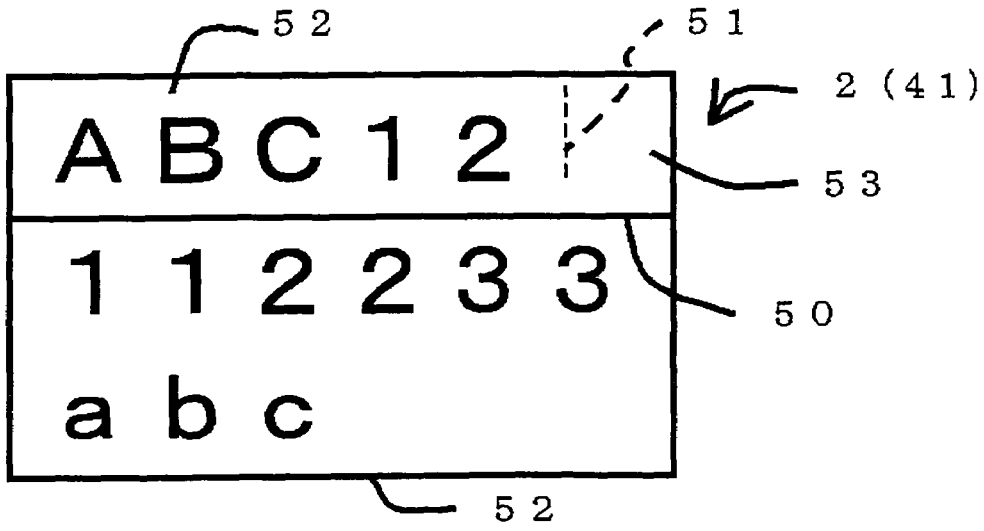
FIG. 3 is a diagram showing a print example of a label image on a 9 mm-A tape (1:2 divisions)
Figure 4:
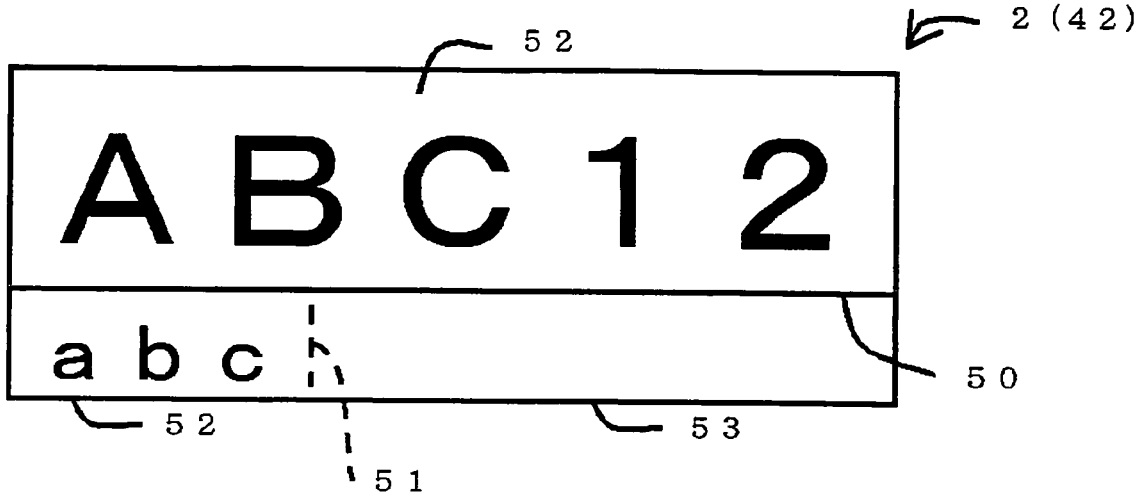
FIG. 4 is a diagram showing a print example of a label image on a 9 mm-B tape (2:1 divisions)
Figure 5:
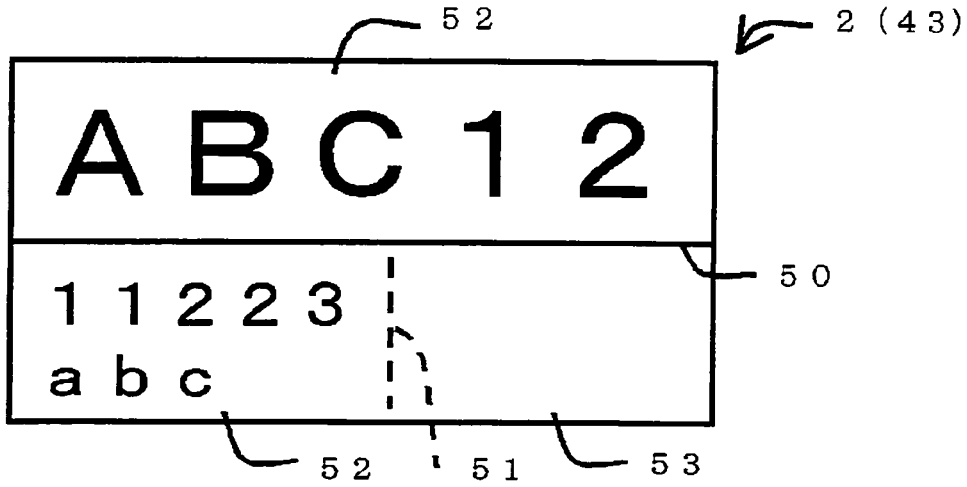
FIG. 5 is a diagram showing a print example of a label image on a 9 mm-C tape (1:1 divisions)
Figures 6, 7:
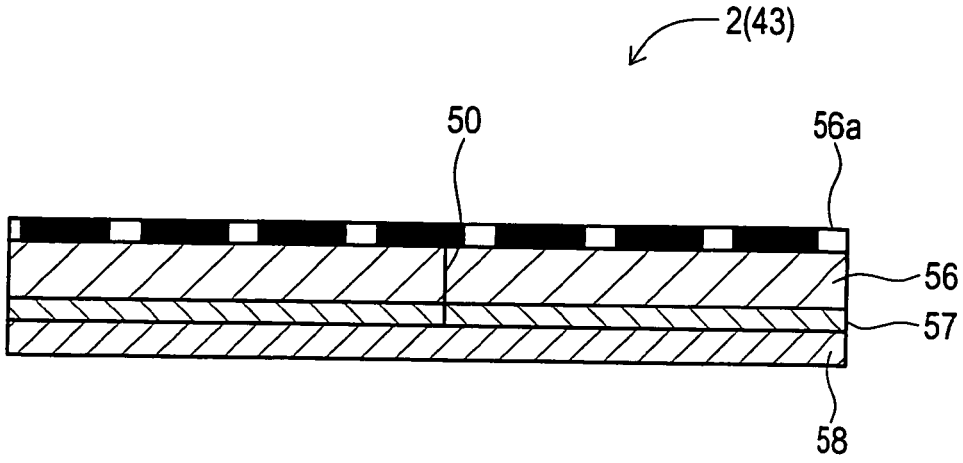
FIG. 6 is a sectional view of the 9 mm-C tape.
FIG. 7 is a diagram showing a tape information table.

FIG. 2 is a diagram showing a print example of a label image on a 9 mm tape (with no divisions). FIG. 3 is a diagram showing a print example of a label image on a 9 mm-A tape (1:2 divisions). FIG. 4 is a diagram showing a print example of a label image on a 9 mm-B tape (2:1 divisions). FIG. 5 is a diagram showing a print example of a label image on a 9 mm-C tape (1:1 divisions). FIG. 6 is a sectional view of the 9 mm-C tape. FIG. 7 is a diagram showing a tape information table. The term "with no divisions" means a normal tape 2 which does not include a half cut line 50 to be described later. The term "division" means that the tape 2 including the half cut line 50 to be described later is divided into a plurality of areas by the half cut line 50. As the kinds of divisions, there are three kinds of divisions (four kinds if including "with no divisions"), that is, the half cut line 50 to be described later is formed on the tape 2 and extended in the tape longitudinal direction, so that the tape is divided in the width direction at a ratio of 1 to 2 as shown in FIG. 3, at a ratio of 2 to 1 as shown in FIG. 4, and at a ratio of 1 to 1 as shown in FIG. 5. In the description, the widths of the tapes 2 are of four kinds: 24 mm, 18 mm, 12 mm and 9 mm. The tape with no divisions has all the four kinds, and on the other hand, the tape with divisions has only the 9 mm width. Hereinafter, the tape with no divisions is referred to as a 24 mm tape, an 18 mm tape, a 12 mm tape and a 9 mm. tape after the size of tape width, and for the tape with divisions, 1:2 divisions, 2:1 divisions, and 1:1 divisions are referred to as a 9 mm-A tape 41, a 9 mm-B tape 42, and a 9 mm-C tape 43.

The configuration of the tape will be described with reference to FIG. 6. The tape 2 is a laminated tape consisting of a printed layer 56, an adhesive layer 57 and a separating layer 58, and includes the half cut line 50 in the middle of the tape width direction. The half cut line 50 is a cut line which extends in the longitudinal direction of the tape 2, passes along the middle portion of the tape width direction, and is provided across the printed layer 56 and the adhesive layer 57 so that the printed layer 56 and the adhesive layer 57 can be separated along the longitudinal direction. The way to cut the printed layer 56 and the adhesive layer 57 while leaving the separating layer 58 is generally called as a half cut that is different from a full cut in which all of the printed layer 56, the adhesive layer 57, and the separating layer 58 are cut across the thickness direction of the tape 2. Even if the half cut line 50 is formed in advance on the tape 2, the separating layer 58 is integrally formed in the tape width direction. Accordingly, when the tape 2 is mounted and fed in the label making apparatus 1, the tape 2 can be handled as a tape that is integrally formed in the width direction. Note that, even if the half cut line 50 is formed at almost the whole portion of the thickness direction of the printed layer 56 and a thin layer as a rest of the printed layer 56 is left, the half cut line 50 is applicable as long as the printed layer 56 and the adhesive layer 57 can be easily and manually separated from the separating layer 58.

Since FIG. 6 shows the 9 mm-C tape 43, the half cut line 50 is formed in the middle of the tape width direction. However, the 9 mm-A tape 41 has the half cut line 50 formed at a ratio of 1 to 2 in the tape width direction, and the 9 mm-B tape 42 has the half cut line 50 formed at a ratio of 2 to 1 in the tape width direction.

The upper surface of the printed layer 56 is a thermosensitive coloring layer 56*a*that reacts with heat and develops colors, and images such as text strings can be printed thereon by a thermal head 22. The printed layer 56 may be a layer on which images can be printed through a separate ink ribbon.

FIG. 7 shows a tape information table. This table is stored in the ROM 13 (refer to FIG. 9), and consists of the items of "kind of tape" 131*a* that indicates the name of a tape, "number of tape rows" 131*b* that indicates an area defined by dividing the tape with the half cut line 50, "width of first row" 131*c* that indicates the size of the width of the first row that is an area defined by dividing the tape with the half cut line 50, and "width of second row" 131*d* that indicates the size of the width of the second row that is an area defined by dividing the tape with the half cut line 50. The table contains these data as a set on the basis of the kind of tape. The "width of first row" 131*c* and the "width of second row" 131*d* use a mm as a unit.

The tapes are of seven kinds, namely, the 24 mm tape, 18 mm tape, 12 mm tape, 9 mm tape, 9 mm-A tape, 9 mm-B tape, and 9 mm-C tape. The 24 mm tape, 18 mm tape, 12 mm tape, and 9 mm tape are not divided because the half cut lines 50 are not formed thereon, and the number of tape rows 131*b* is 1. The width of first row 131*c* is the same as that of the tape itself. The width of second row 131*d* is 0 mm. The 9 mm-A tape has one half cut line 50 so that the tape is divided at a ratio of 1 to 2 in the width direction, and accordingly the number of tape rows 131*b* is 2, the width of first row 131*c* is 3 mm, and the width of second row 131*d* is 6 mm. The 9 mm-B tape has one half cut line 50 so that the tape is divided at a ratio of 2 to 1 in the width direction, and accordingly the number of tape rows 131*b* is 2, the width of first row 131*c* is 6 mm, and the width of second row 131*d* is 3 mm. The 9 mm-C tape has one half cut line 50 so that the tape is divided at a ratio of 1 to 1 in the width direction, and accordingly the number of tape rows 131*b* is 2, the width of first row 131*c* is 4.5 mm, and the width of second row 131*d* is 4.5 mm. The position of arranging a label corresponding to each row, and the width of the label corresponding to each row, a font size to be used for each label, and the like are obtained by using the table alone or by using the table in combination with other information.

FIG. 8 shows a cassette information table. This table is stored in the ROM 13 (refer to FIG. 9). As described above, the cassette sensor 31 obtains the kind of tape cassette by reading the state of the plurality of needle-shaped protrusions. The needle-shaped protrusions are of five kinds, namely, first to fifth detection switches. The cassette sensor 31 detects an OFF state in which the needle-shaped protrusions protrude from the supporting face of the tape cassette, and an ON state in which the tip ends of the needle-shaped protrusions are pulled back up to the supporting face of the tape cassette. The cassette information table 132 is a table combining the ON/OFF of the first to fifth detection switches, and is configured so that the kind of tape can be sorted depending on the width of the tape, and the kind of tape (the kind of division) can be sorted depending on the difference of the tape divisions in provision or nonprovision of the half cut line 50, the number of half cut lines 50 and the position of the half cut line 50.

The sorting of the kind of tape depending on the width of the tape is performed by the first and second detection switches. When the combination of these detections is (OFF, OFF), the tape is determined as the 9 mm tape (any one of the 9 mm tape, 9 mm-A tape, 9 mm-B tape, and 9 mm-C tape). When the combination of these detections is (OFF, ON), the tape is determined as the 12 mm tape. When the combination of these detections is (ON, OFF), the tape is determined as the 18 mm tape. When the combination of these detections is (ON, ON), the tape is determined as the 24 mm tape.

The sorting of the kind of tape depending on the kind of division is performed by the third, fourth and fifth detection switches. When the combination of these detections is (OFF, OFF, OFF), the tape is determined as no cassette which means that the tape cassette is not mounted in the label making apparatus 1. When the combination of these detections is (OFF, OFF, ON), the tape is determined as no divisions. When the combination of these detections is (OFF, ON, OFF), the tape is determined as 1:1 divisions. When the combination of these detections is (OFF, ON, ON), the tape is determined as 1:2 divisions. When the combination of these detections is (ON, OFF, OFF), the tape is determined as 2:1 divisions. When the combination of these detections is (ON, OFF, ON), the tape is determined as 1:1:1 divisions in which two half cut lines 50 extend in the tape longitudinal direction so that the tape is divided at a ratio of 1:1:1 in the tape width direction. When the combination of these detections is (ON, ON, OFF), the tape is determined as 1:2:1 divisions in which two half cut lines 50 extend in the tape longitudinal direction so that the tape is divided at a ratio of 1:2:1 in the tape width direction. When the combination of these detections is (ON, ON, ON), the tape is determined as a kind, other than these kinds, that is kept in reserve if a new kind of tape is used in future. For example, for the tape cassette accommodating the 9 mm-A tape, the combination of the values of the first to fifth detection switches is (OFF, OFF, OFF, ON, ON).

Note that the 1:1:1 divisions and 1:2:1 divisions can be determined by the cassette sensor 31. However, these divisions are not supported in the label making apparatus 1, and thus the labels using the tapes with such divisions can not be made.

Next, a memory configuration of the ROM 13 will be described with reference to FIG. 9. The ROM 13 stores program data 130 consisting of respective programs for controlling the label making apparatus 1, the tape information table 131 as described above (refer to FIG. 7), the cassette information table 132 as described above (refer to FIG. 8), displaying CG data 133 including an image part consisting of each image data such as characters and drawings for display and an index part by which each of the image data can be searched for, printing CG data 134 including an image part consisting of each image data such as characters and drawings for print and an index part by which each of the image data can be searched for, the other data 135, and the like.

Next, a memory configuration of the RAM 14 will be described with reference to FIG. 10. The RAM 14 comprises a print buffer 140 for storing a print image to be printed on the tape, a label image buffer 141 for storing an image for one label, a template flag 142 for indicating that a mode for making a label in the label making apparatus 1 is a template input mode or a normal input mode, a type of division 143 for storing, in the template input mode, the kinds of templates that have been specified in more detail, a text buffer a for storing the print contents to be printed on the first row (the upper row, assuming that the left/right direction is the tape longitudinal direction. Hereinafter, the first row is identical to the upper row.) when being printed on the tape with two rows, a text buffer b for storing the print contents to be printed on the second row (the lower row assuming that the left/right direction is the tape longitudinal direction. Hereinafter, the second row is identical to the lower row.) when being printed on the tape with two rows, total number of sets 146 for representing the number of label-sets in printing for the specified number of label sets, given that a label on which the contents of the text buffer a is printed and another label on which the contents of the text buffer b is printed are in one set, and a set counter 147 for counting the current number of printed label sets in printing for the total number of sets 146.

Further, the RAM 14 comprises an upper row label starting position 148 for representing a position where a label is arranged in the upper row when making the label using the upper row, an upper row label length 149 for representing the length of a label, in the tape longitudinal direction, which is arranged in the upper row, a lower row label starting position 150 for representing a position where a label is arranged in the lower row when making the label using the lower row, a lower row label length 151 for representing the length of a label, in the tape longitudinal direction, which is arranged in the lower row, a width direction a alignment flag 152 for, in the case where there is an unused row in the tape width direction for a label that is to be made first when making a plurality of labels by using the tape with divisions, indicating whether or not another label to be made later is arranged in the unused row, a length direction alignment flag 152 for indicating whether or not to align all spaces between labels that are adjacent to each other in the tape longitudinal direction when making a plurality of labels by using the tape with divisions, an each-print cutting flag 154 for indicating whether or not to cut the tape by length of one label every time the label is (or the labels are) printed when a plurality of labels are to be arranged in the tape longitudinal direction, and a memory 155 for other operations. Note that, hereinafter, tape areas that are obtained by dividing the tape with the half cut line into respective rows may be referred to as divided tape areas (an upper divided tape area, a lower divided tape area, and the like).

An image for one label stored in the label image buffer 141 is combined with a print image stored in the print buffer 140. The combination process is performed by the number of labels to arranged in the tape areas which are defined by cutting the tape at one time, and then images of cut lines representing the ends of the label, and the like are added to the print image as needed. Thus, the final print image is made.

There are three kinds of tapes with divisions, namely, 9 mm-A, 9 mm-B, and 9 mm-C according to the first exemplary embodiment, and the number of templates corresponding to each of the tapes is only one. Accordingly, the possible indicative values of the type of division 143 are 0 for the template corresponding to the 9 mm-A tape, 1 template corresponding to the 9 mm-B tape, and 2 for the template corresponding to the 9 mm-C tape.

The text being input in the normal input mode is stored in the text buffer a, and the text buffer b becomes empty.

The total number of sets is 1 when only one set of labels is made. When the text buffer a or text buffer b is empty, one label on which the contents of the nonempty text buffer is printed makes one label set. The counting on the basis of the sets is mainly utilized in the template input mode in the first exemplary embodiment. On the other hand, the number of labels as a unit can be specified in plural prints in the normal input mode. In the normal input mode, the total number of sets 146 corresponds to the total number of labels, and the set counter 147 corresponds to a counter of the number of labels.

The upper row label starting position 148 and the upper row label length 149 are utilized to store the label starting position and the label length when a label is made even by using the tape with no-divisions.

The memory 155 for other operations includes a numbering flag for indicating whether or not to perform numbering, a kind of cassette in which the kind of cassette obtained by reading the cassette is stored, a margin text buffer for storing the print contents when being printed in the margin, a row counter for setting the row in which the currently-making label is arranged when a label is made by using the tape with divisions, a file memory for separately storing the contents of the text buffer, a text buffer a for operations, a text buffer b for operations, and the like (all of which are not shown in the drawings).

Note that each of the numbering flags is prepared while being associated with each of the text buffer a and the text buffer b so that it is possible to separately specify the numbering.

Further, the margin text buffer is used when a single margin label to be described later is made.

For more detail, the file memory consists of the template flag 142, the type of division 143, the text buffer a 144, and the text buffer b 145.

In the memory areas of the RAM, there is an area for backing up the stored contents even when the power is turned off. The area for back up includes the template flag 142, the type of division 143, the text buffer a 144, the text buffer b 145, the file memory (not shown), and the like, and holds the contents which has been previously used. Note that an area of the RAM which is not backed up is cleared or set to a predetermined value when the power is turned on, and an area of the RAM which is backed up is cleared or set to a predetermined value when the power is initially turned on or a reset process is performed. Incidentally, the label making apparatus is started in the normal input mode when the power is initially turned on, and thus the template flag is set to OFF.

Hereinafter, the operations of the label making apparatus 1 according to the first exemplary embodiment will be described by mainly referring to the flowcharts (FIG. 11 to FIG. 24), by appropriately referring to the drawings (FIG. 25 to FIG. 31 and FIG. 38 to FIG. 53) representing the label images, and by appropriately referring to the drawings (FIG. 54 to FIG. 62) representing the images of respective setting screens.

Figure 11:
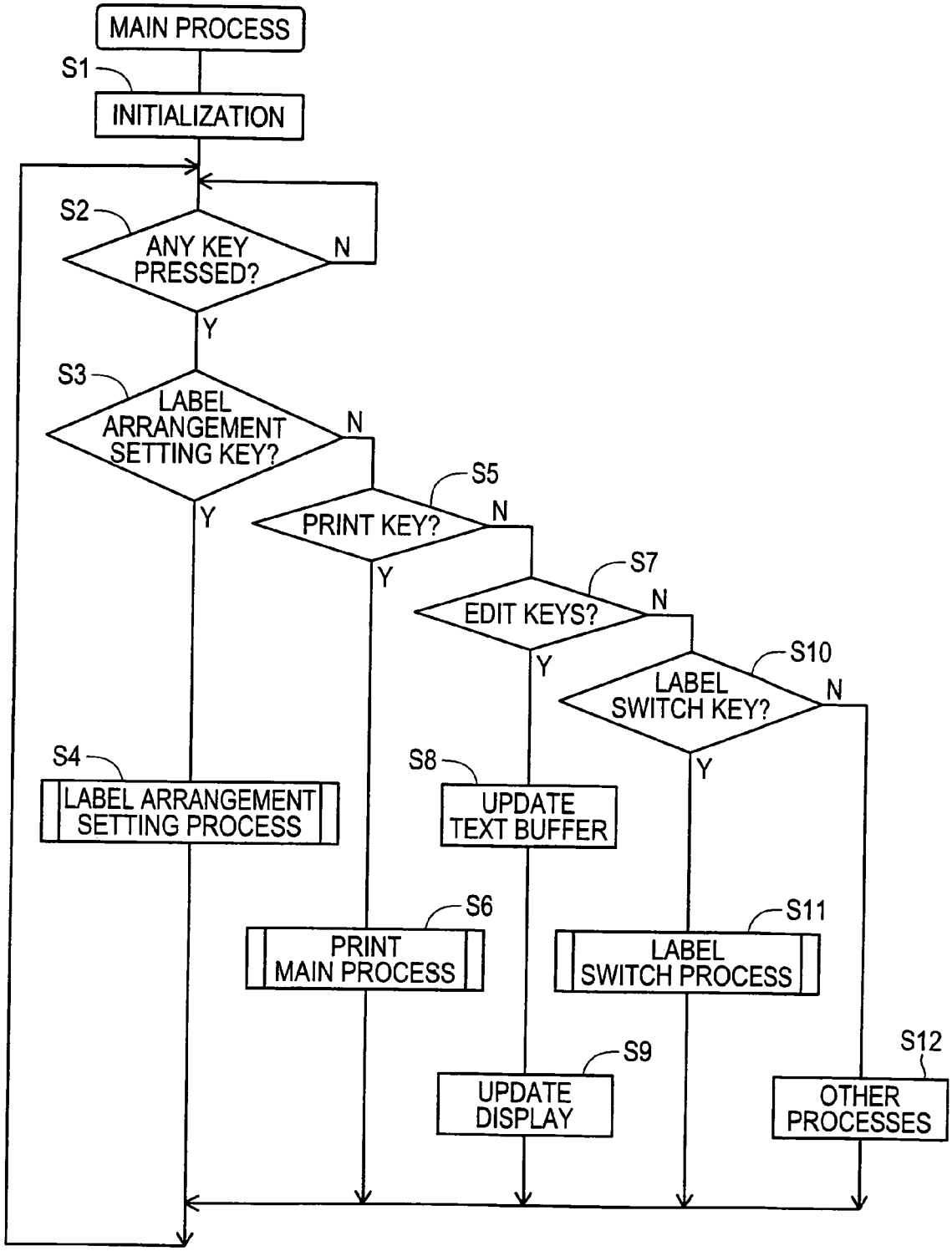
FIG. 11 is a flowchart representing a whole flow of the label making apparatus.

FIG. 11 is a flowchart representing the whole flow of the label making apparatus 1. When the power key (not shown) is pressed in the label making apparatus 1, the label making apparatus 1 is started. First, the CPU 12 executes the initialization such as the setting of respective variables in the RAM 14 and the displaying of an edit screen (not shown) (S1).

Next, in the state of receiving the pressing of keys on the key board 29, the CPU 12 determines whether or not any of the keys is pressed (S2). If any of the keys is pressed (S2: YES), it is determined whether or not the label arrangement setting key (not shown) is pressed (S3). If the label arrangement setting key (not shown) is pressed (S3: YES), a label arrangement setting process (S4) is executed, and then the flow returns to S2 to receive the key input. The label arrangement setting process will be described later in detail with reference to FIG. 13.

If the label arrangement setting key (not shown) is not pressed (S3 NO), the CPU 12 determines whether or not the print key (not shown) is pressed (S5). If the print key (not shown) is pressed (S5: YES), a print main process (S6) is executed, and then the flow returns to S2 to receive the key input. The print main process will be described later in detail with reference to FIG. 14.

If the print key (not shown) is not pressed (S5: NO), the CPU 12 determines whether or not the edit key (not shown) is pressed (S7). The edit keys include the alphabet keys, the numeric keys, the delete key, the space key, the symbol input key, the accent key, the kana/kanji conversion key, (all of which are not shown in the drawings), and the like. If the edit key is pressed (S7: YES), the text which is the current editorial target on the edit screen (not shown) and which is stored in one of the text buffer a 144 and the text buffer b 145 is updated in accordance with the edit key that was pressed (S8), and then the display of the edit screen (not shown) is updated in accordance therewith (S9). Thereafter, the flow returns to S2 to receive the key input.

If the edit key is not pressed (S7: NO), the CPU 12 determines whether or not the label switch key (not shown) is pressed (S10). If the label switch key (not shown) is pressed (S10: YES), a label switch process (S11) is executed, and then the flow returns to S2 to receive the key input. The label switch process will be described later in detail with reference to FIG. 12.

If the label switch key (not shown) is not pressed (S10: NO), a key other than the label arrangement setting key, the print key, the edit key and the label switch key is assumingly pressed so that the CPU 12 performs the process in accordance with the pressed key in the other processes (S12). Thereafter, the flow returns to S2 to receive the key input.

Figure 12:
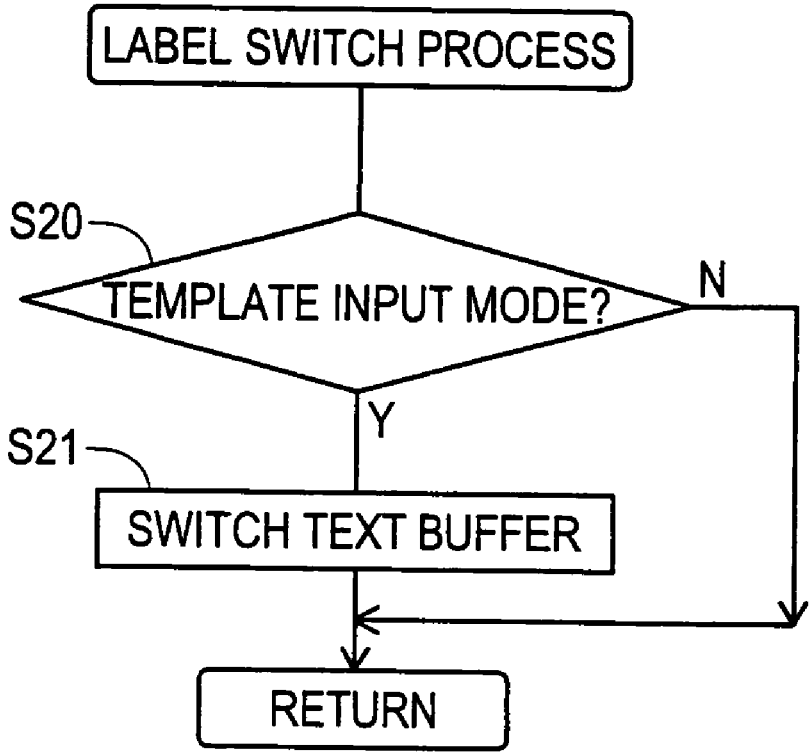
FIG. 12 is a flowchart of a label switch process.

Next, the label switch process will be described with reference to FIG. 12. When the label switch process is called in S11 of FIG. 11, first, it is determined whether or not the apparatus is in the template input mode (S20). To determine this, it is confirmed whether or not the template flag 142 is ON. If the template flag 142 is ON, it is determined that the apparatus is in the template input mode (S20: YES). At this time, the variable (not shown) in the RAM 14 retaining that the currently-edited text buffer is the text buffer a 144 or the text buffer b 145 is updated so that the other text buffer than the text buffer indicated as being currently-edited is indicated. Thereafter, the label switch process is terminated, and then the flow returns to FIG. 11.

If the template flag 142 is OFF, it is determined that the apparatus is not in the template input mode (S20: NO). At this time, the label switch process is terminated, and then the flow returns to FIG. 11.

Figure 13:
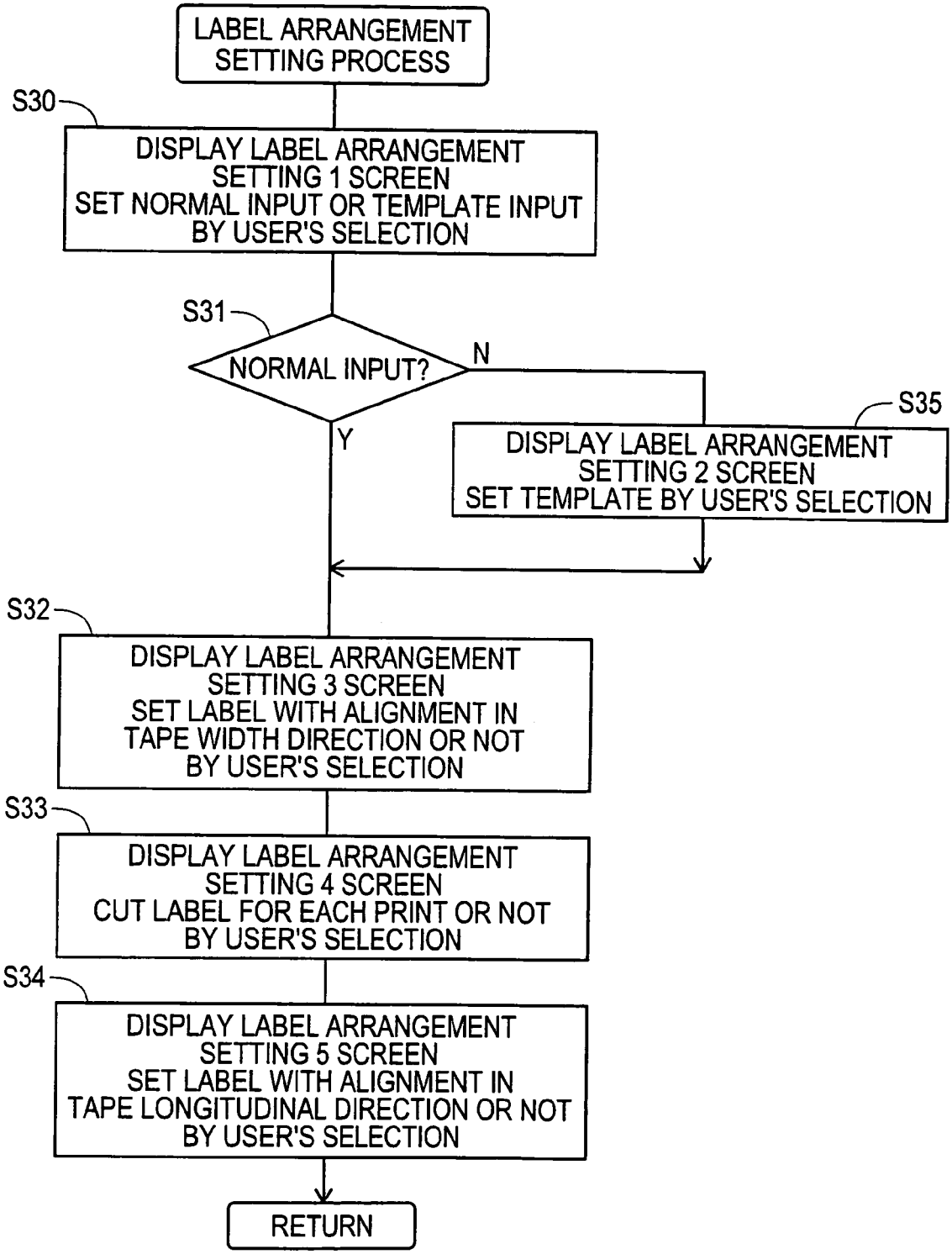
FIG. 13 is a flowchart of a label arrangement setting process.

Next, the label arrangement setting process will be described with reference to FIG. 13. When the label arrangement setting process is called in S4 of FIG. 11, first, a label arrangement setting screen 1 is displayed in S30. The label arrangement setting screen 1 is a screen for setting an input mode, and "normal input" and "template input" are displayed as selection items and radio buttons for selecting either one of these items are provided on the label arrangement setting screen 1 as shown in FIG. 54. Right after the label arrangement setting 1 screen is displayed, the normal input indicated on the top of the selection items is being in the state of selection. The user changes the selection item in the state of selection by pressing the up/down keys (not shown), and determines by pressing an OK key (not shown). The value of the template flag 142 is set depending on the selected result (the template flag 142 is set to OFF when selecting the normal input, and the template flag 142 is set to ON when selecting the template input). At this point, with the setting of the template flag 142, when a mode different from the last input mode is selected, the text buffer a 144 and the text buffer b 145 are cleared.

Thereafter, it is determined whether or not the normal input is selected (S31). To determine this, it is confirmed whether or not the template flag 142 is OFF. If the template flag 142 is OFF, it is determined that the apparatus is in the normal input mode (S31: YES). At this time, the flow proceeds to S32 to display a label arrangement setting screen 3. The label arrangement setting screen 3 is a screen for setting whether or not a plurality of labels are arranged while being aligned in the tape width direction when arranging the plurality of labels on the tape. "No alignment in the tape width direction" and "alignment in the tape width direction" are displayed as the selection items and radio buttons for selecting either one of these items are provided as shown in FIG. 56. Right after the label arrangement setting 3 screen is displayed, the "no alignment in tape width direction" indicated on the top of the selection items is being in the state of selection. The user changes the selection item in the state of selection by pressing the up/down keys (not shown), and determines by pressing the OK key (not shown). The value of the width direction alignment flag 152 is set depending on the selected result (the width direction alignment flag 152 is set to OFF when selecting the "no alignment in tape width direction", and the width direction alignment flag 152 is set to ON when selecting the "alignment in tape width direction")

Thereafter, the flow proceeds to S33 to display a label arrangement setting screen 4. The label arrangement setting screen 4 is a screen for setting whether or not to cut the tape in the case where the cutting of the tape at the boundary between labels in the tape longitudinal direction does not cause the other labels to be cut in the middle thereof. "Not cut for each print" and "cut for each print" are displayed as the selection items and radio buttons for selecting either one of these items are provided as shown in FIG. 57. Right after the label arrangement setting 4 screen is displayed, the "cut for each print" indicated on the top of the selection items is being in the state of selection. The user changes the selection item in the state of selection by pressing the up/down keys (not shown), and determines by pressing the OK key (not show). The value of an each-print cutting flag 154 is set depending on the selected result (the each-print cutting flag 154 is set to OFF when selecting the "not cut for each print", and the each-print cutting flag 154 is set to ON when selecting the "cut for each print")

Thereafter, the flow proceeds to S34 to display a label arrangement setting screen 5. The label arrangement setting screen 5 is a screen for setting whether or not a plurality of labels are arranged while being aligned in the tape longitudinal direction when arranging the plurality of labels on the tape. "No alignment in tape longitudinal direction" and "alignment in tape longitudinal direction" are displayed as the selection items and radio buttons for selecting either one of these items are provided as shown in FIG. 58. Right after the label arrangement setting 5 screen is displayed, the "no alignment in tape longitudinal direction" indicated on the top of the selection items is being in the state of selection. The user changes the selection item in the state of selection by pressing the up/down keys (not shown), and determines by pressing the OK key (not shown). The value of the length direction alignment flag 153 is set depending on the selected result (the length direction alignment flag 153 is set to OFF when selecting the "no alignment in tape longitudinal direction", and the length direction alignment flag 153 is set to ON when selecting the "alignment in tape longitudinal direction"). Thereafter, the label switch process is terminated, and the flow returns to FIG. 11.

On the other hand, if the template flag 142 is ON in S31, it is determined that the apparatus is in the template input mode (S31: NO). At this time, the flow proceeds to S35 to display a label arrangement setting screen 2. The label arrangement setting screen 2 is a screen for selecting the kind of tape with divisions. Three items of "1:2 tape", "2:1 tape" and "1:1 tape" are displayed as the selection items and radio buttons for selecting any one of the three items are provided as shown in FIG. 55. Right after the label arrangement setting 2 screen is displayed, the "1:2 tape" indicated on the top of the selection items is being in the state of selection. The user changes the selection item in the state of selection by pressing the up/down keys (not shown), and determines by pressing the OK key (not shown). The value of the type of division is set depending on the selected result (the value is set to 0 when selecting the "1:2 tape", the value is set to 1 when selecting the "2:1 tape" and the value is set to 2 when selecting the "1:1 tape"). Then, the flow proceeds to S32. Thereafter, the same processes are performed as the ones in the case where the flow proceeds to S32 after the determination in S31 in which the apparatus is in the normal input mode.

Next, the print main process will be described with reference to FIG. 14. When the print main process is called in S6 of FIG. 11, first, it is determined whether or not there is text in S40. In this case, it is determined whether or not there is text in the text buffer a 144 and the text buffer b 145 at the time of the template input, and it is determined whether or not there is text in the text buffer a 144 at the time of the normal input. If it is determined that there is no text (S40: NO), the print main process is terminated and the flow returns to FIG. 11. On the other hand, if it is determined that there is text (S40: YES), the flow proceeds to S41 to perform a cassette reading process. The cassette reading process will be described later with reference to FIG. 15. After performing the cassette reading process, the flow proceeds to S42. In the case where an error process is performed during the cassette reading process, information of presence or absence of the error is stored in an error flag (not shown) in the memory 155 for other operations of the RAM 14. In S42, it is determined whether or not the error occurs during the cassette reading process by referring to the error flag. If it is determined that the error occurs (S42: YES), the print main process is terminated without printing, and the flow returns to FIG. 11. On the other hand, if it is determined that no error occurs (S42: NO), the flow proceeds to S43 to perform a print format input process. The print format input process will be described later with reference to FIG. 17. After performing the print format input process, the flow proceeds to S44 to perform a print process. The print process will be described later with reference to FIG. 18. Thereafter, the print main process is terminated, and the flow returns to FIG. 11.

Next, the cassette reading process will be described with reference to FIG. 15. When the cassette reading process is called in S41 of FIG. 14, first, the kind of cassette is read in S50. The kind of cassette is determined with reference to the cassette information table 132 by using a combination of the values of ON/OFF obtained by the first to fifth detection switches of the cassette sensor 31 as described above. The kind of cassette being read is stored in the kind of cassette (not shown) of the memory for other operations of the RAM14 (kinds of no cassette, 24 m, 18 mm, 12 mm, 9 mm, 9 mm-A and 9 mm-B). Thereafter, the flow proceeds to S51 where it is determined whether or not the cassette is mounted in the label making apparatus 1. If the cassette is not mounted (S51: NO), the flow proceeds to S58 to display an error and then the error flag (not shown) is set. Note that the pressing of a key other than the power key during the error display functions for only the release of the error display, and the error flag (not shown) is accordingly cleared. These processes of the error release are included in other processes (S12) in FIG. 11 (that is, in the determinations by the respective key inputs in S3, S5, S7, and S10, it is also determined that no error occurs). After terminating the process in S58, the cassette reading process is terminated, and the flow returns to FIG. 14.

If it is determined that the cassette is mounted in S51 (S51: YES), the flow proceeds to S52. Here, the contents of the text buffer a 144 and the text buffer b 145 is copied to the text buffer a 144 for operations and the text buffer b for operations (both of which are not shown in the drawings) of the memory 155 for other operations in the RAM 14. Then, the flow proceeds to S53 where it is determined whether or not the template flag 142 is ON. If the template flag 142 is not ON (S53: NO), it is determined that the apparatus is in the normal input mode. In this case, since the print is performed without specific limitations regardless of whether or not the tape is divided, the cassette reading process is terminated without performing other processes, and the flow returns to FIG. 14.

On the other hand, if it is determined that the template flag 142 is ON in S53 (S53: YES), the flow proceeds to S54 where it is determined whether or not the cassette is for the tape with divisions. To determine this, the kind of cassette (not shown) of the memory for other operations in the RAM 14 is utilized. If the kind of cassette is for any one of 24 mm, 18 mm, 12 mm, and 9 mm tapes, it is determined that the cassette is for the tape with no divisions (S54: NO), the flow proceeds to S58. Here, as similar to the foregoing, the error is displayed, then the cassette reading process is terminated and the flow returns to FIG. 14. If the kind of cassette is for the tape with divisions (any one of 9 mm-A, 9 mm-B, and 9 mm-C) in S54 (S54: YES), the flow proceeds to S55. Here, it is determined whether or not the kind of cassette is associated with the type of division.

The type of division corresponds to the type of division 143 of the RAM 14, and the user previously set the same on the label setting screen 2 (refer to FIG. 55) as the kind of label which the user desires to make. Further, the kind of cassette represents a kind of cassette that is actually mounted in the label making apparatus 1, and is stored in the kind of cassette (not shown) of the memory for other operations in the RAM 14. If the combination of the type of division and the kind of cassette is any one of: "the type of division is 0 (1:2 tape, 9 mm-A)" and "the kind of cassette is 9 mm-A"; "the type of division is 1 (2:1 tape, 9 mm-B)" and "the kind of cassette is 9 mm-B"; and "the type of division is 2 (1:1 tape, 9 mm-C)" and "the kind of cassette is 9 mm-C", it is determined that the type of division is associated with the kind of cassette. If the type of division is associated with the kind of cassette (S55: YES), the cassette reading process is terminated because the print can be performed without any problems, so that the flow returns to FIG. 14. In S55, if the combination of the type of division and the kind of cassette is the one other than the three combinations described above, it is determined that the type of division is not associated with the kind of cassette (S55: NO). In this case, the flow proceeds to S56 where it is determined whether or not it is possible to make the label of the kind, which the user previously set on the label setting screen 2 (refer to FIG. 55), without exchanging the cassette that is currently mounted.

Figure 38:
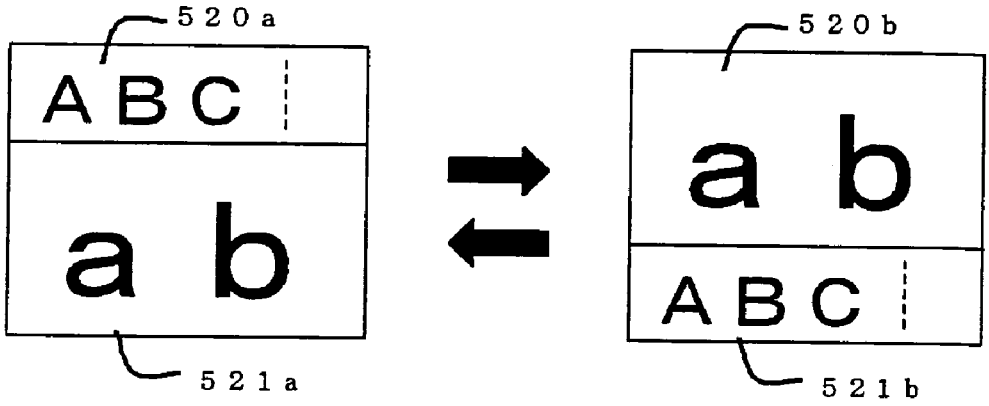
FIG. 38 is a diagram illustrating an example in which the labels conform to the tapes that are different from each other.

With reference to FIG. 38, the explanation will be made with regard to the example in which the label desired by the user can be made without exchanging the cassette that is currently mounted. FIG. 38 is a diagram illustrating an example in which the labels conform to the tapes that are different from each other. There is illustrated a label image using the 9 mm-A tape with 1:2 divisions on the left side of the drawing. Further, there is illustrated another label image using the 9 mm-B tape with 2:1 divisions on the right side of the drawing. "ABC" is printed in an upper label 520*a* of the label image on the left side of the drawing. As similar thereto, "ab" is printed in a lower label 521*a*. On the other hand, "ab" is printed in an upper label 520*b* of the label image on the right side of the drawing. As similar thereto, ABC is printed in a lower label 521*b*. The label printed in the upper label 520*a* of the left label image is the same as the one printed in the lower label 521*b* of the right label image. As similar thereto, the label printed in the lower label 521*a* of the left label image is the same as the one printed in the upper label 520*b* of the right label image. That is, in the case where the user originally desires to make the upper label 520*a* and the lower label 521*a* by using the 9 mm-A tape on the left side of the drawing, the labels 520*a* and 521*a* can be made by using the 9 mm-B tape on the right side of the drawing even when there is no 9 mm-A tape. On the contrary, in the case where the user originally desires to make the upper label 520*b* and the lower label 521*b* by using the 9 mm-B tape on the right side of the drawing, the labels 520*b* and 521*b* can be made by using the 9 mm-A tape on the left side of the drawing even when there is no 9 mm-B tape. However, the positions of the labels are respectively inverted when the labels are arranged on the different tape.

In S56, it is determined whether or not such a replacement of the labels is possible. Specifically, it is determined whether or not the combination of the type of division and the kind of cassette is any one of "the type of division is 0 (1:2 tape, 9 mm-A)" and "the kind of cassette is 9 mm-B", and "the type of division is 1 (2:1 tape, 9 mm-B)" and "the kind of cassette is 9 mm-A". If the replacement of the labels is not possible (S56: NO), the flow proceeds to S58 to display an error. Then, the cassette reading process is terminated, and the flow returns to FIG. 14. On the other hand, if the replacement of the labels is possible (S56: YES), the flow proceeds to S57 to execute a replacement process. The replacement process will be described later with reference to FIG. 16. After executing the replacement process, the cassette reading process is terminated, and the flow returns to FIG. 14.

Next, the replacement process will be described with reference to FIG. 16. When the replacement process is called in S57 of FIG. 15, text is made so that the text in the upper row and the text in the lower row are replaced by each other. First, in the case of printing on the tape with divisions in the template input mode, as long as any of the text buffer a 144 and the text buffer b 145 is not empty, the contents of the text buffer a 144 is usually handled as the print contents of the label that was printed by using the upper row of the tape with divisions and the contents of the text buffer b 145 is usually handled as the print contents of the label that was printed by using the lower row of the tape with divisions. However, it is necessary to replace the upper and lower arrangements of the labels as described above because the process in this instance is to be performed after having been determined that the text can be replaced in S56 of the cassette reading process. For that process, the values of the text buffer b 145 and the text buffer a 144 are respectively copied to the text buffer a for operations and the text buffer b for operations (both of which are not shown in the drawings) of the memory for other operations in the RAM 14. Since there is a possibility that the replacement process between the upper and lower labels is performed on two numbering flags to be set in the following print format input process (FIG. 17), information of replacement or no replacement is stored in a predetermined flag of the memory 155 for other operations. Thereafter, the replacement process is terminated, and the flow returns to FIG. 15.

Figure 17:
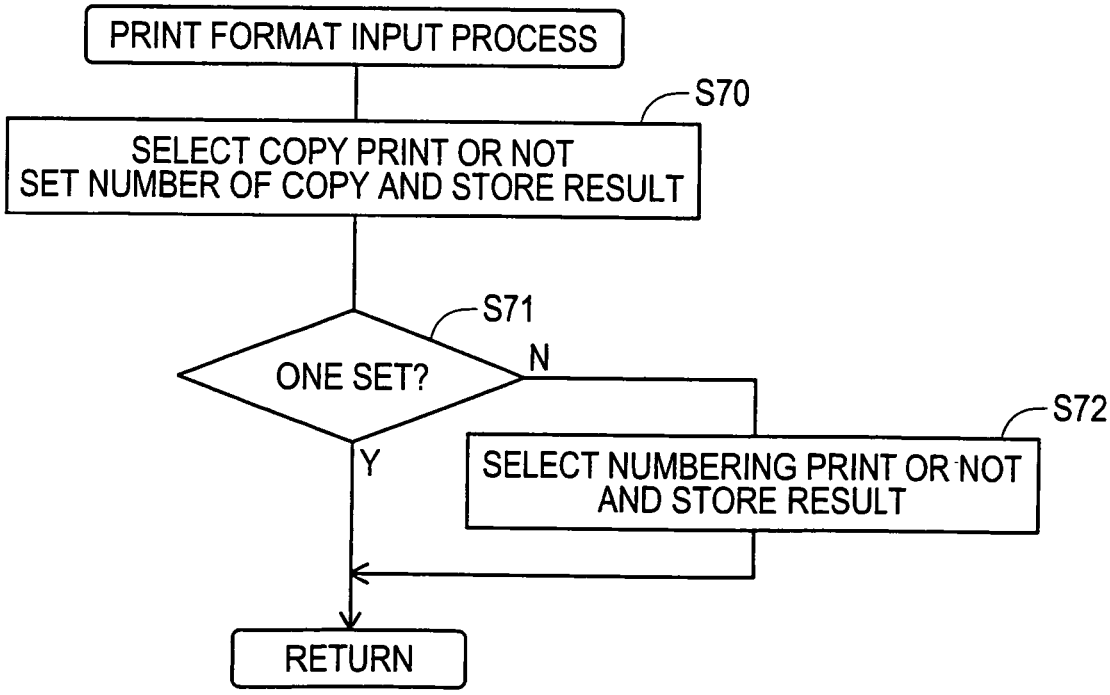
FIG. 17 is a flowchart of a print format input process.
Figure 60:
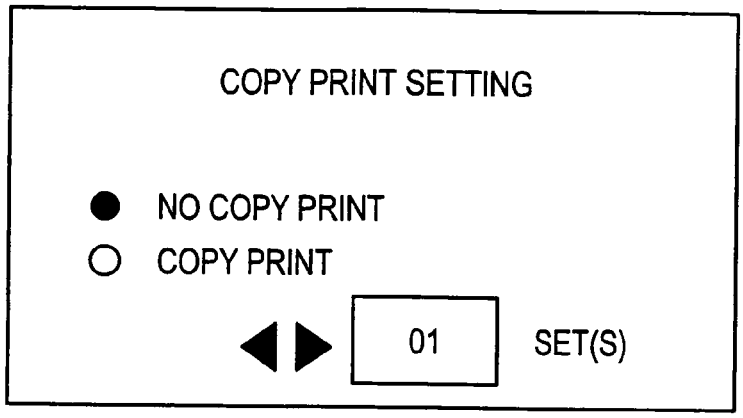
FIG. 60 is a copy print setting screen for a template input mode.

Next, the print format input process will be described with reference to FIG. 17. When the print format input process is called in S43 of FIG. 14, the user is made to set whether or not the print is a copy print and then set the number of copies if the copy print is set. The input screens for that process will be described with reference to FIGS. 59 and 60. FIG. 59 is a copy print setting screen for the normal input mode, and FIG. 60 is a copy print setting screen for the template input mode. The displaying of the copy print setting screen for the normal input mode or the copy print setting screen for the template input mode is determined based on the value of the template flag 142. "No copy print" and "copy print" are displayed as the selection items and radio buttons for selecting either one of these items are provided on both the screens as shown in FIG. 59 and FIG. 60. Another setting item for setting the number of copies or sets is provided underneath the above-described two items. The setting item is available only when the "copy print" is selected. Right after the number of copies setting screen is displayed, the "no copy print" indicated on the top of the selection items is being in the state of selection. The user changes the selection item in the state of selection by pressing the up/down keys (not shown). Further, the number of copies or sets is incremented or decremented (not including 0) by pressing the left/right keys (not shown). The setting is determined by pressing the OK key (not shown). If the "no copy print is selected", 1 is stored in the total number of sets (total number of labels) 146 in the RAM 14. If the "copy print is selected", the total number of labels or the total number of sets being input to the total number of sets (total number of labels) 146 in the RAM 14 is stored.

Note that, the set is an assembly of labels that are different from each other in print contents. The label making apparatus 1 according to the first exemplary embodiment includes the two text buffers, and enables to make the labels as the print contents stored in the two buffers all at once, and the maximum number of labels configuring one set is two. In the case where text has been input to both the two text buffers, two labels make one set. However, in the case where one of the two text buffers is empty, one label makes one set. As described above, since there are two text buffers in the first exemplary embodiment, two is the maximum number of labels in one set. However, if there are three or more text buffers as another exemplary embodiment, the number of text buffers becomes the maximum number of labels in one set. In the first exemplary embodiment, it may seem that two is a unit of one set because the different pieces of print contents are respectively printed in the upper and lower labels on the tape with two divisions. However, the unit is not derived from the number of divisions of the tape. The different labels in sets of two can be made while being arranged in the tape longitudinal direction on the tape with no divisions. It is conceivable that the number of divisions of the tape becomes larger than the maximum number of different labels in one set, and on the contrary, the number of divisions of the tape becomes smaller than the maximum number of different labels in one set.

Figure 61:
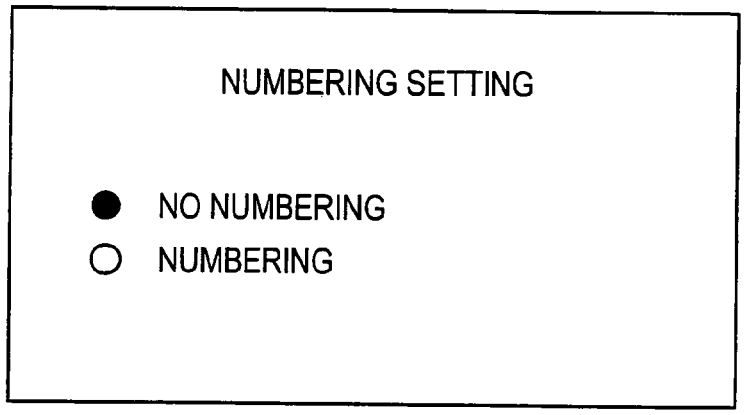
FIG. 61 is a numbering setting screen for the normal input mode.
Figure 62:
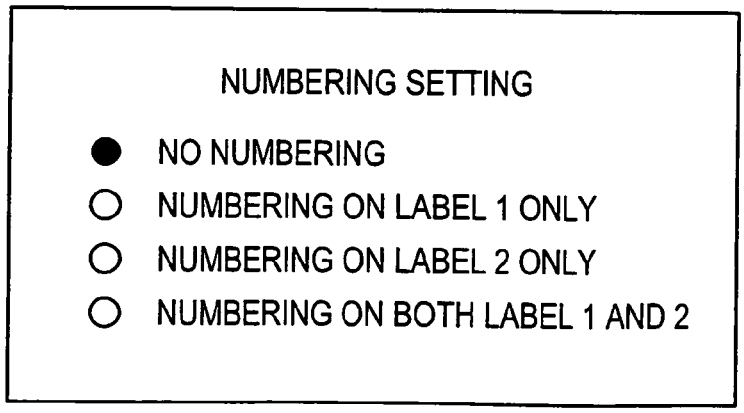
FIG. 62 is a numbering setting screen for the template input mode.

After S70, the flow proceeds to S71 where it is determined whether or not the value stored in the total number of sets (the total number of labels) 146 in the RAM 14 is 1. If the total number of sets (the total number of labels) 146 is 1, the print format input process is terminated, and the flow returns to FIG. 14. On the contrary, if the total number of sets (the total number of labels) 146 is not 1, the flow proceeds to S72 where the user is made to select whether or not the numbering print is to be performed. The input screens for that process will be described with reference to FIGS. 61 and 62. FIG. 61 is a numbering setting screen for the normal input mode, and FIG. 62 is a numbering setting screen for the template input mode. The displaying of the numbering setting screen for the normal input mode or the numbering setting screen for the template input mode is determined based on the value of the template flag 142. The numbering generally means that numbers or the like are changed on the basis of a predetermined rule every time the text of the print contents is made. In many cases, a portion representing a value is incremented or decremented every time one label is made. In typical cases, a portion representing an alphabetic character is changed in alphabetical order. Note that in the first exemplary embodiment, the number which appears first in searching the text being stored in the text buffer from its end is incremented. However, 0 follows 9 without a carry.

"No numbering" and "numbering" are displayed as the selection items and radio buttons for selecting either one of these items are provided on the numbering setting screen for the normal input mode as shown in FIG. 61. Further, "no numbering", "numbering on label 1 only", "numbering on label 2 only" and "numbering on both label 1 and 2" are displayed as the selection items and radio buttons for selecting one of these items are provided on the numbering setting screen for the template input mode as shown in FIG. 62. The user changes the selection item in the state of selection by pressing the up/down keys (not shown), and determines by pressing the OK key (not shown). The value of the numbering flag (not shown) of the memory for other operations in the RAM 14 is set based on the selected result. Two numbering flags are prepared, namely, the numbering flag for label 1 and the numbering flag for label 2, and the two flags can be independently set (when the replacement between the upper and lower labels in the replacement process in FIG. 16 occurs, the numbering flags need to be replaced by each other. Replacement or no replacement is confirmed by referring to a predetermined flag that is set in FIG. 16 that is stored the memory 155 for other operations. This flag is temporarily utilized and cleared after the reference). The text buffer a 144 is the text buffer for label 1, and the text buffer b 145 is the text buffer for label 2. In the template input mode, the upper label and the lower label to be printed on the tape with divisions correspond to the label 1 and the label 2, respectively. After terminating the process of S72, the print format input process is terminated, and the flow returns to FIG. 14.

Figure 18:
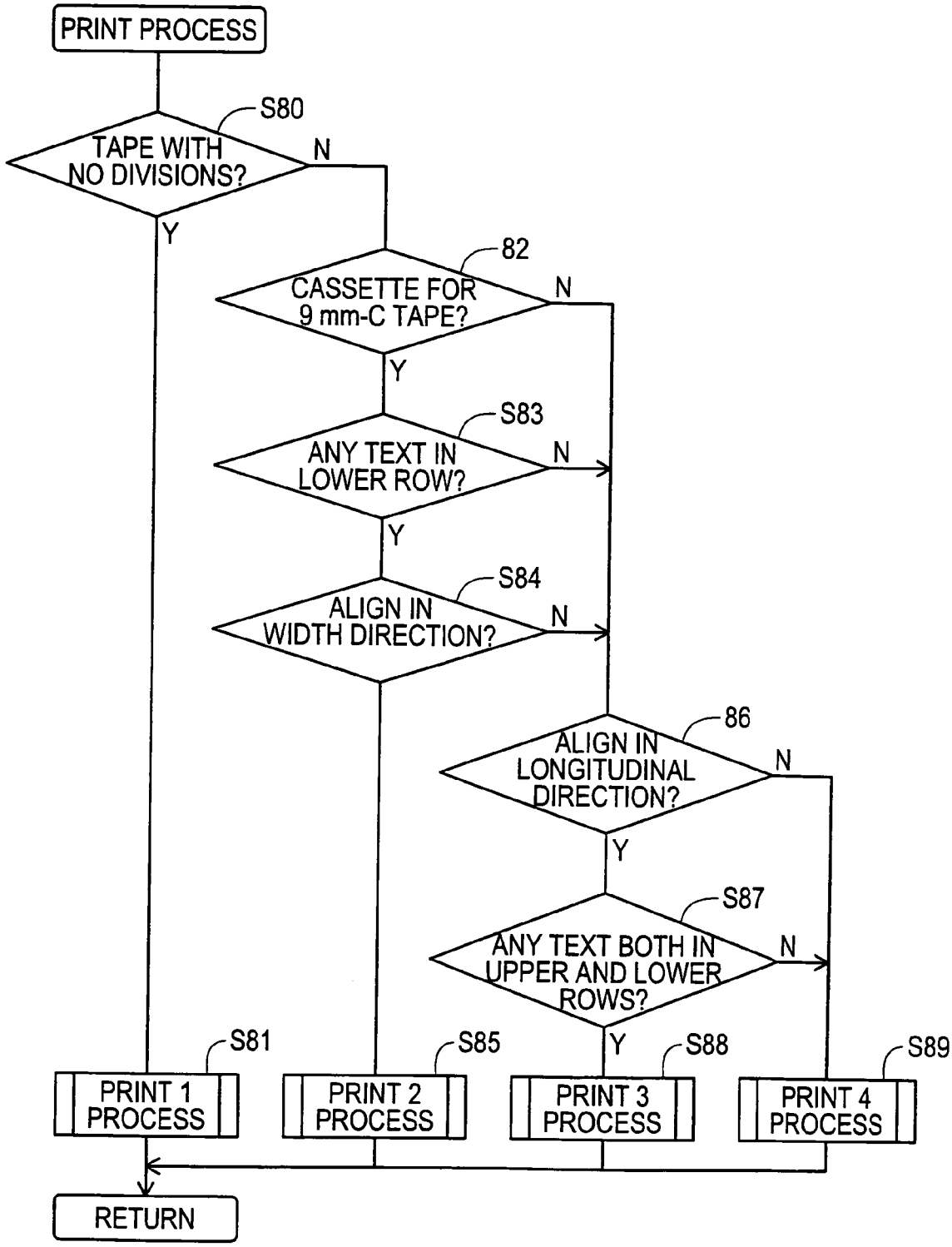
FIG. 18 is a flowchart of a print process.

Next, the print process will be described with reference to FIG. 18. When the print process is called in S44 of FIG. 14, it is determined whether or not the label to be made is a label that is made by using the tape with no divisions in S80. The label can be made only when the tape with no divisions is mounted in the normal input mode. For more detail, it is determined that the label to be made is a label that is made by using the tape with no divisions (S80: YES) when the template flag 142 is OFF and the type of cassette is any one of 24 mm tape, 18 mm tape, 12 mm tape and 9 mm tape. If the label to be made is a label that is made by using the tape with no divisions, the flow proceeds to S81 to execute the print 1 process. The print 1 process will be described later with reference to FIG. 19. After executing the print 1 process, the print process is terminated, and the flow returns to FIG. 14. As an example of the label to be made in the print 1 process, FIG. 2 can be given. In FIG. 2, one label 52 the height of which is equal to the tape width is arranged on the tape with no divisions. Although not shown, plural labels of the same print contents are arranged in the tape longitudinal direction as the copy print, and each of the labels of the copy print is numbered (numbering print) as the labels that can be made in the print 1 process. The setting of cutting or no cutting between the labels that are made by the copy print and the numbering print is functioned in this process.

If it is determined that the label to be made is not a label that is made by using the tape with no divisions in S80 (S80: NO), the flow proceeds to S82. Here, it is determined that the label to be made is a label that is made by using the 9 mm-C tape (if the cassette for 9 mm-C tape is mounted in the label making apparatus 1 even in the normal input mode, the label can be made as the upper label. However, the explanation thereof is omitted here). The label can be made only in the template input mode (when the template flag 142 is ON) and only when the tape with 1:1 divisions (the type of cassette, not shown, is 9 mm-C tape) is mounted. If it is determined that the label to be made is a label that is made by using the 9 mm-C tape (S82: YES), the flow proceeds to S83. On the other hand, if it is determined that the label to be made is not a label that is made by using the 9 mm-C tape (S82: NO), the flow proceeds to S86.

In S83, it is determined whether or not there is text in the lower row. The input text is stored in the text buffer a 144 or the text buffer b 145 when editing in the template input mode. For the tape with two divisions, the text buffer a 144 stores the print contents of the upper label, and the text buffer b 145 stores the print contents of the lower label. In this case, it is determined whether or not there is text in the text buffer b 144. If there is no text in the lower row (S83: YES), the flow proceeds to S84. On the other hand, if there is text in the lower row (S83: NO), the flow proceeds to S86. In S84, when a plurality of labels are to be arranged, it is determined whether or not the plurality of labels are to be arranged while being aligned in the tape width direction. The determination is made with the value of the width direction alignment flag 152 of the RAM 14. If the width direction alignment flag 152 is ON, it is determined that the plurality of labels are to be aligned in the tape width direction (S84: YES) and the flow proceeds to S85. On the other hand, if the width direction alignment flag 152 is OFF, it is determined that the plurality of labels are not to be aligned in the tape width direction (S84: NO) and the flow proceeds to S86. In S85, a print 2 process is performed, then the print process is terminated, and the flow returns to FIG. 14.

Figure 29:
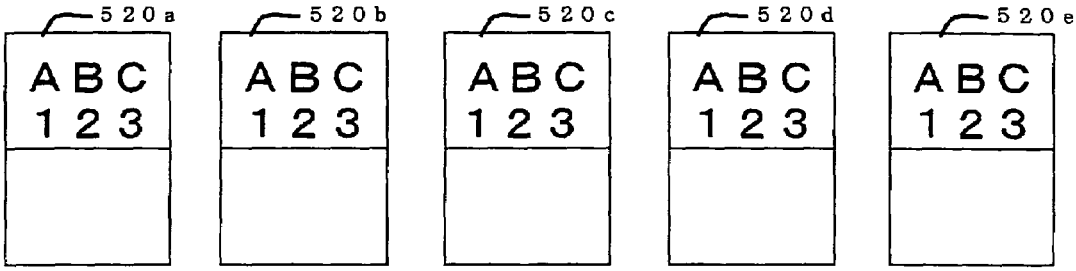
FIG. 29 is a diagram illustrating a print example in which the labels are not aligned in a tape width direction on the 9 mm-C tape (1:1 divisions)
Figure 30:
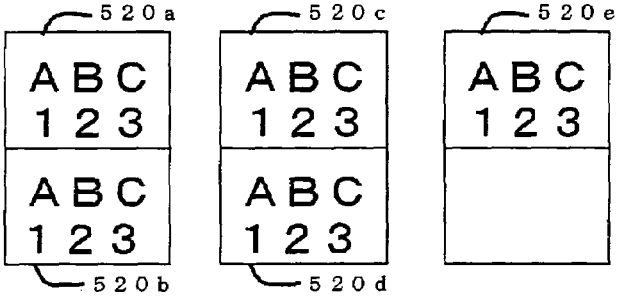
FIG. 30 is a diagram illustrating a print example in which the labels are aligned in the tape width direction on the 9 mm-C tape (1:1 divisions)

Here, with reference to FIGS. 29 and 30, the explanation will be made to the meaning of arranging a plurality of labels while aligning in the tape width direction. FIG. 29 is a diagram illustrating a print example in which the labels are not aligned in the tape width direction on the 9 mm-C tape (1:1 divisions), and FIG. 30 is a diagram illustrating a print example in which the labels are aligned in the tape width direction on the 9 mm-C tape (1:1 divisions) (both of which are made by the copy print). FIG. 29 shows a state in which five labels 520*a* to 520*e*, each having the print contents of "ABC" at the first line and "123" at the second line, are respectively arranged on the upper rows of five tape pieces of the 9 mm-C tape. It is understood that the lower rows of the tape pieces are not used. On the other hand, in FIG. 30, the labels are arranged in the lower rows of the tape pieces in addition to the upper rows. This is because the label 520*b* is arranged underneath the label 520*a* on the left tape piece in FIG. 30, and the label 520*d* is arranged underneath the label 520*c* on the middle tape piece in FIG. 30. When a plurality of labels are made, the labels are arranged while being aligned in the tape width direction as shown in FIG. 30, so that it is possible to save the length of the tape that is used when making the same number of labels. In the print 2 process, one label is also made in the template input mode by using the 9 mm-C tape (1:1 divisions). Although not shown, the numbering print is also performed. The setting of cutting or no cutting between the labels that are made by the copy print and the numbering print is functioned in this process.

Next, when a plurality of labels are to be made, it is determined whether or not the plurality of labels are to be aligned in the tape longitudinal direction. The determination is made with the value of the length direction alignment flag 153 in the RAM 14. If the length direction alignment flag 153 is ON, it is determined that the plurality of labels are to be aligned in the tape longitudinal direction (S86: YES) and the flow proceeds to S87. On the other hand, if the length direction alignment flag 153 is OFF, it is determined that the plurality of labels are not to be aligned in the tape longitudinal direction (S86: NO) and the flow proceeds to S89. In S87, it is determined whether or not there is text in both the upper and lower rows on the tape with two divisions. The determination is made by confirming that any of the text buffer a 144 and the text buffer b 145 is not empty. When any of the text buffers is not empty, it is determined that there is text in both the upper and lower rows (S87: YES), and the flow proceeds to S88. On the other hand, when there is no text in at least one of both the text buffers, it is determined that there is no text in any of the upper and lower rows (S87: NO), and the flow proceeds to S89. In S88, a print 3 process is performed, and then the flow returns to FIG. 14.

Figure 27:
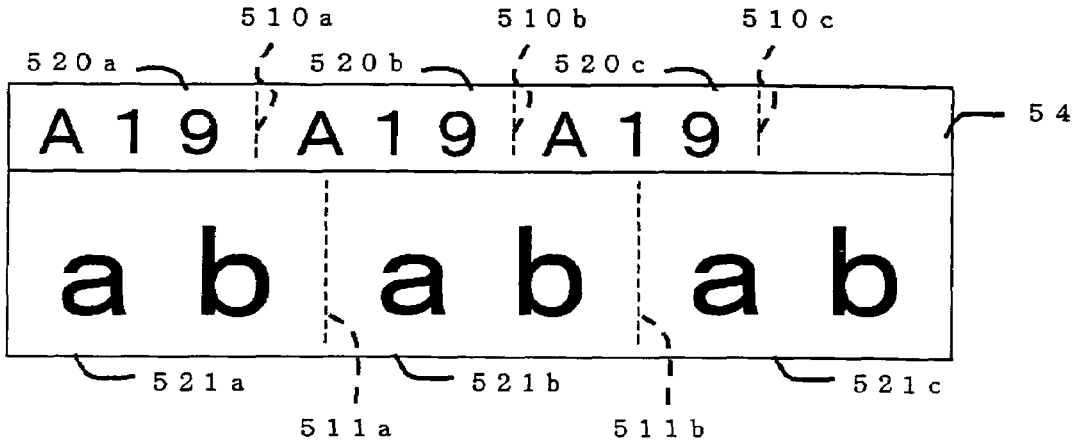
FIG. 27 is a diagram illustrating a print example in which labels are aligned in a tape longitudinal direction on the tape with divisions.

Here, with reference to FIG. 27, the explanation will be made to the meaning of aligning a plurality of labels in the tape longitudinal direction. FIG. 27 is a diagram illustrating a print example in which the labels are aligned in the tape longitudinal direction on the tape with divisions. The labels 520*a*, 520*b* and 520*c* are arranged in the upper row of the tape with divisions without spaces therebetween, and the labels 521*a*, 521*b* and 521*c* are arranged in the lower row of the tape with divisions without spaces therebetween. Cut lines 510*a* and 510*b* made by print are arranged between the labels 520*a* and 520*b* and between the labels 520*b* and 520*c* in the upper row of the tape, respectively. Further, a cut line 510*c* representing a segment of the label is arranged at the right end of the label 520*c*. A margin 54 is formed on the right side of the cut line 510*c*. Cut lines 511*a* and 511*b* made by print are arranged between the labels 521*a* and 521*b* and between the labels 521*b* and 521*c* in the lower row of the tape, respectively. The above description can be understood by referring to FIG. 27. As described above, the alignment in the longitudinal direction means that the respective labels are arranged in the tape longitudinal direction without spaces therebetween. This configuration produces the effects that: when the labels are used while being separated, it is possible to reduce the number of times of cutting the labels; the pieces of margin can be easily handled because the margins can be collected without dispersion; and when some useful information is printed by using the margin, the amount of information can be increased due to a large area of the margin.

Hereinafter, the longer margin that is generated by aligning the labels in the tape longitudinal direction is referred to as a single margin. Note that the labels 520*a*, 520*b*, and 520*c* in the upper row are aligned to the left with respect to the tape piece in the first exemplary embodiment. However, it does not cause any problems if the labels are aligned to the right with respect to the tape piece in another exemplary embodiment.

Figure 14:
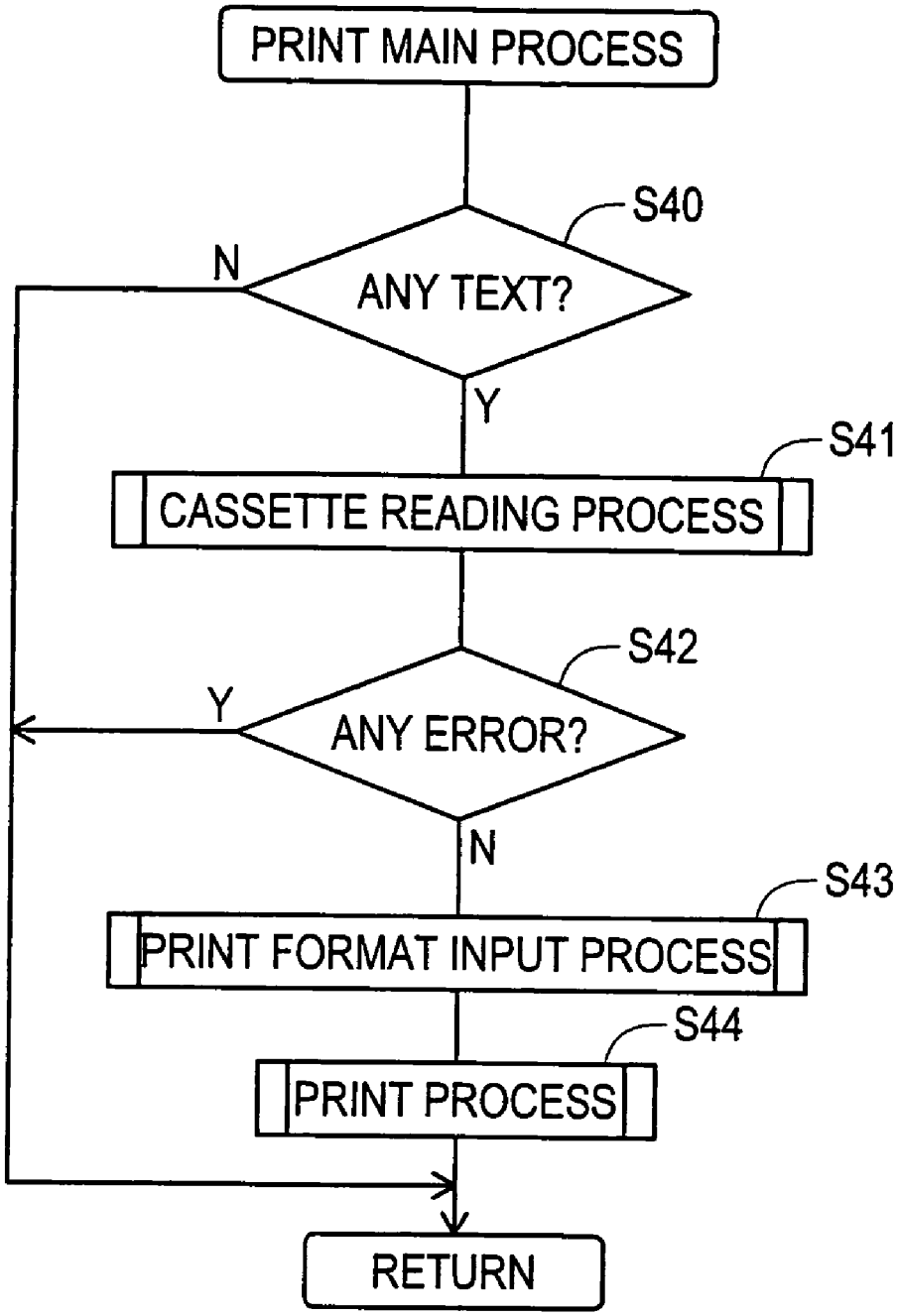
FIG. 14 is a flowchart of a print main process.
Figure 15:
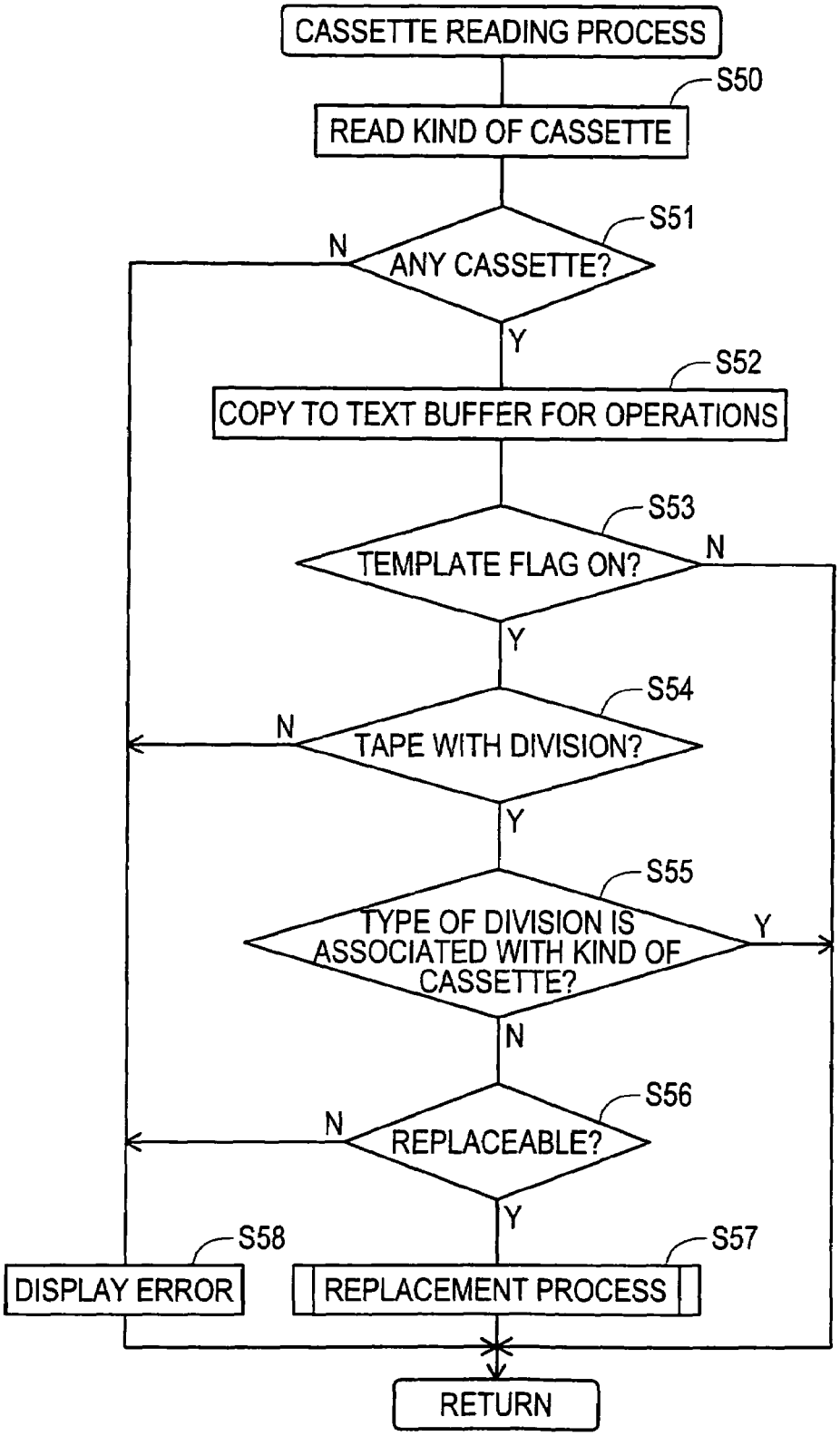
FIG. 15 is a flowchart of a cassette reading process.

Next, in S89, a print 4 process is executed, the print process is terminated after the completion of the print 4 process, and the flow returns to FIG. 14. The print 4 process will be described later with reference to FIG. 23. Here, the explanation will be made to the label that is made in the print 4 process. In the print 4 process, when the cassette accommodating the tape with two divisions is mounted in the label making apparatus 1, the label is arranged only in the upper row in the normal input mode, and thus the label is not arranged in the lower row. Note that when the mounted cassette accommodates the tape with no division, the label is made in the print 1 process (in the normal input mode). Next, in the case of the template input mode, all kinds of tape pieces are made in this process except the tape piece which is made in the above-described print 2 process and on which the labels are aligned in the tape width direction, and the tape piece which is made in the above-described print 3 process and on which the labels are aligned in the tape longitudinal direction.

Figure 25:
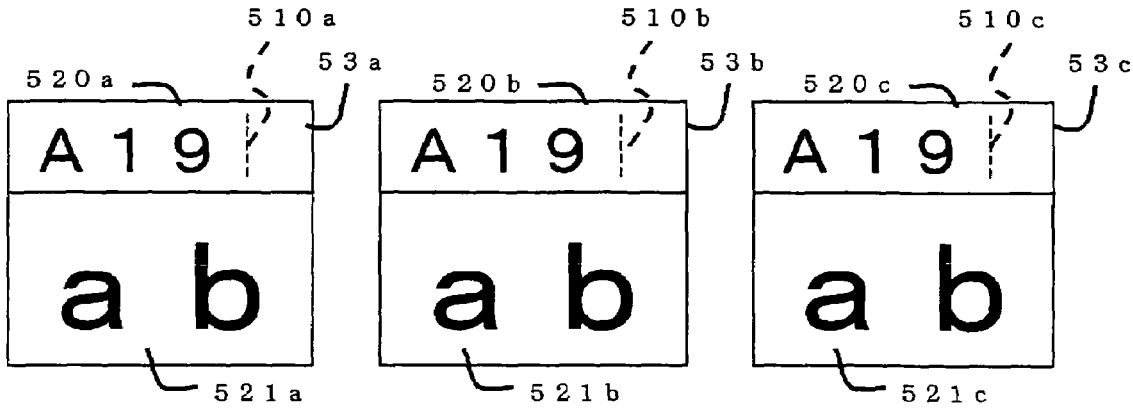
FIG. 25 is a diagram illustrating a print example of a copy print on a tape with divisions.
Figure 26:
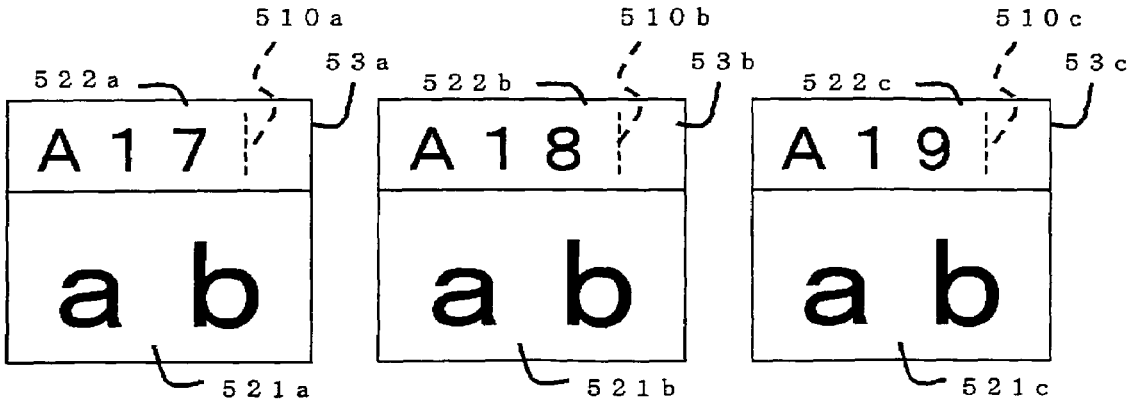
FIG. 26 is a diagram illustrating a print example of a numbering print on the tape with divisions.
Figure 28:
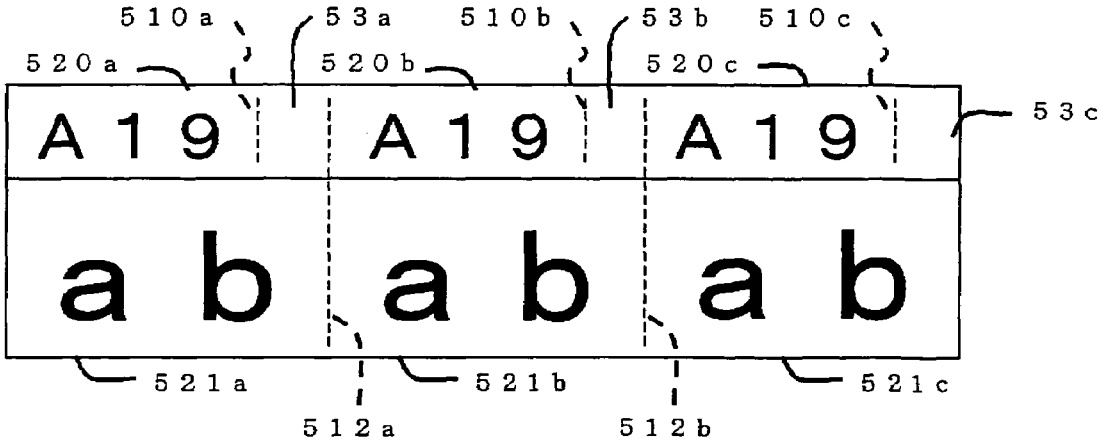
FIG. 28 is a diagram illustrating a print example in which the tape with divisions is not cut for each print.

The labels to be made will be described with reference to FIGS. 25, 26 and 28. FIG. 25 is a diagram illustrating a print example of the copy print on the tape with divisions. FIG. 26 is a diagram illustrating a print example of the numbering print on the tape with divisions. FIG. 28 is a diagram illustrating a print example in which the tape with divisions is not cut for each print. Note that these examples employ the 9 mm-A tape with 1:2 divisions. In FIG. 25, there are made three sets of labels, each of which includes a narrow label of the print contents "A19" and a wide label of the print contents "ab". The first set of the labels 520*a* and 521*a* is arranged on the left tape piece, the second set of the labels 520*b* and 521*b* is arranged on the middle tape piece, and the third set of the labels 520*c* and 521*c* is arranged on the right tape piece. The narrow labels 520*a*, 520*b*, and 520*c* are arranged while being aligned to the left in the upper rows of the tape pieces, respectively. At the right ends of the narrow labels 520*a*, 520*b*, and 520*c*, there are respectively arranged the cut lines 510*a*, 510*b* and 510*c* that represent boundaries between labels and that are the lines made by print. Further, on the right side of the cut lines 510*a*, 510*b* and 510*c*, there are respectively formed margins 53*a*, 53*b* and 53*c*. The labels are arranged in the above-described manner if the following conditions are satisfied. The label is made by the copy print; any one of the upper and lower labels is not numbered; the upper label is shorter than the lower label in the length of the tape longitudinal direction of each of the upper and lower labels; each of the labels is not aligned in the tape longitudinal direction; and the tape is cut for each print. Note that the tape pieces are made in the order of left, middle, and right.

The difference between FIGS. 25 and 26 is that the pieces of print contents of the upper narrow labels are different from each other. The print contents is "A17" on the label 522*a*, "A18" on the label 522*b*, and "A19" on the label 522*c*. The text buffer a for operations initially stores the contents of "A17", the numbers are searched from the end of the text, and then the number 7 that appears first is incremented every time one label is made. FIGS. 25 and 26 are different from each other in numbering or no numbering.

The difference between FIGS. 28 and 25 is that the tape pieces being divided into three in FIG. 25 are integrally formed into one piece. Instead of being cut between the left tape piece and the middle tape piece in FIG. 25, there is arranged in FIG. 28 the printed cut line 512*a* which extends in the tape width direction and which has a length to cover almost the whole range of the tape width. Further, instead of being cut between the middle tape piece and the right tape piece in FIG. 25, there is arranged the printed cut line 512*b* which is formed in the same manner as described above in FIG. 28. FIGS. 28 and 25 are different from each other in whether or not the tape is cut for each print.

Figure 31:
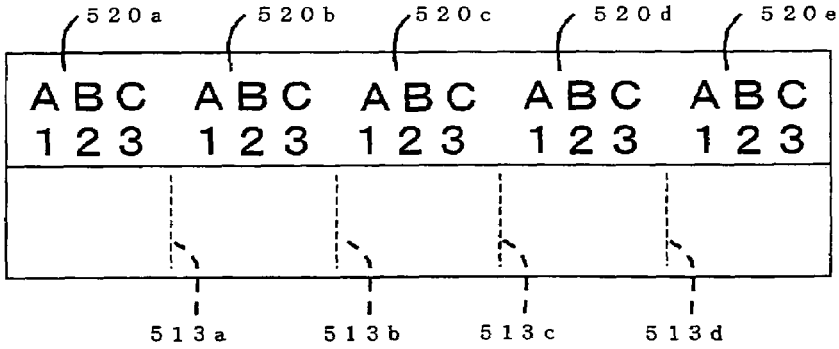
FIG. 31 is a diagram illustrating a print example in which cut lines are displayed in a margin.

In the print 4 process, not only a plurality of sets of labels as FIGS. 25, 26, and 28, but also one set of labels as FIGS. 3, 4, and 5 described above is made. Further, there is made the label which is not arranged in one of the upper and lower rows of the tape with divisions as shown in FIG. 29 (in this example, no arrangement in the lower row). Incidentally, the arrangement as shown in FIG. 29 is achieved in the case where the cassette accommodating the tape with divisions is mounted in the label making apparatus 1 in the normal input mode, and in the case where text is not input in one of the two text buffers in the template input mode. FIG. 31 is one of the examples of the tape piece made in the print 4 process, and shows a print example in which the cut lines are displayed in the margin. The difference between FIGS. 29 and 31 is only that the tape is cut or not cut for each print. As shown in FIG. 31, the label is arranged in only one of the upper and lower rows of the tape with divisions. When either of the upper and lower rows is empty, there are arranged the cut lines that are boundaries between the labels in the tape longitudinal direction in the empty row. Specifically, in FIG. 31, the cut line 513*a* between the labels 520*a* and 520*b* arranged in the upper row of the tape is arranged in the lower row of the tape, the cut line 513*b* between the labels 520*b* and 520*c* arranged in the upper row of the tape is arranged in the lower row of the tape, the cut line 513*c* between the labels 520*c* and 520*d* arranged in the upper row of the tape is arranged in the lower row of the tape, and the cut line 513*d* between the labels 520*d* and 520*e* arranged in the upper row of the tape is arranged in the lower row of the tape. Such an arrangement produces the effect of giving a good appearance to the labels without leaving the cut lines when the tape is cut between the labels.

Figure 19:
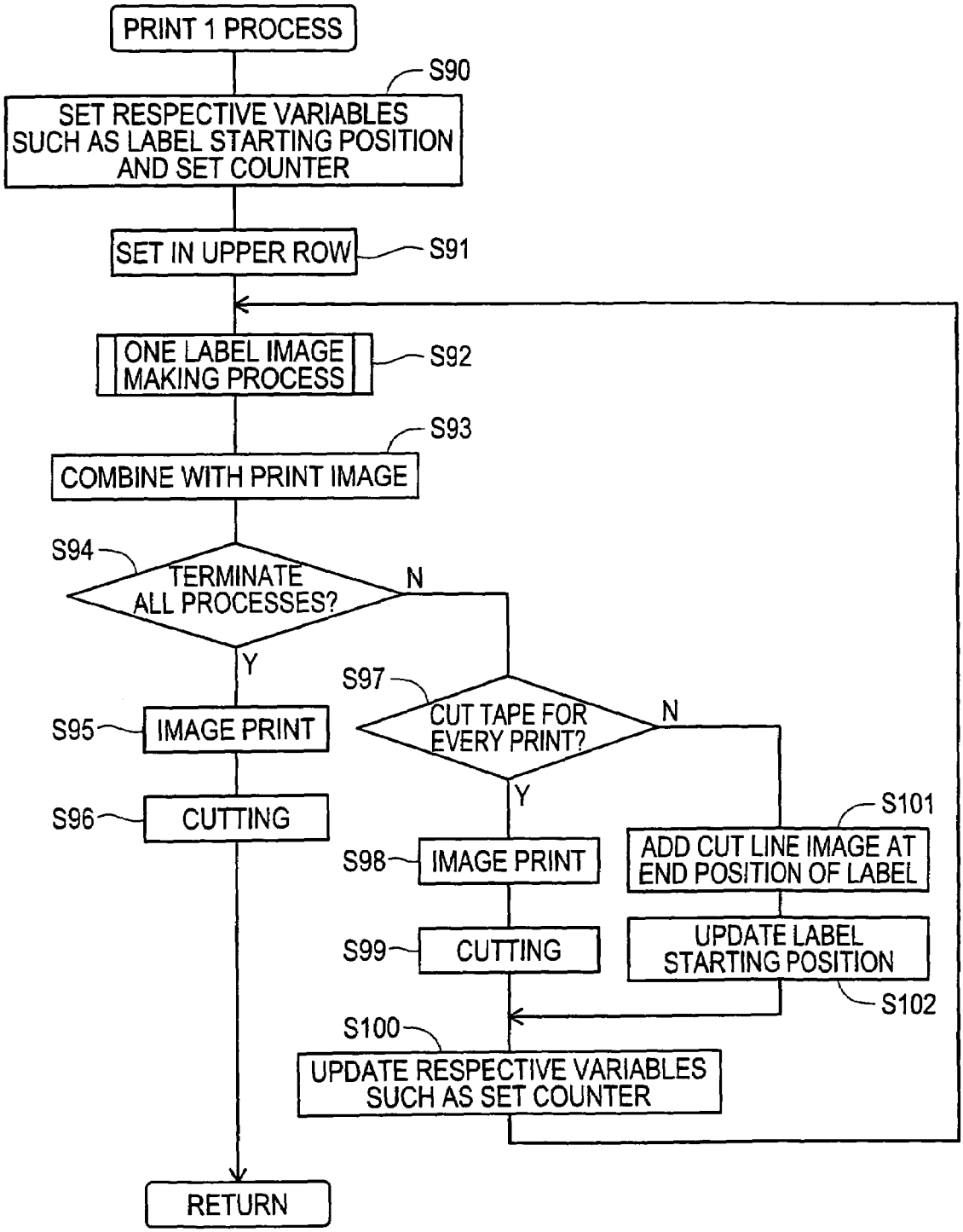
FIG. 19 is a flowchart of a print 1 process.

Next, the print 1 process will be described with reference to FIG. 19. FIG. 19 is a flowchart of the print 1 process. When the print 1 process is called in FIG. 18, the respective variables such as the label starting position and the set counter are set in S90. For example, since the tape has no divisions, the upper row label starting position 148 and the upper row label length 149 are used as the label starting position and the label length, the label starting position in the tape width direction is set to 0 as a coordinate value that indicates the upper end of the tape, the label starting position in the tape longitudinal direction is set to 0 as a coordinate value that indicates the left end of the tape (as the position in the tape width direction is directed downward, the value becomes larger, and as the position in the tape longitudinal direction is directed rightward, the value becomes larger, which is applied to the following description). The label length is set to 0 (the value is obtained by converting the label starting position or the label length into the length on the unit of the magnitudes of dots of the thermal head 22, which is applied to the following description) by counting the length in the tape longitudinal direction. Further, the print buffer 140 is cleared, and the set counter 147 is set to 1. In addition, appropriate variables are set to predetermined values as needed.

Thereafter, the flow proceeds to S91 where the label to be made is set to be arranged in the upper row. For this setting, the row counter (not shown) of the memory for other operations is set to the upper row. Thereafter, the flow proceeds to S92 where a one label image making process is executed. The one label image making process will be described later with reference to FIG. 20. Thereafter, the flow proceeds to S93. In the one label image making process, since the image data for one label is made in the label image buffer 141, the image data in the label image buffer 141 and the image data in the print buffer 140 are combined so that the label image in the label image buffer 141 is arranged at the position indicating the label starting position on a virtual tape image produced in the print buffer 140. The print buffer 140 is updated by using the combined image data. Hereinafter, this is shortened as "the label image and the print image are combined" and the like.

Thereafter, the flow proceeds to S94 where it is determined whether or not all the processes are terminated. It is determined whether or not the set counter 147 matches the total number of sets 146. All the processes are terminated if the set counter 147 matches the total number of sets 146. If all the processes are terminated (S94: YES), the flow proceeds to S95. If all the processes are not terminated (S94: NO), the flow proceeds to S97. In S95, the image print is performed. Here, the thermal head 22 is made to be in cooperation with the tape feeding motor 23 while the head driving circuit 26 is synchronous with the motor driving circuit 27, and accordingly the print image stored in the print buffer 140 is printed on the tape. Thereafter, the flow proceeds to S96 where the cutter driving circuit 28 moves the cutter 24 to cut the tape, so that the tape pieces are made. Thereafter, the print 1 process is terminated, and the flow returns to FIG. 18.

On the other hand, if all the processes are not terminated (S94 NO), it is determined whether or not the tape is cut for each print in S97. If the each-print cutting flag 154 is ON, it is determined that the tape is cut for every print. If the tape is cut for each print (S97: YES), the flow proceeds to S98 where the print image stored in the print buffer 140 is printed on the tape as similar to S95. Thereafter, the flow proceeds to S99 to cut the tape, and then proceeds to S100. Here, the respective variables are updated in addition to the set counter 147. For example, the set counter 147 is incremented, and the print buffer 140 is cleared if the each-print cutting flag 154 is ON. In addition, appropriate variables are set to predetermined values as needed. Thereafter, the flow proceeds to S92 where the forgoing processes are repeated. On the other hand, if the tape is not cut for each print in S97 (S97: NO), the flow proceeds to S101 where a cut line image is added at the end position of the label. The end position of the label is a value obtained by adding the label length to the starting position of the label in the tape longitudinal direction. Thereafter, the flow proceeds to S102 to update the label starting position by adding the label length to the starting position of the label in the tape longitudinal direction. The foregoing is the description of the print 1 process.

Figure 20:
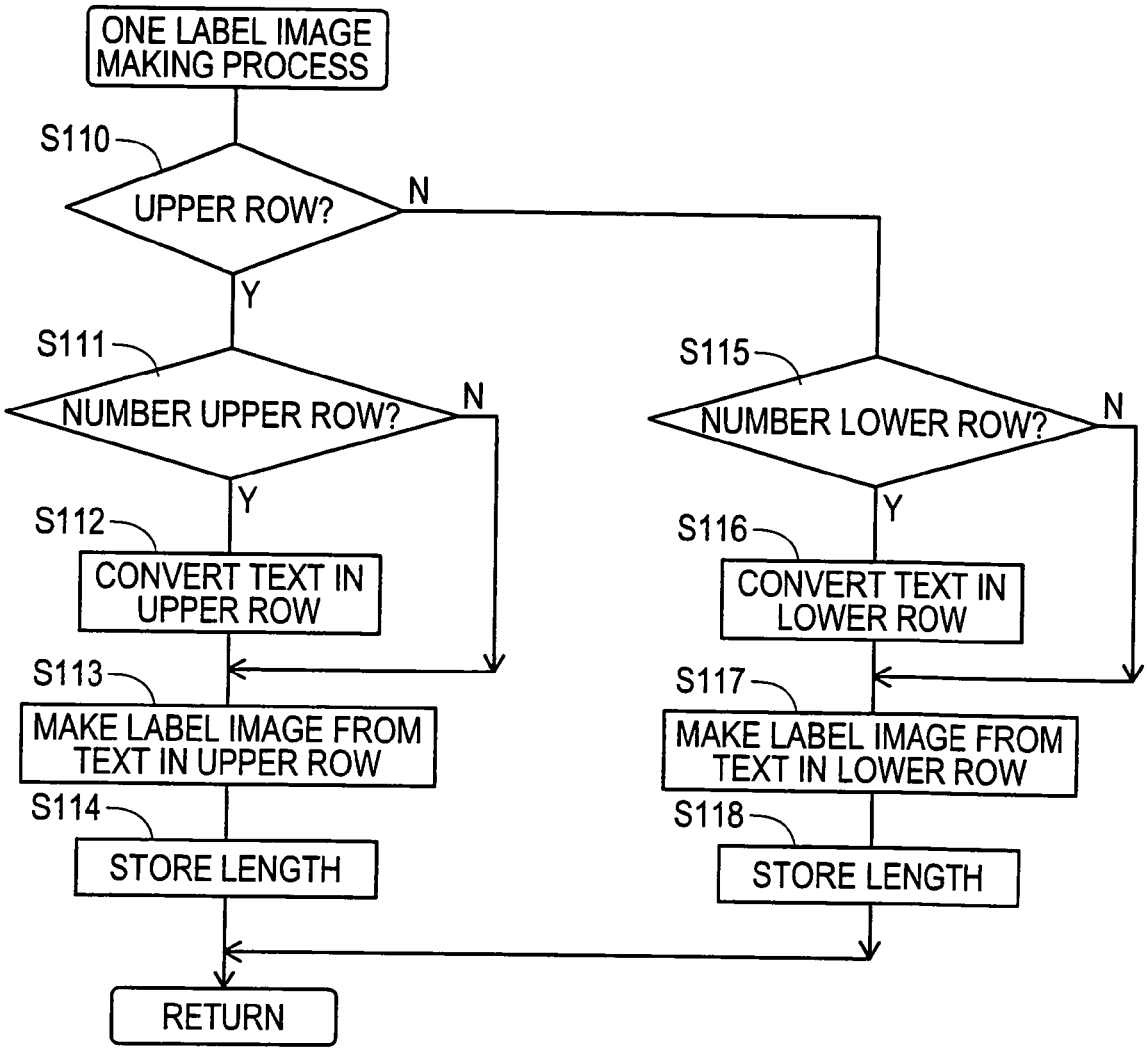
FIG. 20 is a flowchart of a label image making process.

Next, in addition to S92 in the print 1 process, the one label image making process called in the print 2 process (FIG. 21) and the like will be described with reference to FIG. 20. First, it is determined whether or not the label is to be arranged in the upper row by using the value of the row counter (not shown) in the memory 155 for other operations in S110. If the label is to be arranged in the upper row (S110: YES), the flow proceeds to S111, and if the label is to be arranged in the lower row (S110: NO), the flow proceeds to S115. In S111, it is determined whether or not the label arranged in the upper row is to be numbered. This can be determined by confirming whether or not the numbering flag for the upper row (not shown) of the memory 155 for other operations is ON. If the label arranged in the upper row is to be numbered (S111: YES), the flow proceeds to S112 where the text stored in the text buffer a for operations is updated for the numbering print. The text is remained as it is without updating for the first time. Thereafter, the flow proceeds to S113. If the label arranged in the upper row is not to be numbered in S111 (S111: NO), the flow proceeds to S113 where there is made the label image having the print contents of the text stored in the text buffer a for operations that is the text buffer for the upper row, and then the label image is stored in the label image buffer 141.

In order to make the label image, first, the width of the row (the width 131*c* of the first row or the width 131*d* of the second row) on which the label is to be pasted is obtained by referring to the tape information table 131 by using the type of division 143 and the row counter (not shown). On the other hand, the number of lines of the text stored in the text buffer for operations (not shown) corresponding to the row counter (not shown) is obtained. The font size to be used for print on the label is obtained as follows. A predetermined value is multiplied by the value which is obtained by dividing the width of the row by the number of lines of the text, and the value thus obtained is reduced. A predetermined margin (a head margin) is provided at the head of the label on the virtual label image of the label image buffer 141. Thereafter, the following processes are repeated: a text code is obtained in order starting from the head of the text; the image data of the character corresponding to the code is obtained from a printing CG data 134 and then pasted; and the position where the image data of the character is pasted is displaced. If there is a line feed code, the position where the image data of the character is pasted is displaced at the point of the line feed code by a predetermined amount in the tape width direction and is moved to the position which is spaced by the head margin in the tape longitudinal direction. Then, the following processes are repeated again: the text code is sequentially obtained from the continuation of the text; the image data of the character corresponding to the code is obtained from the printing CG data 134 and then pasted; and the position where the image data of the character is pasted is displaced. After the arrangement of the image of the character string, a predetermined margin (tail margin) is provided at the end of the longest line.

Note that the image data of the character is scalable, and the image of the desired character is made by enlarging/reducing the data in accordance with the font size obtained as above. A predetermined space is provided between the character images. The pitch of the character is a fixed pitch, and if the font size is the same, the pitch of the character is not changed. By doing so, the label image is made. The lengths of the head margin, the character string of the longest line, and the tail margin make the length of the label. If the text has one line, the line becomes the longest line. If the text has two lines, a longer line becomes the longest line. The length of the character string of the longest line is obtained as follows. The number of text codes included in the longest line is multiplied by the size of the character width, and the value thus obtained is added to the value which is obtained by multiplying the predetermined length between the characters by the value that is obtained by subtracting 1 from the number of text codes included in the longest line. The foregoing is merely an example of making the label image. Thus, it goes without saying that if the switching of the vertical writing/horizontal writing of character strings, the setting of enlargement/reduction of characters, the setting of bold characters, outline characters, shadow-casting characters, and italic characters, and the setting of adding a frame to a whole label are possible as needed, the processes corresponding thereto are added in another exemplary embodiment. Furthermore, the method of making the label image and obtaining the label length are well-known.

Thereafter, the flow proceeds to S114. Here, since the length of the label in the tape width direction is calculated by specifying the positions where the images of the respective characters are pasted during the process of making the label image in S113 (the process of making the label image also includes the process of obtaining the label length), the length thus obtained is stored in the upper row label length 149. Thereafter, the one label image making process is terminated, the flow returns to the process that was called.

If it is determined that the label is to be arranged in the lower row (S110: NO), it is determined whether or not the label arranged in the lower row is to be numbered. To determine this, it is confirmed whether or not the numbering flag (not shown) for the lower row in the memory 155 for other operations is ON. If the label arranged in the lower row is to be numbered (S115: YES), the flow proceeds to S116, and the text stored in the text buffer b for operations is updated for the numbering print. Note that, the text is remained as it is without updating for the first time. Thereafter, the flow proceeds to S117. If the label arranged in the lower row is not to be numbered in S115 (S115: NO), the flow proceeds to S117 where the label image having the print contents of the text in the buffer b for operations that is the text buffer for the lower row is made in the above-described manner, and the image thus made is stored in the label image buffer 141. Thereafter, the flow proceeds to S118. Here, since the length of the label in the tape width direction is calculated during the process of making the label image in S117, the length thus obtained is stored in the lower row label length 151. Thereafter, the one label image making process is terminated, the flow returns to the process that was called.

Figure 21:
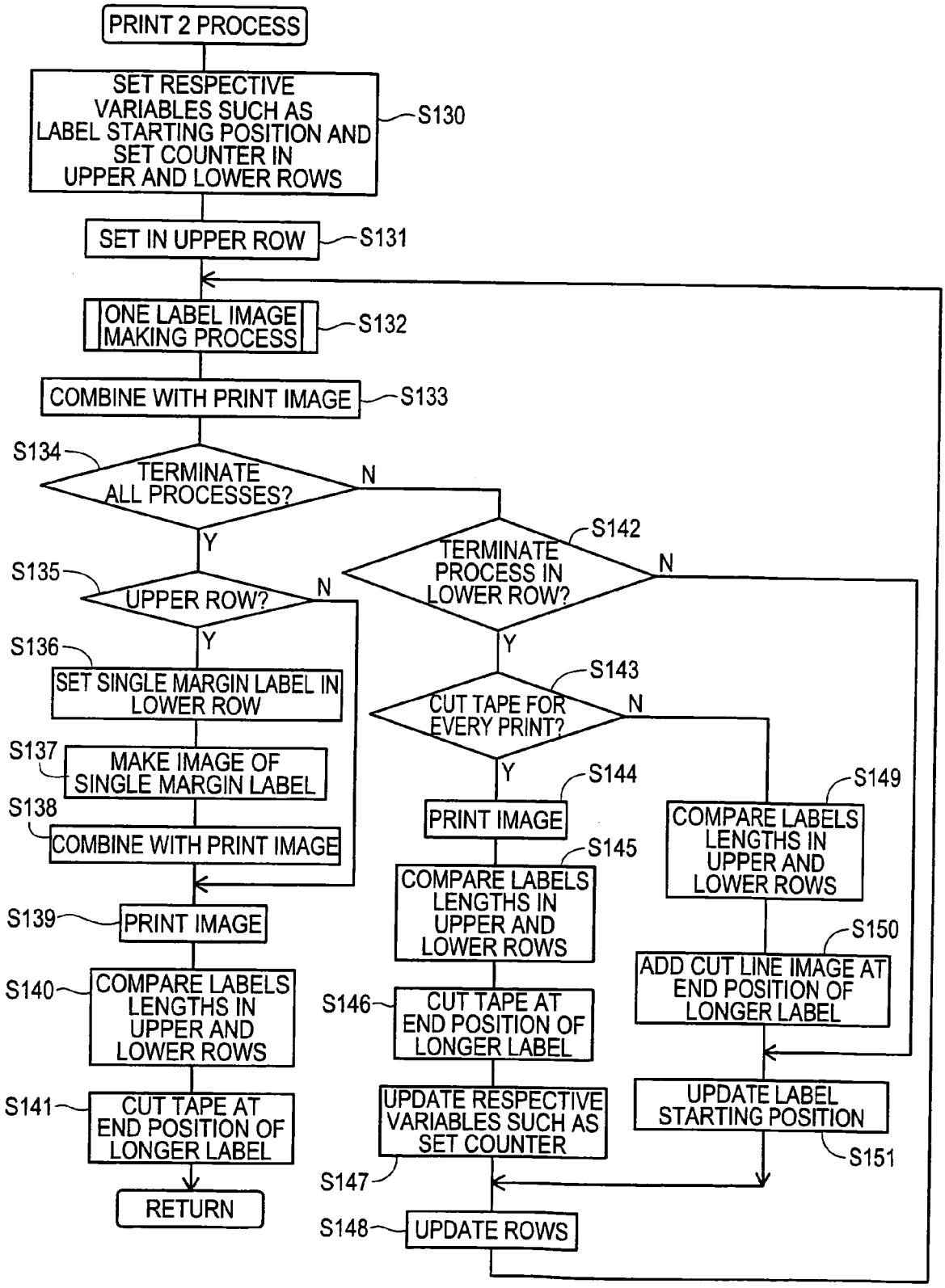
FIG. 21 is a flowchart of a print 2 process.

Next, the print 2 process will be described with reference to FIG. 21. FIG. 21 is a flowchart of the print 2 process. When the print 2 process is called in FIG. 18, the respective variables such as the label starting position and the set counter are set in S130. For example, since the tape has the divisions, all of the upper row label starting position 148 as the label starting position, the upper row label length 149 as the label length, the lower row label starting position 150 and the lower row label length 151 are used, the label starting position of the upper label in the tape width direction is set to 0 as a coordinate value that indicates the upper end of the tape, and the label starting position of the upper label in the tape longitudinal direction is set to 0 as a coordinate value that indicates the left end of the tape. The label length is set to 0 by counting the length in the tape longitudinal direction. The label starting position of the lower label in the tape width direction is set to the width of the first row of the corresponding kind of tape in the tape information table 131 as a coordinate value that indicates the upper end of the lower row of the divided tape, and the label starting position of the lower label in the tape longitudinal direction is set to 0 as a coordinate value that indicates the left end of the tape. The label length is set to 0 (the value is obtained by converting the label starting position or the label length into the length on the unit of the magnitudes of dots of the thermal head 22, which is applied to the following description) by counting the length in the tape longitudinal direction. Further, the print buffer 140 is cleared, and the set counter 147 is set to 1. In addition, appropriate variables are set to predetermined values as needed.

Thereafter, the flow proceeds to S131 where the label to be made is set to be arranged in the upper row. For this setting, the row counter (not shown) of the memory for other operations is set to the upper row. Thereafter, the flow proceeds to S132 where the one label image making process is executed (the one label image making process was described above with reference to FIG. 20). Thereafter, the flow proceeds to S133, and then the label image and the print image are combined. Thereafter, the flow proceeds to S134 where it is determined whether or not all the processes are terminated. It is determined whether or not the set counter 147 matches the total number of sets 146. All the processes are terminated if the set counter 147 matches the total number of sets 146. If all the processes are terminated (S134: YES), the flow proceeds to S135. If all the processes are not terminated (S134: NO), the flow proceeds to S142. In S135, it is determined whether or not the row counter (not shown) indicates the upper row. If it is determined that the upper row is not indicated (S135: NO), the flow proceeds to S139. If it is determined that the upper row is indicated, the flow proceeds to S136. As shown in FIG. 30, there is provided a margin in the lower row of the right tape piece. This margin is also the single margin, and a label on which useful information is printed in the margin is referred to as the single margin label that is differentiated from the (normal) label. As similarly applicable to a margin label to be described later, when being merely referred to as a label, the label does not include the margin label unless otherwise noted. In the next S137, the print image of the single margin label is made.

Figure 39:
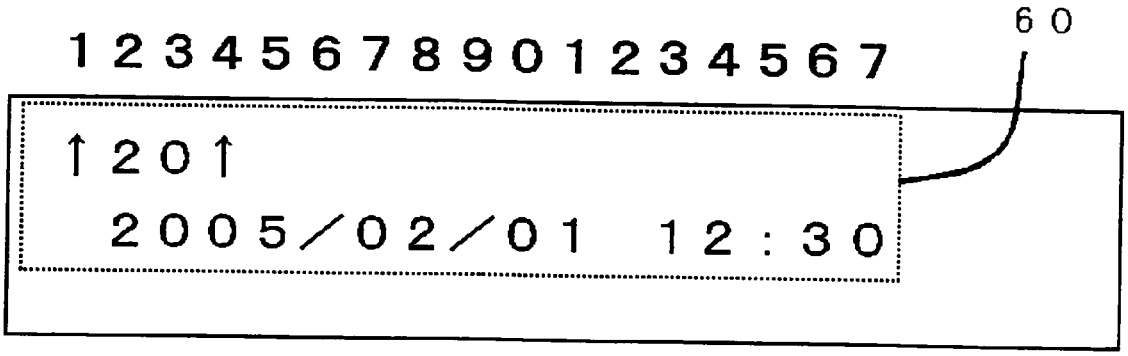
FIG. 39 is a diagram illustrating a print example of a single margin label (large)
Figure 40:
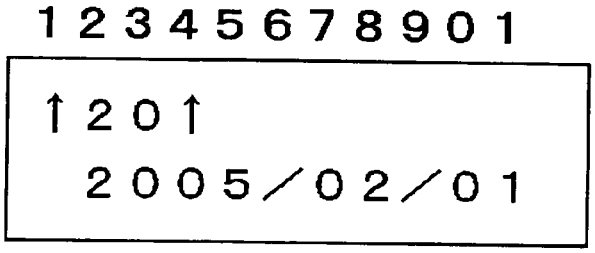
FIG. 40 is a diagram illustrating a print example of the single margin label (medium)
Figure 41:
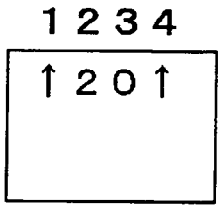
FIG. 41 is a diagram illustrating a print example of the single margin label (small)
Figure 42:
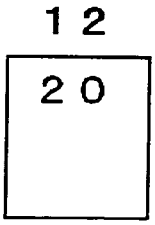
FIG. 42 is a diagram illustrating a print example of the single margin label (mini)
Figure 43:
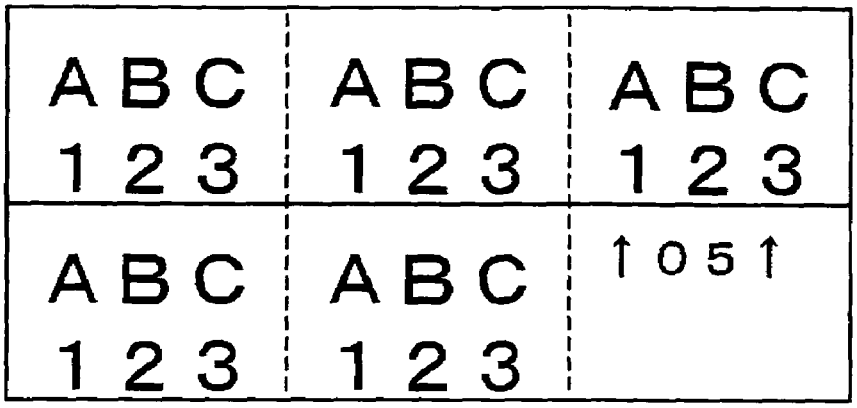
FIG. 43 is a diagram illustrating a print example of a usage example 1 of the single margin label.
Figure 44:
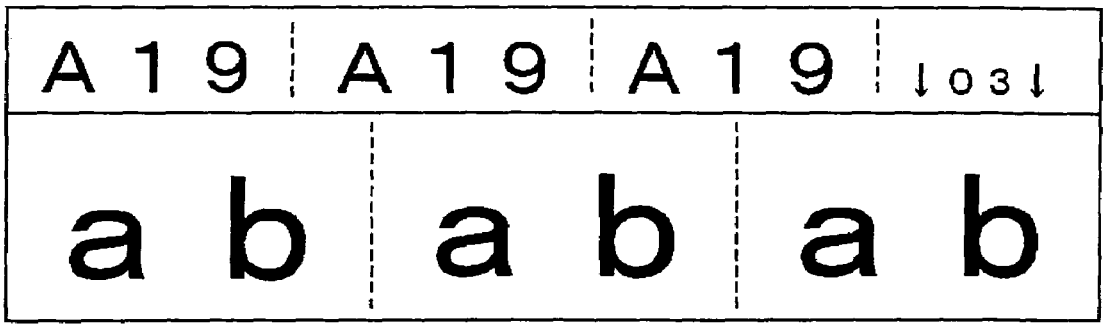
FIG. 44 is a diagram illustrating a print example of a usage example 2 of the single margin label.

Here, the single margin label will be described in detail with reference to FIGS. 39 to 44. FIG. 39 is a diagram illustrating a print example of the single margin label (large). FIG. 40 is a diagram illustrating a print example of the single margin label (medium). FIG. 41 is a diagram illustrating a print example of the single margin label (small). FIG. 42 is a diagram illustrating a print example of the single margin label (mini). FIG. 43 is a diagram illustrating a print example of a usage example 1 of the single margin label. FIG. 44 is a diagram illustrating a print example of a usage example 2 of the single margin label. FIGS. 39 to 42 are configured by the images of the single margin labels enclosed with squares of solid lines and the numbers arranged thereon. The numbers represent the pitches of characters which are converted using the character of the minimum size to be used when being printed on the normal label in the first exemplary embodiment. Specifically, the size is the one to be used when the text of two lines is arranged in the upper row of the 9 mm-A tape (or the lower row of the 9 mm-B tape). The single margin label and the margin label to be described later are printed by using the size of the characters.

As shown in FIGS. 39 to 42, the lengths of 17 characters, 11 characters, 4 characters, and 2 characters (including spaces between the characters, which is applied to the following description) are needed as the margins for the single margin label (large), the single margin label (medium), the single margin label (small), and the single margin label (mini), respectively. Therefore, the margin having the length of more than or equal to 17 characters of the size is the single margin label (large). The margin having the length of more than or equal to 11 and less than 17 characters of the size is the single margin label (medium). The margin having the length of more than or equal to 4 and less than 11 characters of the size is the single margin label (small). The margin having the length of more than or equal to 2 and less than 4 characters of the size is the single margin label (mini). The margin having the length of less than 2 characters of the size, no characters are printed in the single margin label.

The single margin label (large) shown in FIG. 39 is obtained when the single margin is produced in the lower row of the tape with divisions. The first line includes "↑20↑" in which the left up-pointing arrow represents the position of the cut line, 20 represents the total number of labels or the total number of sets of two characters, and the right up-pointing arrow represents the position of the cut line again. The second line includes "2005/02/01 12:30" in which 2005/02/01 represents the year/month/date in the dominical year when being printed, and 12:30 represents the time when being printed. The text image is arranged while being aligned in the upper direction within the range of the single margin label. The range of the text image is a square area 60 which is represented by a dotted line and which is not printed on the label.

The single margin label (medium) shown in FIG. 40 is obtained when the single margin is produced in the lower row of the tape with divisions. The first line includes "↑20↑" in which the left up-pointing arrow represents the position of the cut line, 20 represents the total number of labels or the total number of sets of two characters, and the right up-pointing arrow represents the position of the cut line again. The second line includes "2005/02/01" which represents the year/month/date in the dominical year when being printed. The text image is arranged while being aligned in the upper direction within the range of the single margin label.

The single margin label (small) shown in FIG. 41 is obtained when the single margin is produced in the lower row of the tape with divisions. The single margin label (small) includes "↑20↑" in which the left up-pointing arrow represents the position of the cut line, 20 represents the total number of labels or the total number of sets of two characters, and the right up-pointing arrow represents the position of the cut line again. The text image is arranged while being aligned in the upper direction within the range of the single margin label. The single margin label (mini) shown in FIG. 42 is obtained when the single margin is produced in the lower row of the tape with divisions. The single margin label (mini) includes "20" which represents the total number of labels or the total number of sets of two characters. The text image is arranged while being aligned in the upper direction within the range of the single margin label.

When the single margin label is arranged in the upper row of the tape with the divisions, the first line and the second line are replaced by each other in the single margin label (large) and the single margin label (medium) which contain the text of the print contents of two lines. In that case, since the cut line is positioned underneath the single margin label, the up-pointing arrows are also changed for down-pointing arrows (↓) in the single margin label (large), the single margin label (medium), and the single margin label (small). Further, the text images are arranged while being aligned downward in all the single margin labels. FIG. 43 is an example of applying the single margin label (small) to the lower row of the 9 mm-C tape. FIG. 44 is an example of applying the single margin label (small) to the upper row of the 9 mm-A tape.

The explanation will be made back to S136 of FIG. 21. Since the single margin label is made in the lower row in S136, a dedicated flag for passing the information to the process of making the image of the single margin label is provided in the memory 155 for other operations, and then the single margin label is set to be arranged in the lower row. Thereafter, the flow proceeds to S137 where the length of the single margin is calculated first. The difference in the tape longitudinal direction between the positions of the termination of the label that is arranged nearest to the apparatus 1 in the upper row of the tape and the termination of the label that is arranged nearest to the apparatus 1 in the lower row of the tape is calculated. It is calculated how many characters the length thus obtained corresponds to in the case of arranging the characters of the minimum size that is utilized on the normal label. The kinds of single margin labels (the kinds of large, medium, small, mini, no characters to be printed) are sorted by using the above-described standard of the number of characters.

Next, the text for the single margin label is made. The single margin label (large) is exemplified as an example. The flag information which is provided in the memory. for other operations and which indicates the position where the single margin label is made is obtained. When the information represents that the single margin label is to be made in the lower row and the single margin label (large) is to be made, a text model of "↑↑, a line feed code, ,//, ,:" (",," represents merely a segment, which is applied to the following description) is copied to the margin text buffer. The "" portion of "↑↑" at the head of the text is replaced by a character code of two digits into which the value of the set counter 147 is converted. In the next "//", the current year-month-day information is obtained from the timer 30 and then converted into the character codes in the "//" format which replaces the corresponding portions in the text model. In the next ":", the current time information is obtained from the timer 30 and then converted into the character codes in the ":**" format which replaces the corresponding portions in the text model. Thereby, the text for the single margin label (large) is made.

Next, the image of the text portion of the single margin label is made on the basis of the text. In this case too, the image buffer is temporarily obtained on the memory for other operations, and the respective character images are arranged on the image buffer by using the size and the space of the characters for the single margin in order to make the image of the text portion. The image of the text portion corresponds to one square area enough to cover whole the respective character images. The image of the single margin label is made in the above-described manner. When the single margin label is made in the lower row of the tape, the other text that becomes the models of the respective single margin labels is "↑↑, a feed line code, ,//" in the single margin label (medium), "↑↑" in the single margin label (small), and "" in the single margin label (mini). When the single margin label is made in the upper row of the tape, the other text that becomes the models of the respective single margin labels is "//, :, a feed line code, ↓↓" in the single margin label (large), "**//, a feed line code, ↓↓" in the single margin label (medium), "↓↓" in the single margin label (small), and "" in the single margin label (mini). The methods of making the image of the single margin label, other than the method of making the image of the single margin label (large) in the lower row of the tape, are pursuant to the above-described method of making the image of the single margin label (large) in the lower row of the tape (note that there is no case in the print 2 process that the single margin label is arranged in the upper row of the tape). Thereafter, the flow proceeds to S138.

In S138, the image of the single margin label is combined with the print image. Specifically, the flag information which is provided in the memory for other operations and which indicates the position (upper or lower row) where the single margin label is made is obtained. Since the information indicates that the single margin label is to be made in the lower row, the print image stored in the print buffer 140 is combined with the image of the single margin label so that the image of the text portion in the square area 60 is aligned upward with respect to the area of the single margin. If the single margin label is to be made in the upper row of the tape, the print image stored in the print buffer 140 is combined with the image of the single margin label so that the image of the text portion in the square area 60 is aligned downward with respect to the area of the single margin, which is not performed in the print 2 process. Thereafter, the flow proceeds to S139.

In S139, the image print is performed. Here, the thermal head 22 is made to be in cooperation with the tape feeding motor 23 while the head driving circuit 26 is synchronous with the motor driving circuit 27, and accordingly the print image stored in the print buffer 140 is printed on the tape. Thereafter, the flow proceeds to S140 where the lengths of the portions on which the labels are arranged in the divided tape upper and lower areas are compared with each other. Specifically, the termination of the label that is arranged nearest to the apparatus 1 in the upper row of the tape and the termination of the label that is arranged nearest to the apparatus 1 in the lower row of the tape are compared with each other (the label that is arranged nearest to the apparatus 1 does not include the single margin label, which is applied to the following description). The termination of the label can be obtained by adding the label starting position in the tape longitudinal direction to the label length. Thereafter, the flow proceeds to S141 where the tape piece is made in such a manner that the tape is cut at the termination of the label, which is arranged nearest to the apparatus 1, in the divided tape area that is found to be longer by comparison in S140. Thereafter, the print 2 process is terminated, and the flow returns to FIG. 18.

Next, the explanation will be made to S142 to which the flow proceeds when all the processes are not terminated in S134 (S134: NO). In S142, it is determined whether or not all the processes for the lower row are terminated. This is to determine whether or not the label made in the foregoing S132 to S133 is a label that is to be arranged in the lower row of the tape with divisions, and it is determined with the value of the row counter (not shown). If the row counter indicates the lower row (S142: YES), the flow proceeds to S143. If the row counter indicates the upper row (S142: NO), the flow proceeds to S151.

In S143, it is determined whether or not the tape is cut for each print. If the each-print cutting flag is ON by referring thereto, it is determined that the tape is cut for each print. If the tape is cut for each print (S143: YES), the flow proceeds to S144 where the print image stored in the print buffer 140 is printed on the tape. Thereafter, the flow proceeds to S145 where the lengths of the portions on which the labels are arranged in the divided tape upper and lower areas are compared with each other. Specifically, the termination of the label that is arranged nearest to the apparatus 1 in the upper row of the tape and the termination of the label that is arranged nearest to the apparatus 1 in the lower row of the tape are compared with each other. The termination of the label can be obtained by adding the label starting position in the tape longitudinal direction to the label length. Thereafter, the flow proceeds to S146 where the tape piece is made in such a manner that the tape is cut at the termination of the label in the divided tape area that is found to be longer by comparison in S145. Thereafter, the print 2 process is terminated, and the flow proceeds to S147.

On the other hand, if it is determined that the tape is not cut for each print (S143: NO), the flow proceeds to S149 where the lengths of the portions on which the labels are arranged in the divided tape upper and lower areas are compared with each other. Specifically, the termination of the label that is arranged nearest to the apparatus 1 in the upper row of the tape and the termination of the label that is arranged nearest to the apparatus 1 in the lower row of the tape are compared with each other. Thereafter, the flow proceeds to S150 where a cut line image covering the whole range of the tape width is added at the termination of the label on which the image is made and which is arranged nearest to the apparatus 1 in the divided tape area that is found to be longer by comparison in S149. Thereafter, the flow proceeds to S151 where the label starting position is updated. Specifically, the value of the upper row label starting position 148 in the tape longitudinal direction is incremented by only the upper row label length 149, and the upper row label length 149 is set to 0. Further, the value of the lower row label starting position 150 in the tape longitudinal direction is incremented by only the lower row label length 151, and the lower row label length 151 is set to 0. Thereafter, the flow proceeds to S147 where the respective variables are updated as needed in addition to the increment of the value of the set counter 147. Thereafter, the flow proceeds to S148 where the row counter (not shown) is updated to replace the setting of the upper and lower rows by the current setting. Thereafter, the flow returns to S132 where the above-described processes are repeated. The foregoing is the description of the print 2 process.

Figure 22:
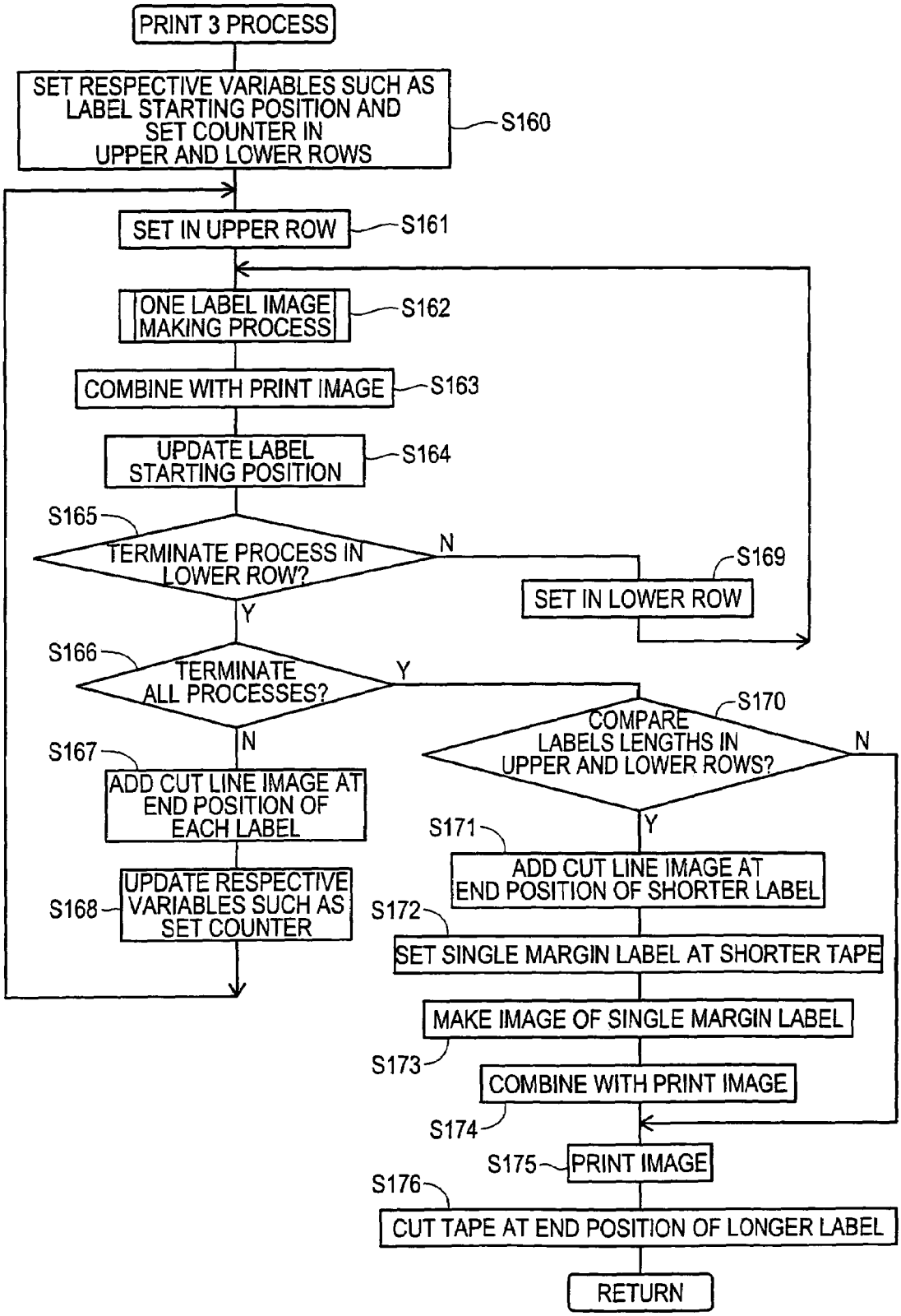
FIG. 22 is a flowchart of a print 3 process.

Next, the print 3 process will be described with reference to FIG. 22. FIG. 22 is a flowchart of the print 3 process. When the print 3 process is called in FIG. 18, the respective variables such as the label starting position and the set counter are set in S160. For example, since the tape has the divisions, all of the upper row label starting position 148 as the label starting position, the upper row label length 149 as the label length, the lower row label starting position 150 and the lower row label length 151 are used. The label starting position of the upper label in the tape width direction is set to 0, and the label starting position of the upper label in the tape longitudinal direction is set to 0. The label starting position of the lower label in the tape width direction is set to the width of the first row of the corresponding kind of tape in the tape information table 131, the label starting position in the tape longitudinal direction is set to 0, and the label length is set to 0 (the value is obtained by converting the label starting position or the label length into the length on the unit of the magnitudes of dots of the thermal head 22, which is applied to the following description). Further, the print buffer 140 is cleared, and the set counter 147 is set to 1. In addition, appropriate variables are set to predetermined values as needed.

Thereafter, the flow proceeds to S161 where the label to be made is set to be arranged in the upper row. For this setting, the row counter (not shown) of the memory for other operations is set to the upper row. Thereafter, the flow proceeds to S162 where the one label image making process is executed (the one label image making process was described above with reference to FIG. 20). Thereafter, the flow proceeds to S163, and then the label image and the print image are combined. Thereafter, the flow proceeds to S164 where the label starting position is updated. Specifically, the label starting position is updated by adding the label starting position in the tape longitudinal direction of the row indicated by the row counter (not shown) of the memory for other operations to the label length in the same row, and the label length is set to 0. Thereafter, the flow proceeds to S165 where it is determined whether or not the process was for the lower row. It is determined whether or not the row counter (not shown) indicates the lower row. If the lower row is indicated (S165: YES), the flow proceeds to S166. If the upper row is indicated (S165: NO), the flow proceeds to S169.

It is determined whether or not all the processes are terminated in S166. It is determined whether or not the set counter 147 matches the total number of sets 146. All the processes are terminated if the set counter 147 matches the total number of sets 146. If all the processes are terminated (S166: YES), the flow proceeds to S170. If all the processes are not terminated (S166: NO), the flow proceeds to S167. In S167, each image of the cut line having a length corresponding to the width of each row is added to the end position of the label arranged nearest to the apparatus 1 in each row. The update of the label starting position is completed in S164, so that the position corresponds to the value of the label starting position corresponding to each row in the tape longitudinal direction. Thereafter, the flow proceeds to S168 where the respective variables are updated as needed in addition to the increment of the value of the set counter 147. Thereafter, the flow proceeds to S161 to repeat the above-described processes again.

In S169 to which the flow proceeds when the upper row is indicated in S165 (S165: NO), the row counter (not shown) of the memory for other operations is set to the lower row. Thereafter, the flow proceeds to S162 to repeat the above-described processes again.

In S170 to which the flow proceeds when all the processes are terminated in S166 (S166: YES), it is determined whether or not the tape lengths are different in the upper and lower rows. It means whether or not the lengths of the portions on which the labels are arranged in the divided tape upper and lower areas are different from each other. Specifically, the termination of the label that is arranged nearest to the apparatus 1 in the upper row of the tape and the termination of the label that is arranged nearest to the apparatus 1 in the lower row of the tape are compared with each other.

Since the label starting position is updated in S164, it is determined by comparing the values of the label starting positions of the respective rows in the tape longitudinal direction with each other. If these values are equal to each other (S170: NO), the flow proceeds to S175. If these values are not equal to each other (S170: YES), the flow proceeds to S171. In S171, the cut line image is added to the end position of the shorter tape, which means that the cut line image, which has a length corresponding to the shorter portion among the portions on which the labels are arranged in the divided tape upper and lower areas, is added to the end of the shorter portion. The end position corresponds to the value of the label starting position of the shorter portion in the tape longitudinal direction.

Next, the image of the single margin label is made in S172 to S174 to be combined with the print image. In S172, the single margin label is set to be arranged in the divided tape area which has a shorter label area. Since the single margin label is made only in the lower row of the tape with division in the print 2 process of FIG. 21, the process of "setting in the lower row" in S136 does not make too much sense. However, the single margin label can be made in the upper or lower row in the print 3 process. Therefore, the single margin label is set to be made in either one of the upper and lower row. If the making of the image of the single margin label (S173 to be described later) and the combining of the print image with the image of the single margin label (S174 to be described later) are performed, it is conceivable that S173 and S174 are in common with the making of the image of the single margin label (S137) and the combining of the print image with the image of the single margin label (S138) in the print 2 process of FIG. 21. Therefore, the reason of providing S136 is to switch the process between the print 2 and 3 processes depending on the condition in which the single margin label is made in the upper or lower row. After S172, the flow proceeds to S173 where the image of the single margin label is made. Then, the flow proceeds to S174 where the image of the single margin label is combined with the image of the print image. S172 is pursuant to S137 of FIG. 21. S174 is pursuant to S138 of FIG. 21. Thereafter, the flow proceeds to S175.

The print image stored in the print buffer 140 is printed on the tape in S175. Thereafter, the flow proceeds to S176 where the tape is cut at the end of the longer portion among the portions on which the labels are arranged in the divided tape upper and lower areas. Specifically, the longer portion has a larger value determined by comparing the values of the label starting positions in the tape longitudinal direction in the respective rows with each other (any one of the respective values does not include the length of the single margin label). This is the end of the description of the print 3 process.

Figure 23:
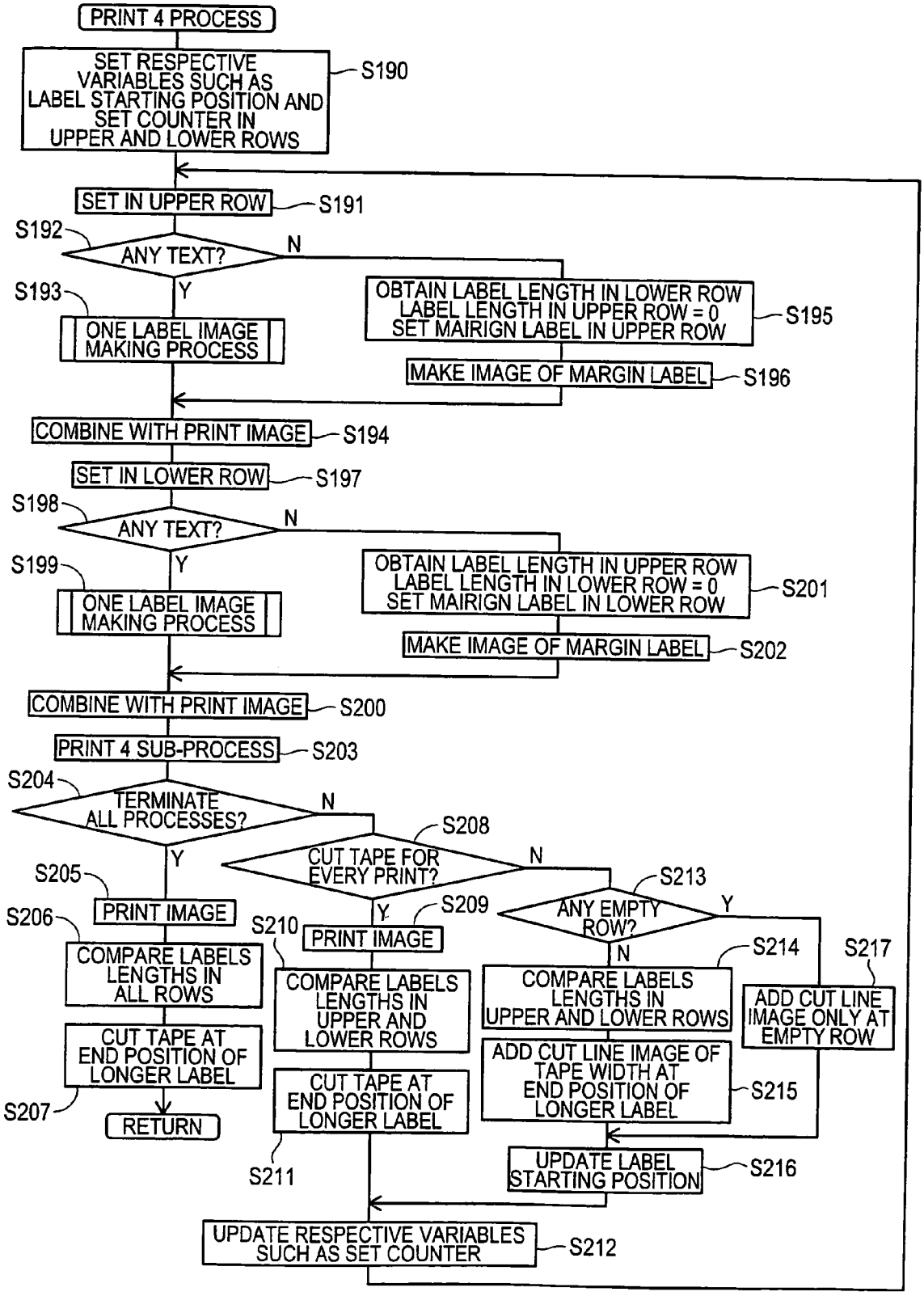
FIG. 23 is a flowchart of a print 4 process.

Next, the print 4 process will be described with reference to FIG. 23. FIG. 23 is a flowchart of the print 4 process. When the print 4 process is called in FIG. 18, the respective variables such as the label starting position and the set counter are set in S190. For example, since the tape has the divisions, all of the upper row label starting position 148 as the label starting position, the upper row label length 149 as the label length, the lower row label starting position 150 and the lower row label length 151 are used. The label starting position of the upper label in the tape width direction is set to 0, the label starting position of the upper label in the tape longitudinal direction is set to 0, and the label length of the upper label is set to 0. The label starting position of the lower label in the tape width direction is set to the width of the first row of the corresponding kind of tape in the tape information table 131, the label starting position of the lower label in the tape longitudinal direction is set to 0, and the label length of the lower label is set to 0 (the value is obtained by converting the label starting position or the label length into the length on the unit of the magnitudes of dots of the thermal head 22, which is applied to the following description). Further, the print buffer 140 is cleared, and the set counter 147 is set to 1. In addition, appropriate variables are set to predetermined values as needed. Thereafter, the flow proceeds to S191 where the label to be made is set to be arranged in the upper row. For this setting, the row counter (not shown) of the memory for other operations is set to the upper row.

Thereafter, the flow proceeds to S192 where it is determined whether or not there is text. To determine this, it is confirmed whether or not there is text in the text buffer a for operations (not shown) in the memory 155 for other operations. If there is text (S192: YES), the flow proceeds to S193. If there is no text (S192: NO), the flow proceeds to S195. In S193, the one label image making process is executed (the one label image making process was described with reference to FIG. 20). Thereafter, the flow proceeds to S194.

On the other hand, in S195 to which the flow proceeds after it is determined that there is no text in S192 (S192: NO), the label length in the lower row is calculated.

The calculation of the label length is almost the same as the making of the label image as described above, and is different in that the label image is not made on the label image buffer. The lengths of the head margin, the character string of the longest line, and the tail margin make the length of the label. If the text has one line, the line becomes the longest line. If the text has two lines, a longer line becomes the longest line. The length of the character string of the longest line is obtained as follows. The number of text codes included in the longest line is multiplied by the size of the character width, and the value thus obtained is added to the value which is obtained by multiplying the predetermined length between the characters by the value that is obtained by subtracting 1 from the number of text codes included in the longest line.

The size of the character width is calculated as follows. First, the width of the row (the width 131*c* of the first row or the width 131*d* of the second row) on which the label is to be pasted is obtained with reference to the tape information table 131 by using the type of division 143 and the row counter (not shown). On the other hand, the number of lines of the text stored in the text buffer for operations (not shown) corresponding to the row counter (not shown) is obtained. The font size to be used for print on the label is obtained as follows. A predetermined value is multiplied by the value which is obtained by dividing the width of the row by the number of lines of the text, and the value thus obtained is reduced. The pitch of the character is a fixed pitch, and if the font size is the same, the pitch of the character is not changed. The foregoing is merely an example of making the label image. Thus, it goes without saying that if the switching of the vertical writing/horizontal writing of character strings, the setting of enlargement/reduction of characters, the setting of bold characters, outline characters, shadow-casting characters, and italic characters, and the setting of adding a frame to a whole label are possible as needed, the length of the label may change due to the adaptation to the above switching and setting functions.

Further, the upper row label length 149 is set to 0 in S195. Since the margin label is made in the upper row at this time, a dedicated flag for passing the information to the process of making the image of the margin label is provided in the memory 155 for other operations, and then the margin label is set to be made in the upper row. Thereafter, the flow proceeds to S196 where the image of the margin label is made.

Here, the margin label will be described. The above-described single margin label and the margin label are different in that the number of single margin labels to be made is one at most in a series of prints, whereas the margin label is made every time one set of labels or one label is made except special cases when a plurality of sets or sheets of normal labels are printed. Another difference is that the value of the number of sets counter (the number of labels counter) is added to the print contents.

Figure 49:
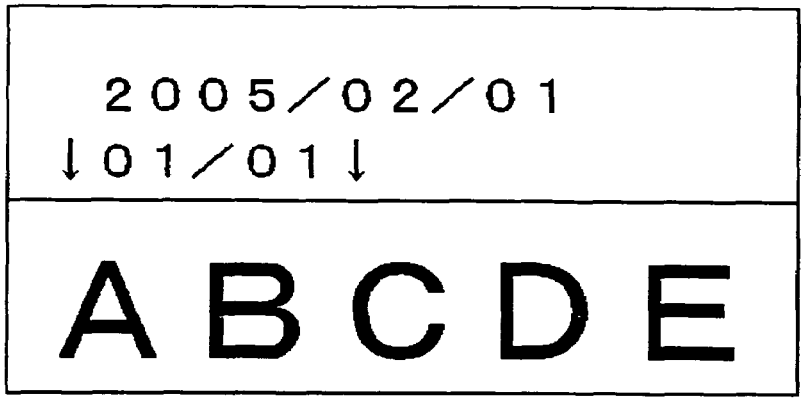
FIG. 49 is a diagram illustrating a print example of a usage example 1 of the margin label.
Figure 50:
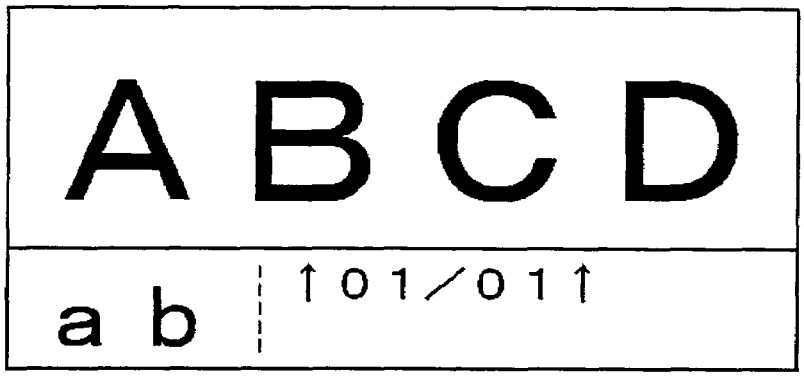
FIG. 50 is a diagram illustrating a print example of a usage example 2 of the margin label.
Figure 51:
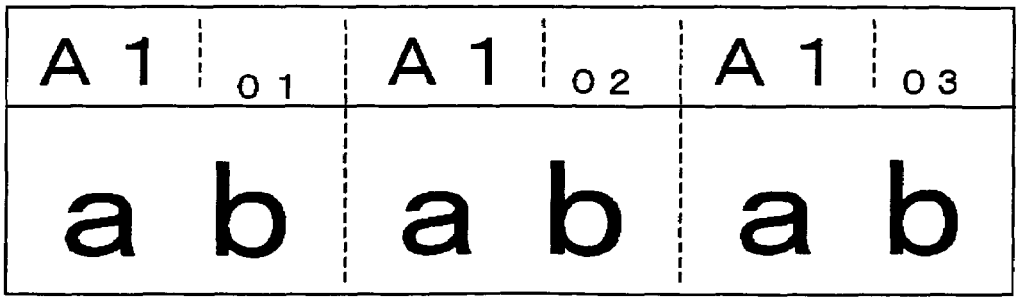
FIG. 51 is a diagram illustrating a print example of a usage example 3 of the margin label.

Here, the margin label will be described in detail with reference to FIGS. 45 to 53. FIG. 45 is a diagram illustrating a print example of the margin label (large). FIG. 46 is a diagram illustrating a print example of the margin label (medium). FIG. 47 is a diagram illustrating a print example of the margin label (small). FIG. 48 is a diagram illustrating a print example of the margin label (mini). FIG. 49 is a diagram illustrating a print example of a usage example 1 of the margin label. FIG. 50 is a diagram illustrating a print example of a usage example 2 of the margin label. FIG. 51 is a diagram illustrating a print example of a usage example 3 of the margin label. FIG. 52 is a diagram illustrating a print example of another example 1 of the margin label. FIG. 53 is a diagram illustrating a print example of another example 2 of the margin label.

FIGS. 45 to 48 are configured by the images of the margin labels enclosed with squares and the numbers arranged thereon. As similar to the above-described single margin label, the numbers represent the pitches of characters which are converted using the character of the minimum size to be used when being printed on the normal label in the first exemplary embodiment. The label is made by using the size and the pitch. As shown in FIGS. 45 to 48, the lengths of 17 characters, 11 characters, 7 characters, and 2 characters (including spaces between the characters) are needed as the margins for the margin label (large), the margin label (medium), the margin label (small), and the margin label (mini), respectively. Therefore, the margin having the length of more than or equal to 17 characters of the size is the margin label (large). The margin having the length of more than or equal to 11 and less than 17 characters of the size is the margin label (medium). The margin having the length of more than or equal to 7 and less than 11 characters of the size is the margin label (small). The margin having the length of more than or equal to 2 and less than 7 characters of the size is the margin label (mini). The margin having the length of less than 2 characters of the size, no characters are printed in the margin.

The margin label (large) shown in FIG. 45 is obtained when the margin is produced in the lower row of the tape with divisions. The first line includes "↑01/20↑" in which the left up-pointing arrow represents the position of the cut line, the fraction representation (of 5 characters) represents the value of the number of sets counter or the number of labels counter of 2 characters for numerator and the value of the total number of labels or the total number of sets of 2 characters for denominator, and the right up-pointing arrow represents the position of the cut line again. The second line includes "2005/02/01 12:30" in which 2005/02/01 represents the year/month/date in the dominical year when being printed, and 12:30 represents the time when being printed. The text image is arranged while being aligned in the upper direction within the range of the margin label.

The margin label (medium) shown in FIG. 46 is obtained when the margin is produced in the lower row of the tape with divisions. The first line includes "↑01/20↑" in which the left up-pointing arrow represents the position of the cut line, the fraction representation (of 5 characters) represents the value of the number of sets counter or the number of labels counter of 2 characters for numerator and the value of the total number of labels or the total number of sets of 2 characters for denominator, and the right up-pointing arrow represents the position of the cut line again. The second line includes "2005/02/01" which represents the year/month/date in the dominical year when being printed. The text image is arranged while being aligned in the upper direction within the range of the margin label.

The margin label (small) shown in FIG. 47 is obtained when the margin is produced in the lower row of the tape with divisions. The first line includes "↑01/20↑" in which the left up-pointing arrow represents the position of the cut line, the fraction representation (of 5 characters) represents the value of the number of sets counter or the number of labels counter of 2 characters for numerator and the value of the total number of labels or the total number of sets of 2 characters for denominator, and the right up-pointing arrow represents the position of the cut Line again. The text image is arranged while being aligned in the upper direction within the range of the margin label. The margin label (mini) shown in FIG. 48 is obtained when the margin is produced in the lower row of the tape with divisions. The margin label (mini) includes "01" which represents the value of the number of sets counter or the number of labels counter of two characters. The text image is arranged while being aligned in the upper direction within the range of the margin label.

When the margin label is arranged in the upper row of the tape with the divisions, the first line and the second line are replaced by each other in the margin label (large) and the margin label (medium) which contain the text of the print contents of two lines. In that case, since the cut line is positioned underneath the margin label, the up-pointing arrows are also changed for down-pointing arrows in the margin label (large), the margin label (medium), and the margin label (small). Further, the text images are arranged while being aligned downward in all the margin labels. FIG. 49 is an example of applying the margin label (medium) to the upper row of the 9 mm-C tape. FIG. 50 is an example of applying the margin label (small) to the lower row of the 9 mm-B tape. FIG. 51 is an example in which three sets of labels are printed by copy print on the 9 mm-A tape and the margin labels are applied to the upper row.

FIG. 52 is an example of adding a file name to the print contents of the margin label as another exemplary embodiment. "FL01" is added after "01/20" in FIG. 45. The "FL01" represents the file name. In a memory function for storing text in a memory other than the text buffer in editing, the file name is stored together with text being named. Note that the file name has 4 characters. The addition of the file name may be applicable to not only the margin label, but also the single margin label.

Further, in FIG. 53, a line made by print is drawn in parallel with and adjacent to the half cut line as another exemplary embodiment, instead of the arrows which indicate the half cut line and which are of the print contents in the margin label. The line in parallel with the half cut line is utilized instead of the arrows in FIG. 49. It is desirable that the line is positioned on the margin label while being slightly apart from the half cut line because the line in this position does not give the label (which is not the margin) bad appearance. However, the line may be positioned on the half cut line or may slightly protrude into the label (which is not the margin), if the user does not care. The change of indication for the position of the half cut line may be applied to not only the margin label, but also the single margin label.

The margin label has the following two kinds. The whole areas of the divided tape areas on the side, on which the labels are not arranged, in the divided tape pieces are used as the margin labels as shown in FIG. 29. The margins generated by the differences in lengths between the upper labels and lower labels like the margins 53*a*, 53*b*, and 53*c* as shown in FIG. 25 are used as the margin labels. The images of the former margin labels are made in S196 and S202 to be described later (refer to FIG. 23), and the images of the latter margin labels are made in S234 to be described later (refer to FIG. 24).

"The making of the image of the margin label" in the first exemplary embodiment will be described back again to S196 in FIG. 23. Here, the length of the margin is obtained first. The length is equal to the label length of the lower row calculated in S195. It is calculated how many characters the length thus obtained corresponds to in the case of arranging the characters of the minimum size that is utilized on the normal label. The kinds of margin labels (the kinds of large, medium, small, mini, no characters to be printed) are sorted by using the above-described standard of the number of characters. Next, the text for the margin label is made. The margin label (large) is exemplified as an example. The flag information which is provided in the memory for other operations and which indicates the position where the margin label is made is obtained. When the information represents that the margin label is to be made in the upper row and the margin label (large) is to be made, a text model of "**//, ,:, a line feed code, ↓/↓" (",," represents merely a segment, which is applied to the following description) is copied to a margin text buffer. In the "//" portion at the head of the text, the current year-month-day information is obtained from the timer 30 and then converted into the character codes in the "//" format which replaces the corresponding portions in the text model. In the next ":", the current time information is obtained from the timer 30 and then converted into the character codes in the ":" format which replaces the corresponding portions in the text model. The  portion of "↓" is replaced by the character code of two digits into which the value of the set counter 147 is converted. The "" portion of the next "/" is replaced by the character code of two digits into which the value of the total number of sets 146** is converted. Thereby, the text for the margin label (large) is made.

Next, the image of the text portion of the margin label is made on the basis of the text obtained in the above-described manner. In this case too, the image buffer is temporarily obtained on the memory for other operations, and the respective character images, are arranged on the image buffer by using the size and the space of the characters for the margin in order to make the image of the text portion. The image of the text portion corresponds to one square area 60 enough to cover whole the respective character images. The image of the margin label is made in the above-described manner.

When the margin label is made in the upper row of the tape, the other text that becomes the models of the respective margin labels is "**//, a line feed code, ↓/↓" in the margin label (medium), "↓/↓" in the margin label (small), and "" in the margin label (mini). When the margin label is made in the lower row of the tape, the other text that becomes the models of the respective margin labels is "↑/↑, a feed line code, ,**//, ,:" in the margin label (large), "↑/↑, a feed line code, ///" in the margin label (medium), "↑/↑" in the margin label (small), and "**" in the margin label (mini). The methods of making the image of the margin label, other than the method of making the image of the margin label (large) in the upper row of the tape, are pursuant to the above-described method of making the image of the margin label (large) in the upper row of the tape.

Thereafter, the flow proceeds to S194 where the label image is combined with the print image. Thereafter, the flow proceeds to S197 where the label is set to be arranged in the lower row. For this setting, the row counter (not shown) of the memory for other operations is set to the lower row. Thereafter, the flow proceeds to S198 where it is determined whether or not there is text. To determine this, it is confirmed whether or not there is text in the text buffer b for operations (not shown) in the memory 155 for other operations. If there is text (S198: YES), the flow proceeds to S199. If there is no text (S198: NO), the flow proceeds to S201. In S199, the one label image making process is performed (the one label image making process was described with reference to FIG. 20). Thereafter, the flow proceeds to S200.

On the other hand, in S201 to which the flow proceeds after it is determined that there is no text in S198 (S198: NO), the label length in the upper row is obtained. It can be obtained by reading the label length which is calculated in the one label image making process in S193 and which is stored in the upper row label length 149. Further, the lower row label length 151 is set to 0 in S193. Since the margin label is made in the lower row at this time, a dedicated flag for passing the information to the process of making the image of the margin label is provided in the memory 155 for other operations, and then the margin label is set to be arranged in the lower row. Next, the flow proceeds to S202 where the image of the margin label is made. The process for making the image is pursuant to the process in S196. Thereafter, the flow proceeds to S200 where the label image is combined with the print image. Thereafter, the flow proceeds to S203 where a print 4 sub-process is executed. The print 4 sub-process will be described later with reference to FIG. 24. Thereafter, the flow proceeds to S204 where it is determined whether or not all the processes are terminated. It is determined whether or not the set counter 147 matches the total number of sets 146. All the processes are terminated if the set counter 147 matches the total number of sets 146. If all the processes are terminated (S204: YES), the flow proceeds to S205. If all the processes are not terminated (S204: NO), the flow proceeds to S208.

The image print is performed in S205. Here, the thermal head 22 is made to be in cooperation with the tape feeding motor 23 while the head driving circuit 26 is synchronous with the motor driving circuit 27, and accordingly the print image stored in the print buffer 140 is printed on the tape. Thereafter, the flow proceeds to S206 where the lengths of the labels in the upper and lower rows are compared with each other. Specifically, the upper row label length 149 is compared with the lower row label length 151. Thereafter, the flow proceeds to S207 where the tape piece is made in such a manner that the tape is cut at the position where the longer label length is added to the label starting position in the tape longitudinal direction in the row that is found to be longer by comparison in S206. Thereafter, the print 4 process is terminated, and the flow returns to FIG. 18.

In S208, it is determined whether or not the tape is cut for each print. If the each-print cutting flag 154 is ON by referring thereto, it is determined that the tape is cut for each print. If the tape is cut for each print (S208: YES), the flow proceeds to S209 where the print image stored in the print buffer 140 is printed on the tape. Thereafter, the flow proceeds to S210 where the lengths of the labels in the upper and lower rows are compared with each other. Specifically, the upper row label length 149 is compared with the lower row label length 151. Thereafter, the flow proceeds to S211 where the tape piece is made in such a manner that the tape is cut at the position where the longer label length is added to the label starting position in the tape longitudinal direction in the row that is found to be longer by comparison in S210. Thereafter, the flow proceeds to S212.

On the other hand, if it is determined that the tape is not cut for each print (S208: NO), the flow proceeds to S213 where it is determined whether or not there is an empty row. To determine this, it is confirmed whether or not any one of the text buffer a for operations (not shown) and the text buffer b for operations (not shown) is empty. If any of them is not empty (S213: NO), the flow proceeds to S214. If any of them is empty (S213: YES), the flow proceeds to S217. In S214, the lengths of the labels in the upper and lower rows are compared with each other. Specifically, the upper row label length 149 is compared with the lower row label length 151. Thereafter, the flow proceeds to S215 where the cut line image covering the whole range of the tape width is added to the print image at the position where the longer label length is added to the label starting position in the tape longitudinal direction in the row that is found to be longer by comparison in S214 (the cut line image corresponds to the cut line 512*a* or 512*b* in FIG. 28). Thereafter, the flow proceeds to S216.

On the other hand, in S217, the cut line image is added to the print image at the position where the label length in the row including text is added to the label starting position in the tape longitudinal direction in the row including text. However, the cut line image is added only to the row including no text, and has a length corresponding to the width of the divided tape area in the row including no text (the cut line image corresponds to the cut line 513*a*, 513*b*, 513*c*, or 513*d* in FIG. 31). Thereby, unnecessary prints due to the cut line images are not left on the labels. Thereafter, the flow proceeds to S216 where the label starting position is updated. Specifically, the values of the positions where the cut lines are added in S215 or S217 are set to both the upper row label starting position 148 in the tape longitudinal direction and the lower row label starting position 150 in the tape longitudinal direction. Further, the upper row label length 149 and the lower row label length 151 are set to 0. Thereafter, the flow proceeds to S212 where the respective variables are updated as needed in addition to the increment of the value of the set counter 147. Thereafter, the flow returns to S191 to repeat the above-described processes. The foregoing is the description of the print 4 process.

Figure 24:
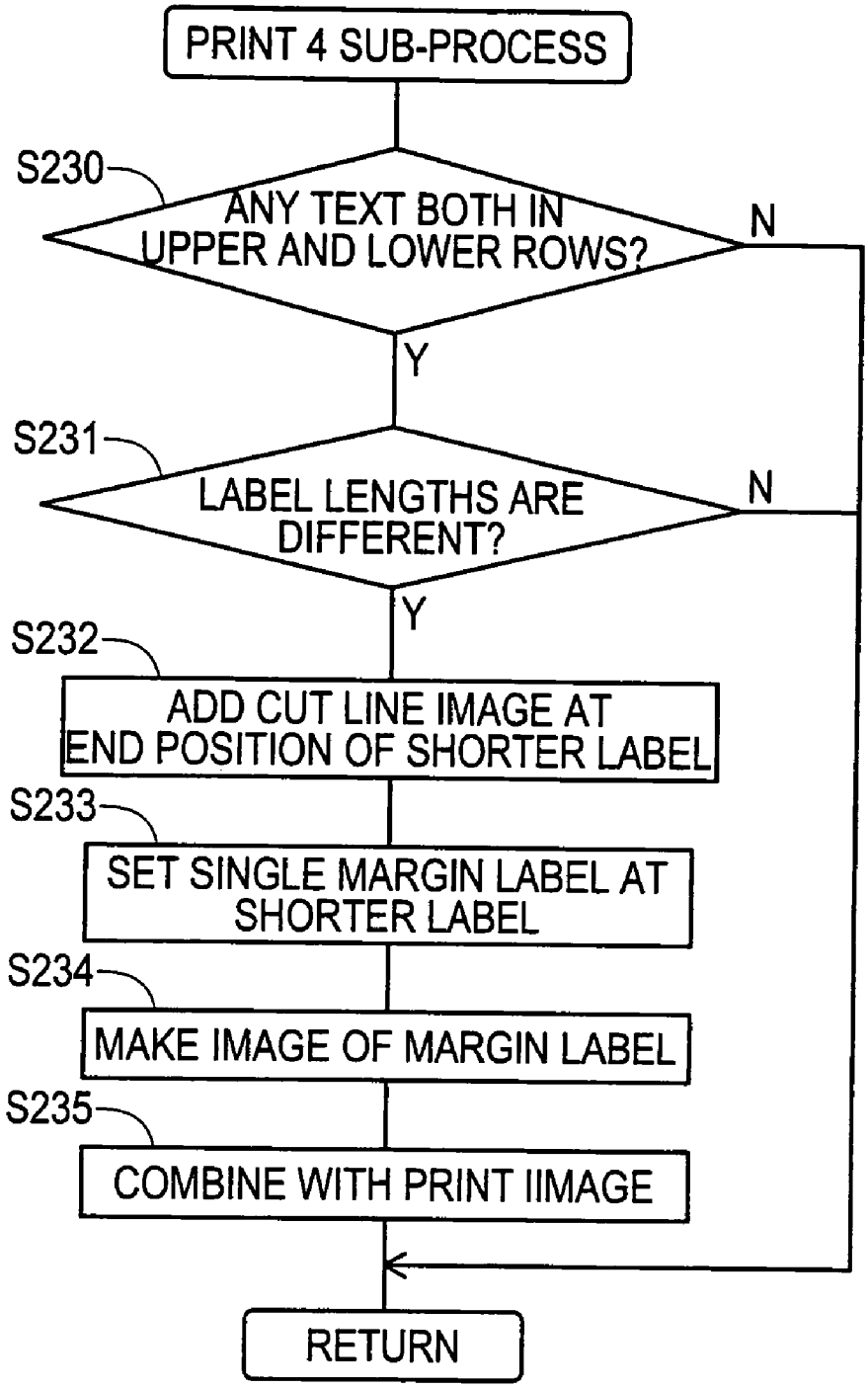
FIG. 24 is a print 4 sub-process.

Next, the print 4 sub-process will be described with reference to FIG. 24. If the print 4 sub-process is called in S203 of FIG. 23, it is determined whether or not there is text in both the upper and lower rows. To determine this, it is confirmed whether or not there is text in both the text buffer a for operations (not shown) and the text buffer b for operations (not shown). If there is no text in one of them (S230: NO), the print 4 sub-process is terminated and the flow returns to FIG. 23. If there is text in both of them (S230: YES), the flow proceeds to S231. Here, it is determined whether or not the upper and lower labels are different in length from each other. The upper row label length 149 is compared with the lower row label length 151. If the lengths are equal to each other (S231: NO), the print 4 sub-process is terminated and the flow returns to FIG. 23. On the other hand, If the lengths are not equal to each other (S231: YES), the flow proceeds to S232 where the cut line image is added to the end position of the shorter label. Specifically, the cut line image having a length corresponding to the width of the divided tape area where the shorter labels are arranged is added to the divided tape area where the shorter labels are arranged (the cut line image corresponds to the cut line 510*a*, 510*b*, or 510*c* in FIG. 28).

Thereafter, the flow proceeds to S233 where the margin label is set to be provided on the shorter label side. Specifically, a dedicated flag for passing information about which division of the upper and lower rows the margin label is made in to the process of making the image of the margin label is provided in the memory 155 for other operations, and the margin label is set to be provided on the shorter label side. Thereafter, the flow proceeds to S234 where the image of the margin label is made. The width of the margin is obtained by subtracting the shorter length from the longer length between the upper row label length 149 and the lower row label length 151. It is determined which kind of margin label is to be made by using the number of disposable characters calculated on the basis of the width. Other than that, the processes are pursuant to the processes of making the image of the margin label in S196 and S202. The margin labels are arranged in the margins 53*a*, 53*b*, and 53*c* in FIG. 25 or 28. Thereafter, the flow proceeds to S235 where the margin label is combined with the print image. Thereafter, the print 4 sub-process is terminated, and the flow returns to FIG. 23. The foregoing is the description of the print 4 sub-process.

The foregoing is the description of the first exemplary embodiment.

Second Exemplary Embodiment

Figure 63:
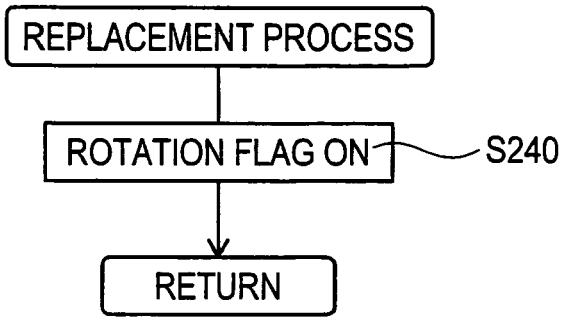
FIG. 63 is a flowchart of a replacing process according to the second exemplary embodiment.
Figure 64:
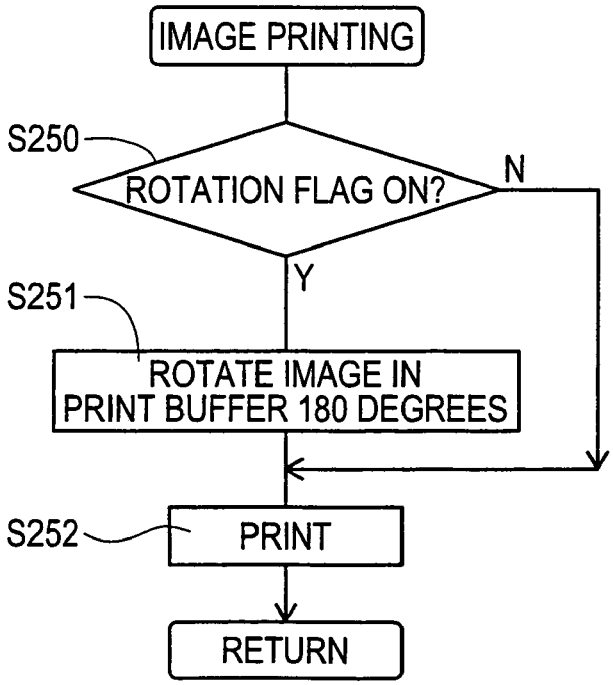
FIG. 64 is a flowchart of an image print process.
Figure 65:
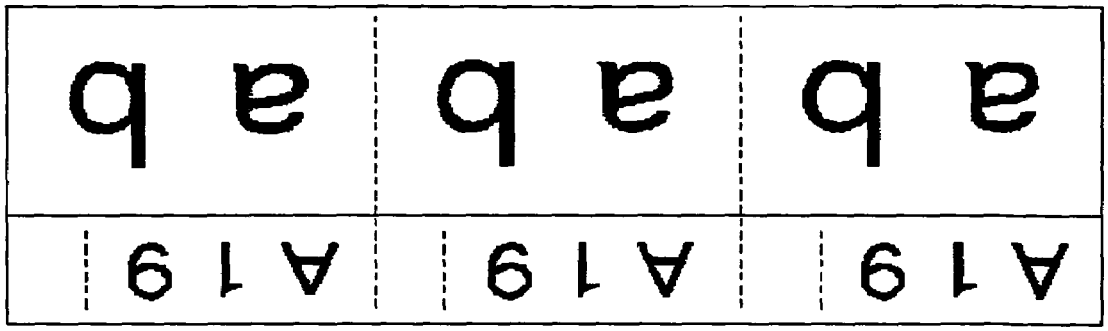
FIG. 65 is a diagram illustrating an example in which labels conform to a different kind of tape.

Next, the second exemplary embodiment will be described. The second exemplary embodiment is almost the same as the first exemplary embodiment except that a part of the processes in the first exemplary embodiment is replaced by other processes in the second exemplary embodiment, while leaving the mechanical and electrical configuration of the label making apparatus 1 in the first exemplary embodiment as they are. Thus, the second exemplary embodiment will be described emphasizing on only the points different from the first exemplary embodiment. The second exemplary embodiment will be described with reference to FIGS. 63 to 65. FIG. 63 is a flowchart of a replacing process according to the second exemplary embodiment. FIG. 64 is a flowchart of an image print process. FIG. 65 is a diagram illustrating an example in which labels conform to a different kind of tape. In the case where the cassette accommodating a tape which is different from the one supposed to be accommodated is mounted in the label making apparatus 1, the positions of the labels to be arranged in the rows of the divided tape are replaced by each other when being printed in the template input mode in the first exemplary embodiment as shown FIG. 38. In the second exemplary embodiment, the whole print images on the tape are rotated 180 degrees as shown in FIG. 65 to conform to the different kind of tape.

Figure 16:
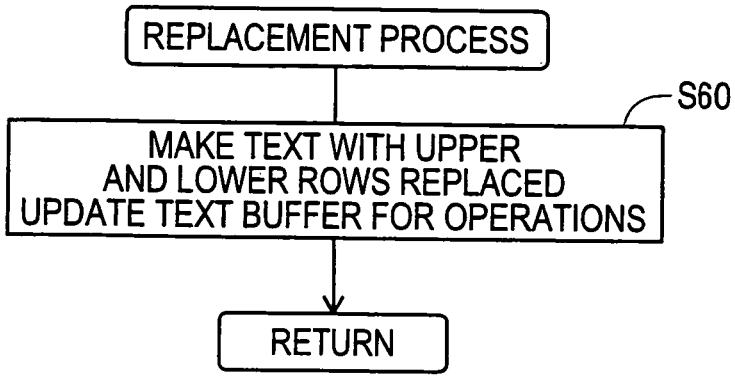
FIG. 16 is a flowchart of a replacement process.

FIG. 63 is an alternative to the replacing process in FIG. 16 according to the first exemplary embodiment. When the replacing process is called in S57 of FIG. 15, a rotation flag (not shown) of the memory 155 for other operations is set to ON. Thereafter, the replacing process is terminated, and the flow returns to FIG. 15. The rotation flag is not provided in the first exemplary embodiment, and the flag is cleared in the initialization in S1 of FIG. 11.

Next, FIG. 64 is an alternative to the steps (S95 and S98 of FIG. 19, S139 and S144 of FIG. 21, S175 of FIG. 22, and S205 and S209 of FIG. 23 ) of the respective image prints according to the first exemplary embodiment. When this process is called, first, it is determined whether or not the rotation flag (not shown) of the memory 155 for other operations is ON. If the rotation flag is ON (S250: YES), the flow proceeds to S251 where the rotation flag is set to OFF, a tape image that is a print image in the print buffer 140 is rotated 180 degrees about the center or the tape image, and the contents of the print buffer 140 is updated by using the new print image thus made. Thereafter, the flow proceeds to S252. On the other hand, if the rotation flag is OFF (S250: NO), the flow proceeds to S252 where the print image in the print buffer 140 is printed on the tape. Thereafter, the image print process is terminated, and the flow returns to the step which was called.

In this case, after the whole tape image is made, the whole tape image is rotated 180 degrees to make the print image. However, the label image may be made with respect to each of the labels and then rotated 180 degrees, and the label and the cut line may be arranged at the position being rotated 180 degrees from the position, at which the label and the cut line are supposed to be arranged, about the center of the tape.

The whole tape image is rotated 180 degrees so that the relative positional relation between the respective labels to be made is not changed and each of the labels is not rotated on one label basis. Therefore, it is convenient because the label assembly being output is the same as the one when making the labels with the tape initially designed.

The foregoing the description of the second exemplary embodiment.

Figure 32:
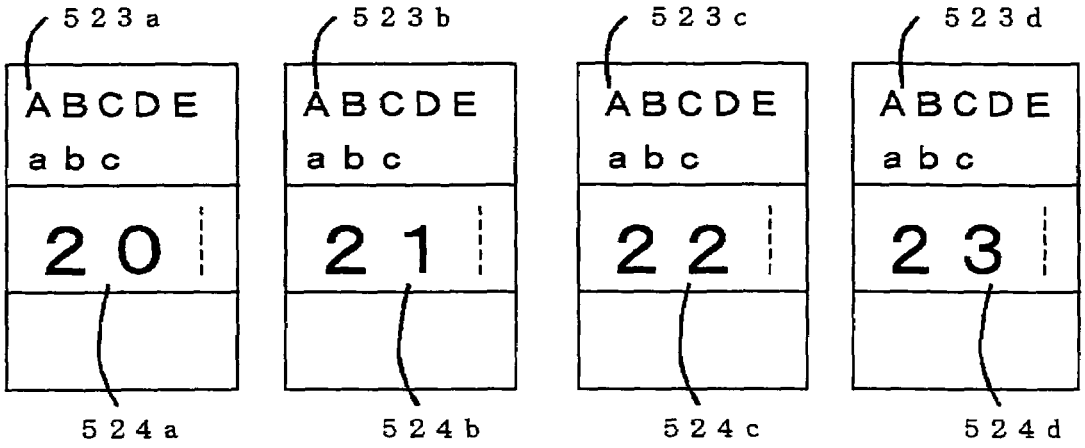
FIG. 32 is a diagram illustrating a print example of a label image when the tape with three rows (1:1:1 divisions) is cut for each print.
Figure 33:
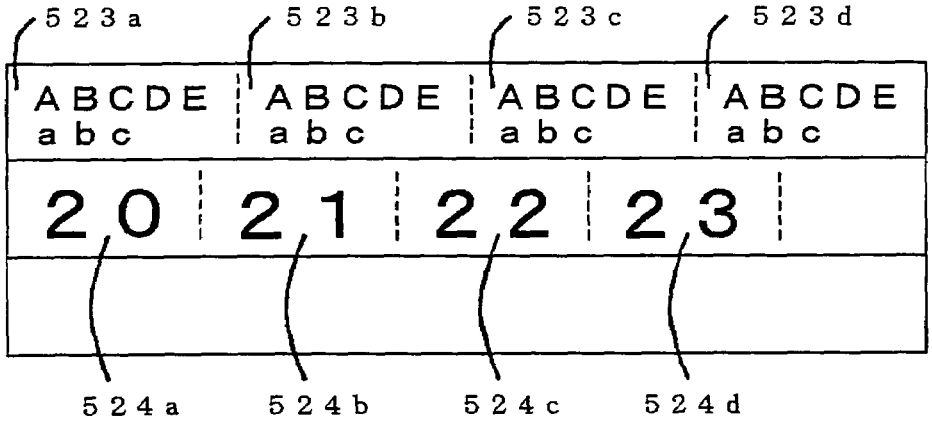
FIG. 33 is a diagram illustrating a print example of aligning in the tape longitudinal direction of the tape with three rows (1:1:1 divisions)
Figure 34:
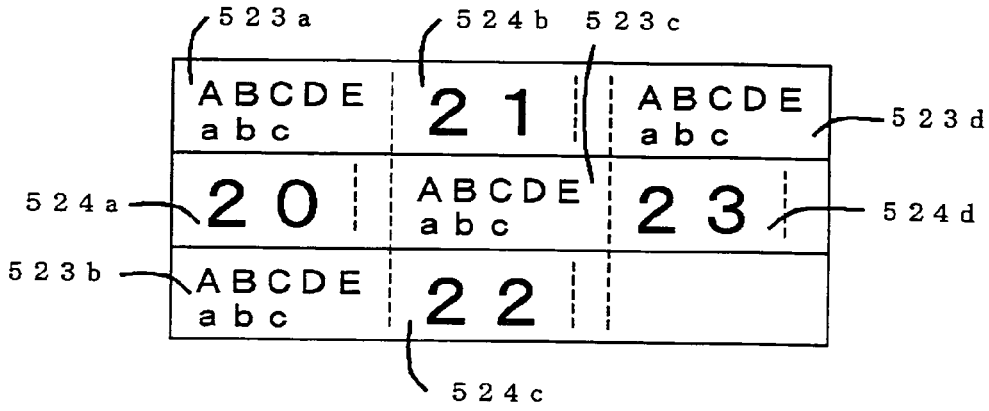
FIG. 34 is a diagram illustrating a print example of aligning in the tape width direction of the tape with three rows (1:1:1 divisions)
Figure 35:
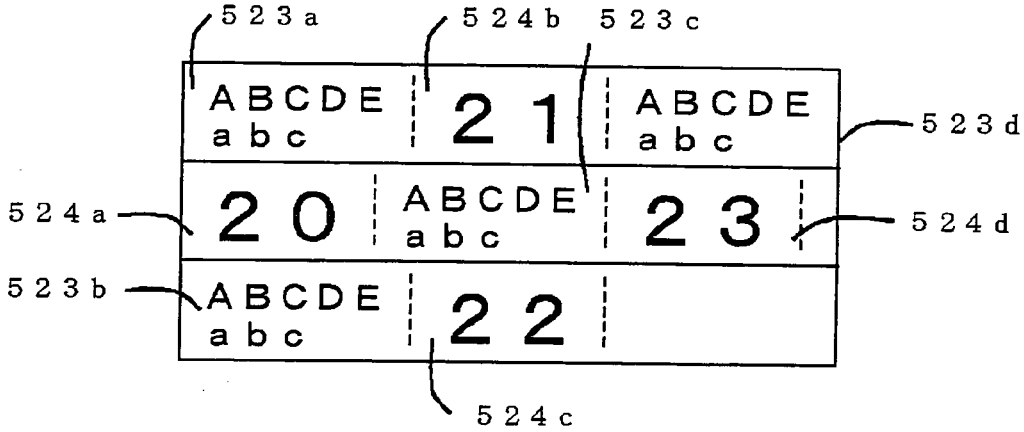
FIG. 35 is a diagram illustrating a print example of aligning in the tape width direction and in the tape longitudinal direction of the tape with three rows (1:1:1 divisions)
Figure 36:
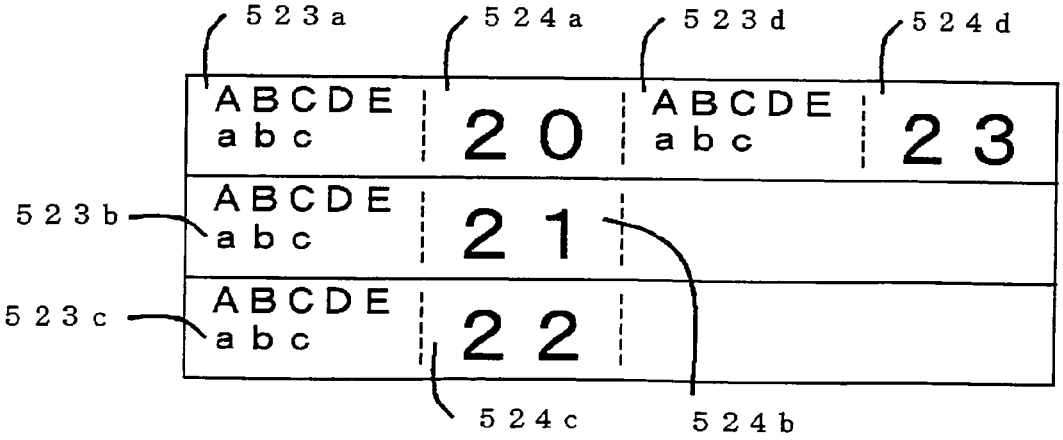
FIG. 36 is a diagram illustrating a print example in which the arrangement of the label assembly is recombined in the tape longitudinal direction.

Examples of applying the disclosure to a tape divided at a ratio of 1:1:1 as another exemplary embodiment will be described with reference to FIGS. 32 to 36. FIG. 32 is a diagram illustrating a print example of a label image when the tape with three rows (1:1:1 divisions) is cut for each print. FIG. 33 is a diagram illustrating a print example of aligning in the tape longitudinal direction of the tape with three rows (1:1:1 divisions). FIG. 34 is a diagram illustrating a print example of aligning in the tape width direction of the tape with three rows (1:1:1 divisions). FIG. 35 is a diagram illustrating a print example of aligning in the tape width direction and in the tape longitudinal direction of the tape with three rows (1:1:1 divisions). FIG. 36 is a diagram illustrating a print example in which the arrangement of the label assembly is recombined in the tape longitudinal direction. The explanation will be made in detail below.

In FIG. 32, there are made four label sets (assemblies), each of which includes a label of "ABCDE, a feed line, abc" of the print contents and a label being numbered starting from the text "20" of the print contents. The first set of a label 523*a* and a label 524*a* is arranged on the tape piece disposed on the extreme left. The second set of a label 523*b* and a label 524*b* is arranged on the tape piece disposed in the second place from the extreme left. The third set of a label 523*c* and a label 524*c* is arranged on the tape piece disposed in the third place from the extreme left. The fourth set of a label 523*d* and a label 524*d* is arranged on the tape piece disposed on the extreme right. The labels 523*a*, 523*b*, 523*c*, and 523*d* are arranged in the divided tape areas of the upper row of the tape. The labels 524*a*, 524*b*, 524*c*, and 524*d* are arranged in the divided tape areas of the middle row of the tape. No labels are arranged in the divided tape areas of the lower row of the tape. It can be understood that the tape with three divisions is an extension of the tape with two divisions in FIG. 25 according to the first exemplary embodiment. Since a plurality of labels on one tape piece belong to the same assembly, a user can easily grasp the boundary of the assemblies. Since there are many cases that one assembly of labels corresponds to the amount of one-time use, it is possible to carry the labels to be required for only one-time usage.

In FIG. 33, each of the labels in the same divided tape area is arranged in the tape longitudinal direction while being adjacent to each other on one tape piece without dividing into tape pieces, unlike the configuration in which each set of labels is arranged on each of the tape pieces in FIG. 32. It can be understood that the tape with three divisions is an extension of the tape with two divisions in FIG. 27 according to the first exemplary embodiment. It is possible to reduce the number of unnecessary tape chips because the margins can be assembled as compared to the case in FIG. 32. The lower row is not taken up in this example because the lower row includes no labels. However, in the case where the labels are arranged even in the lower row, the margins can be assembled to thereby increase the amount of information when useful information is printed by utilizing the margins.

In FIG. 34, other sets (assemblies) of labels are arranged in the empty area of the divided tape on one tape piece without dividing into tape pieces, unlike the configuration in which each set of labels is arranged on each of the tape pieces in FIG. 32. It can be understood that the tape with three divisions is an extension of the tape with two divisions in FIGS. 28 and 30 according to the first exemplary embodiment. With this configuration, the empty area can be effectively used, and the length itself of the tape to be used can be shortened. Further, the cutting of the tape can be easily carried out because the labels are aligned.

In FIG. 35, the respective labels shown in FIG. 34 are arranged while being aligned in the tape longitudinal direction. It can be understood that the tape with three divisions is an extension of the tape with two divisions in FIGS. 27 and 30 according to the first exemplary embodiment. With this configuration, the length itself of the tape to be used can be shortened.

In FIG. 36, the labels included in the same label set (assembly) are arranged without spaces in each of the divided tape areas while being aligned in the tape width direction. With this configuration, the cutting of the tape can be easily carried out because the labels are aligned. Further, when the sets (assemblies) of labels are made in multiples of the number of the divided tape areas (in this case, three), it is possible to utilize the tape in the most effective manner.

The arrangement as shown in FIGS. 34 to 36 is possible in the tape which is evenly divided. However, the arrangement as shown in FIGS. 32 to 33 is possible even in the tape which is not evenly divided.

Figure 37:
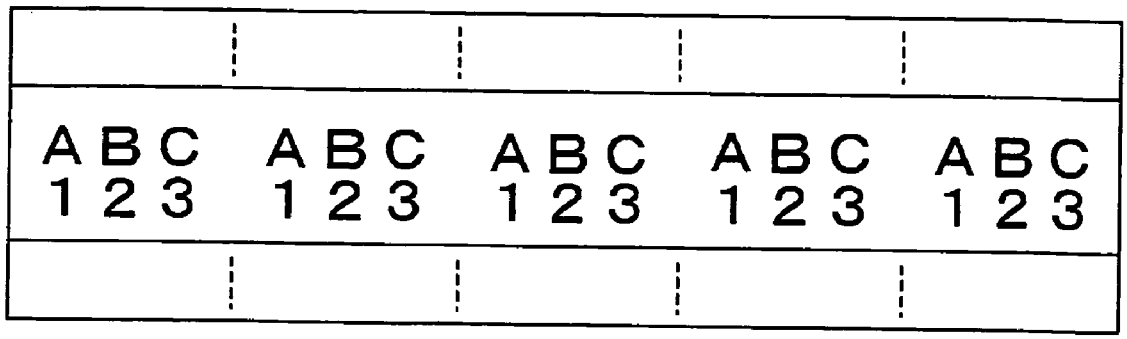
FIG. 37 is a diagram illustrating a print example in which the cut lines are displayed in the margins of the tape with three rows (1:2:1 divisions)

Examples of applying the disclosure to a tape divided at a ratio of 1:2:1 as another exemplary embodiment will be described with reference to FIG. 37. FIG. 37 is a diagram illustrating a print example in which the cut lines are displayed in the margins of the tape with three rows (1:2:1 divisions). Although FIG. 37 is a modified example of FIG. 31, in the case where the divided tape areas in which the labels are not arranged are disposed above and below the divided tape area (middle row) in which the labels are arranged, the cut lines between labels are not arranged in the divided tape area (middle row) in which the labels are arranged, but in both the divided tape areas (upper and lower rows) disposed above and below the divided tape area (middle row) in which the labels are arranged. With this configuration, when being used as labels, the prints of unnecessary cut lines are not left on the labels. Further, a user can easily target the cutting positions due to the two marks when the user cuts the tape with his/her hands.

The disclosure is not limited to the tape with two or three divisions, but may be applicable to a tape with four or more divisions. Further, it can be easily understood by the ordinary skilled in the art that the number of labels belonging to the sets of labels is not limited to one or two, but more number of labels can be adapted by increasing the number of text buffers while associating with the print processes.

Further, it is apparent that the maximum number of labels belonging to the sets of labels is not necessarily equal to the maximum number of divisions of the tape.

Further, in the first exemplary embodiment, the number which appears first in searching the text being stored in the text buffer from its end is incremented and a carry is not performed. However, as another exemplary embodiment, a carry may be performed, the number of characters may increase with a carry, an alphabet character may be changed in order of alphabet without using numbers, and the range of changeable text may be specified.

Further, only the tape of 9 mm width is used as the divided tape in the first exemplary embodiment. However, the tapes of other widths such as 24 mm may be used as the divided tapes in another exemplary embodiment. The divisions may be formed in the tapes of all kinds of widths.

Further, the labels may include illustrations, bar codes, frames, and the like as yet another exemplary embodiment.

Further, the pitch of the character may not be fixed.

Various changes other than the description incorporated herein may be added within a range without departing from the gist of the disclosure.

The thermal head 22, the head driving circuit 26, the tape feeding motor 23, and the motor driving circuit 27 function as the printing device, and the cutter 24 and the cutter driving circuit 28 function as the cutting device. The CPU 12 for executing the determination of whether or not to cut the tape, the calculation of the label length, the update of the label starting position, and the like functions as the label arrangement unit in the processes that follow the print main process in accordance with the setting by the user in the label arrangement setting process and the kind of cassette sensor mounted in the label making apparatus. Further, the CPU 12 for executing the steps (S95 and S98 of FIG. 19, S139 and S144 of FIG. 21, S175 of FIG. 22, and S205 and S209 of FIG. 23) of the respective image prints in the first exemplary embodiment and the print process in S252 in the second exemplary embodiment functions as the print control unit. Further, the CPU 12 for setting the number of print sets or the number of print labels in S70 functions as the number-of-labels setting unit (the number of labels is indirectly set by setting the number of sets). Further, the CPU 12 for executing the process of the text conversion in S112 and S116 functions as the character string generation unit.

The text buffer a 144 and the text buffer b 145 function as the label-set storing unit. Further, the CPU for setting the number of print sets in S70 functions as the number of assemblies setting unit. Further, the CPU 12 for calculating the label length while making the label image in S113 and S117 and calculating the label length in the lower row in S195 functions as the label length calculating unit. Further, the CPU 12 for executing the process of comparing the label lengths between the upper and lower rows with each other in S210, S214 and S145 or the process for comparing the termination of the label arranged nearest to the apparatus 1 in the upper row of the tape with the termination of the label arranged nearest to the apparatus 1 in the lower row of the tape in S140 and S149 (these steps are substantially the same as comparing the label lengths with each other because the lengths of the labels are previously known to be the same) functions as the label length comparing unit. Further, the CPU 12 for reading the cassette sensor 31 and the kind of cassette in S50 functions as the tape information obtaining unit.

What is claimed is:

1. A label making apparatus comprising:

a printing device for printing print contents on tapes that are sequentially fed into the label making apparatus;

a label arrangement unit for setting an arrangement of a number of different labels on a tape by a predetermined arrangement rule;

a print control unit for controlling the printing device to print on a tape with the arrangement of the number of labels by the label arrangement unit, wherein each tape comprises a printed layer, an adhesive layer, and a separating layer, and also includes a half cut line which extends in the tape longitudinal direction across at least the printed layer to divide, in a tape width direction, a plurality of tape areas, the plurality of areas including a first tape area and a second tape area;

a number-of-labels setting unit for setting the number of labels to be printed, wherein the label arrangement unit sets the arrangement of the number of labels, which has been set by the number-of-labels setting unit, in each of the plurality of tape areas divided with the half cut line so that the label making apparatus makes the labels to be printed on a tape area narrower than a tape, wherein:

labels to be printed in the plurality of tape areas of one tape form a label-set, and the label arrangement unit determines whether a stored total number of label-sets is one, when the stored total number of label-sets is determined to be one, labels in the plurality of tape areas are printed; and when the stored total number of label-sets is determined not to be one, labels of different label-sets that are to be printed sequentially in corresponding first tape areas of sequential tapes form a first sequence of labels, labels of different label-sets that are to be printed sequentially in corresponding second tape areas of the sequential tapes form a second sequence of labels, and the label arrangement unit receives a selection for the first and second sequences of labels to independently change print contents according to the predetermined arrangement rule; and a cutting device for cutting the printed tape to separate the number of labels.

2. The label making apparatus according to claim 1, further comprising:

a character string generation unit for generating a character string including one or more characters each of which is changed by a predetermined character change rule when the labels are printed in the set number, wherein each of the print contents to be printed on the labels has the character string generated by the character string generation unit.

3. The label making apparatus according to claim 1, further comprising:

a label-set storing unit for storing one or more labels as a set, wherein the label arrangement unit sets the arrangement of the labels belonging to the predetermined set stored in the label-set storing unit by the predetermined arrangement rule.

4. The label making apparatus according to claim 3, further comprising:

a number-of-sets setting unit for setting a number of sets stored in the label-set storing unit, wherein the label arrangement unit sets the arrangement of the labels included in the number of sets which is set by the number-of-sets setting unit by the predetermined arrangement rule.

5. The label making apparatus according to claim 1, wherein the label arrangement rule is made to arrange the number of labels without space in the tape longitudinal direction.

6. The label making apparatus according to claim 1, wherein the label arrangement rule is made to arrange the number of labels of same lengths in parallel in the tape width direction.

7. The label making apparatus according to claim 1, further comprising:

a tape information obtaining unit for obtaining tape information including at least one of a width of the tape, a number of half cut lines which extend in the tape longitudinal direction, and a position of each half cut line, a width of each of the labels is arranged in the tape width direction and is obtained from the tape information obtained by the tape information obtaining unit.

8. The label making apparatus according to claim 1, further comprising:

a label length calculating unit for calculating lengths, in the tape longitudinal direction, of the number of labels which are arranged in parallel in the tape width direction;

a label length comparing unit for comparing the lengths calculated by the label length calculating unit, in the tape longitudinal direction, of each of the number of labels, and a label determination unit for specifying a longest one of the labels the length of which has been calculated by the label length comparing unit, wherein the label arrangement unit sets the arrangement of the labels except for the longest label within an area in a longitudinal direction of the longest label and in parallel with the longest label.

9. The label making apparatus according to claim 8, wherein all the number of labels are the labels stored in the same set.

10. The label making apparatus according to claim 8, wherein the number of labels comprises the labels which are stored in two or more different sets.

11. The label making apparatus according to claim 8, a tape information obtaining unit for obtaining tape information including at least one of a width of the tape, the number of half cut lines which extend in the tape longitudinal direction, and the position of the half cut line, wherein a width of each of the labels is arranged in the tape width direction and is obtained from the tape information which is obtained by the tape information obtaining unit.

* * * * *